US007210617B2

(12) United States Patent
Chaum

(10) Patent No.: US 7,210,617 B2
(45) Date of Patent: May 1, 2007

(54) SECRET-BALLOT SYSTEMS WITH VOTER-VERIFIABLE INTEGRITY

(76) Inventor: David Chaum, 14652 Sutton St., Sherman Oaks, CA (US) 91403

( * ) Notice: Subject to any disclaimer, the term of this patent is extended or adjusted under 35 U.S.C. 154(b) by 0 days.

(21) Appl. No.: 10/348,547

(22) Filed: Jan. 21, 2003

(65) Prior Publication Data

US 2003/0158775 A1 Aug. 21, 2003

Related U.S. Application Data

(60) Provisional application No. 60/412,749, filed on Sep. 23, 2002, provisional application No. 60/408,909, filed on Sep. 7, 2002, provisional application No. 60/358,109, filed on Feb. 20, 2002.

(51) Int. Cl.
*G07C 13/00* (2006.01)

(52) U.S. Cl. ..... 235/51; 235/386; 705/12

(58) Field of Classification Search ..... 235/51, 235/386, 487, 375, 486; 705/12; 283/103, 283/106

See application file for complete search history.

(56) References Cited

U.S. PATENT DOCUMENTS 3,650,210 A * 3/1972 Archer ..... 283/98
3,708,656 A * 1/1973 Fielder ..... 235/487
3,906,192 A * 9/1975 Cidade ..... 235/487
4,717,177 A * 1/1988 Boram ..... 283/5
4,864,302 A * 9/1989 Bowers ..... 341/13
5,484,996 A * 1/1996 Wood ..... 235/487
5,893,587 A * 4/1999 Wong ..... 283/98
5,895,075 A * 4/1999 Edwards ..... 283/81
6,318,757 B1 * 11/2001 Ritchie et al. ..... 283/75
6,447,014 B1 * 9/2002 Seidl ..... 283/81
6,457,643 B1 * 10/2002 Way ..... 235/462.01
6,779,727 B2 * 8/2004 Warther ..... 235/462.01
2001/0050998 A1 * 12/2001 Firan et al. ..... 382/112
2002/0133396 A1 * 9/2002 Barnhart ..... 705/12
2002/0175514 A1 * 11/2002 Warther ..... 283/5
2005/0121528 A1 * 6/2005 Lubow ..... 235/494

* cited by examiner

*Primary Examiner*—Thien M. Le
*Assistant Examiner*—Edwyn Labaze
(74) *Attorney, Agent, or Firm*—Clark & Brody

(57) ABSTRACT

An election system provides, in one example, each voter with multiple physical "layers" that the voter is able to choose between. The voter takes part of the layers as a kind of receipt and the other layers are retained and/or destroyed by the system. The actual vote is not readily revealed by the layers taken by the voter, thus protecting against improper influence. In the voting booth, when all the layers are combined, however, the voter is readily able to verify the vote. Moreover, posted images of the layers not taken by the voter can be used to compute the election results in a way that is verifiable by interested parties. The results cannot be changed without substantial probability of detection and privacy of votes can be maintained unless a number of parties are compromised or collude.

10 Claims, 40 Drawing Sheets

2 Bush, 3 Gore, 1 Nader
3

❶
❷ Bush, ❶ Gore, ❸ Nader 1 2 3
Nader Bush Gore
3

Gore Bush Nader

Nader Gore ✓
Nader ✓

Nader
Bush 2
3

7 A
14 Z
19 9
24 6
28 4
35 H
42 5
48 S
52 U
60 L
71 9
78 2
85 5
90 V
95 A
104 4
111 J
119 W
122 6
S
L
N
V

1 Dianne Feinstein; 2 Barbara Boxer; 3 Mike Thompson; 4 Wally Herger;
5 Douglas Ose; 6; 7 John T. Doolittle; 8 Robert T. Matsui; 9 Lynn C. Woolsey;
10 George Miller; 11 Nancy Pelosi; 12 Barbara Lee; 13 Ellen O. Tauscher;
14; 15 Richard W. Pombo; 16 Tom Lantos; 17 Fortney Pete Stark;
18 Anna G. Eshoo; 19 Mike Honda; 20 Zoe Lofgren; 21 Sam Farr;
22 Gary A. Condit; 23 George P. Radanovich; 24; 25 Calvin M. Dooley;
26 William M. Thomas; 27 Lois Capps; 28 Elton Gallegly; 29 Brad Sherman;
30 Howard P. "Buck" McKeon; 31 Howard L. Berman; 32; 33 Adam Schiff;
34 David Dreier; 35 Henry A. Waxman; 36 Xavier Becerra; 37 Hilda A. Solis;
38 Lucille Roybal-Allard; 39 Grace Flores Napolitano; 40; 41 Maxine Waters;
42; 43 Jane Harman; 44 Juanita Millender-McDonald; 45 Stephen Horn;
46 Edward R. Royce; 47; 48 Jerry Lewis; 49 Gary G. Miller; 50 Joe Baca;
51 Ken Calvert; 52 Mary Whitaker Bono; 53; 54 Dana Rohrabacher;
55 Loretta Sanchez; 56 Christopher Cox; 57 Darrell Issa; 58 Susan A. Davis;
59 Bob Filner; 60; 61 Randy "Duke" Cunningham; 62 Duncan Hunter;
63 Dianne Feinstein; 64 Barbara Boxer; 65 Mike Thompson; 66 Wally Herger;
67 Douglas Ose; 68 John T. Doolittle; 69 Robert T. Matsui; 70 Lynn C. Woolsey;
71; 72 George Miller; 73 Nancy Pelosi; 74 Barbara Lee; 75 Ellen O. Tauscher;
76 Richard W. Pombo; 77 Tom Lantos; 78; 79 Fortney Pete Stark;
80 Anna G. Eshoo; 81 Mike Honda; 82 Zoe Lofgren; 83 Sam Farr;
84 Gary A. Condit; 85; 86 George P. Radanovich; 87 Calvin M. Dooley;
88 William M. Thomas; 89 Lois Capps; 90 Elton Gallegly; 91 Brad Sherman;
92 Howard P. "Buck" McKeon; 93 Howard L. Berman; 94; 95 Adam Schiff;
96 David Dreier; 97 Henry A. Waxman; 98 Xavier Becerra; 99 Hilda A. Solis;
100 Lucille Roybal-Allard; 101 Grace Flores Napolitano; 102 Maxine Waters;
103; 104 Jane Harman; 105 Juanita Millender-McDonald; 106 Stephen Horn;
107 Edward R. Royce; 108 Jerry Lewis; 109 Gary G. Miller; 110 Joe Baca;
111; 112 Ken Calvert; 113 Mary Whitaker Bono; 114 Dana Rohrabacher;
115 Loretta Sanchez; 116; 117 Christopher Cox; 118 Darrell Issa;
119 Yes on "A"; 120 No on "A"; 121 No on "B"; 122 Yes on "B"

Fig. 8

Governor 7; Lieutenant Governor 14; Secretary of State 19; State Controller 24; State Treasurer 28; Attorney General 35; Insurance Commissioner 42; Board of Equalization - District 5 48; U.S. Senate 52; U.S. Congress - District 7 60; State Senate - District 2 71; State Assembly - District 22 78; Supreme Court 85; Appellate Court - District 3 90; Appellate Court - District 3 - Division 1 95; Superintendent of Public Instruction 105

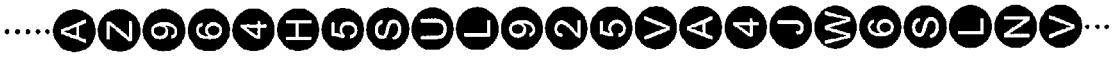

1 Dianne Feinstein; 2 Barbara Boxer; 3 Mike Thompson; 4 Wally Herger; 5 Douglas Ose; 6; 7 John T. Doolittle; 8 Robert T. Matsui; 9 Lynn C. Woolsey; 10 George Miller; 11 Nancy Pelosi; 12 Barbara Lee; 13 Ellen O. Tauscher; 14; 15 Richard W. Pombo; 16 Tom Lantos; 17 Fortney Pete Stark; 18 Anna G. Eshoo; 19 Mike Honda; 20 Zoe Lofgren; 21 Sam Farr; 22 Gary A. Condit; 23 George P. Radanovich; 24; 25 Calvin M. Dooley; 26 William M. Thomas; 27 Lois Capps; 28 Elton Gallegly; 29 Brad Sherman; 30 Howard P. "Buck" McKeon; 31 Howard L. Berman; 32; 33 Adam Schiff; 34 David Dreier; 35 Henry A. Waxman; 36 Xavier Becerra; 37 Hilda A. Solis; 38 Lucille Roybal-Allard; 39 Grace Flores Napolitano; 40; 41 Maxine Waters; 42; 43 Jane Harman; 44 Juanita Millender-McDonald; 45 Stephen Horn; 46 Edward R. Royce; 47; 48 Jerry Lewis; 49 Gary G. Miller; 50 Joe Baca; 51 Ken Calvert; 52 Mary Whitaker Bono; 53; 54 Dana Rohrabacher; 55 Loretta Sanchez; 56 Christopher Cox; 57 Darrell Issa; 58 Susan A. Davis; 59 Bob Filner; 60; 61 Randy "Duke" Cunningham; 62 Duncan Hunter; 63 Dianne Feinstein; 64 Barbara Boxer; 65 Mike Thompson; 66 Wally Herger; 67 Douglas Ose; 68 John T. Doolittle; 69 Robert T. Matsui; 70 Lynn C. Woolsey; 71; 72 George Miller; 73 Nancy Pelosi; 74 Barbara Lee; 75 Ellen O. Tauscher; 76 Richard W. Pombo; 77 Tom Lantos; 78; 79 Fortney Pete Stark; 80 Anna G. Eshoo; 81 Mike Honda; 82 Zoe Lofgren; 83 Sam Farr; 84 Gary A. Condit; 85; 86 George P. Radanovich; 87 Calvin M. Dooley; 88 William M. Thomas; 89 Lois Capps; 90 Elton Gallegly; 91 Brad Sherman; 92 Howard P. "Buck" McKeon; 93 Howard L. Berman; 94; 95 Adam Schiff; 96 David Dreier; 97 Henry A. Waxman; 98 Xavier Becerra; 99 Hilda A. Solis; 100 Lucille Roybal-Allard; 101 Grace Flores Napolitano; 102 Maxine Waters; 103; 104 Jane Harman; 105 Juanita Millender-McDonald; 106 Stephen Horn

Fig. 9

Fig. 10

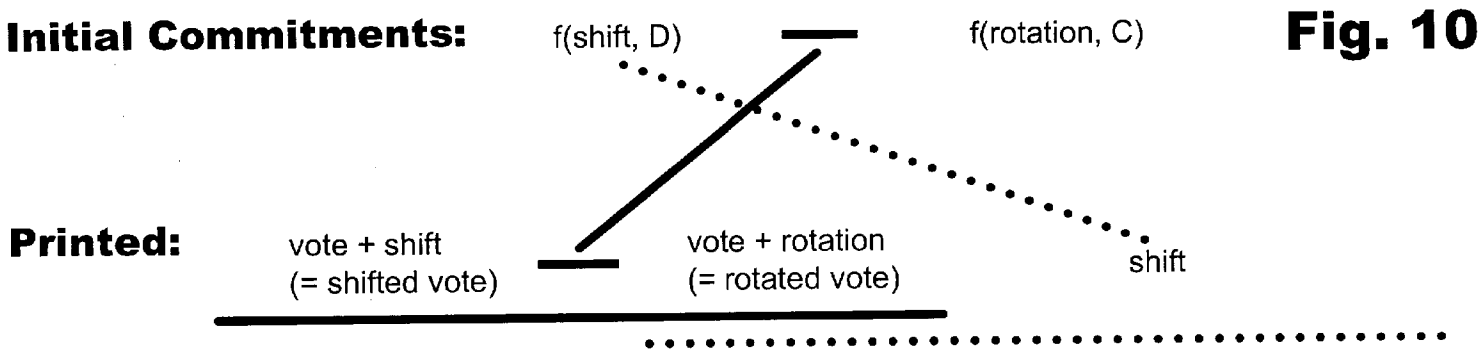

Inspection of paper by voter:

*Establishes that the relationship between the printed shift and shifted vote corresponds to the voter's vote.*

Case A:

rotated vote shifted vote

Show that: [committed <rotation> – <shift>]
= rotated vote – shifted vote

*Establishes that the rotated vote is determined correctly by the shifted vote and both commits.*

Case B:

rotated vote shift, D

*Establishes that the committed shift corresponds to the printed shift.*

Results:

*If what is established by case "A" and "B" were both to be established, then the rotated vote would be established to be the voter's vote plus the committed rotation.*
*If the rotated vote is not correctly formed, then this fact will be revealed by at least one of "A" and "B".*

```
1001222309161310270720 09
```

```
ABCDEFGHIJKLMNOPQRSTUVWXYZ_-
1220012202201121022001011101
5125985814330279860474616723
```

Fig. 13a

```
Q3HCXYZEGRMIGELO
```

```
OFHJXNDU3VCAQSGTI5MKRBPLYWZE
ABCDEFGHIJKLMNOPQRSTUVWXYZ_-
QNOUI5RKYZSJEMFXVDBHC3ATPWGL
```

Fig. 13b

Fig 24a

| | | |
|---|---|---|
| $r_{i,j} \oplus v_{i,j}$ | $r_{i,j} \oplus v_{i,j}$ | $r_{i,j} \oplus v_{i,j}$ |
| $r_{i,j} \oplus v_{i,j}$ | $r_{i,j} \oplus v_{i,j}$ | $r_{i,j} \oplus v_{i,j}$ |
| $r_{i,j} \oplus v_{i,j}$ | $r_{i,j} \oplus v_{i,j}$ | $r_{i,j} \oplus v_{i,j}$ |

Fig 24b

| | | |
|---|---|---|
| $s_{i,j} \oplus v_{i,j}$ | $s_{i,j} \oplus v_{i,j}$ | $s_{i,j} \oplus v_{i,j}$ |
| $s_{i,j} \oplus v_{i,j}$ | $s_{i,j} \oplus v_{i,j}$ | $s_{i,j} \oplus v_{i,j}$ |
| $s_{i,j} \oplus v_{i,j}$ | $s_{i,j} \oplus v_{i,j}$ | $s_{i,j} \oplus v_{i,j}$ |

Fig 24c

| | | |
|---|---|---|
| $r_{i,j} \oplus s_{i,j}$ | $r_{i,j} \oplus s_{i,j}$ | $r_{i,j} \oplus s_{i,j}$ |
| $r_{i,j} \oplus s_{i,j}$ | $r_{i,j} \oplus s_{i,j}$ | $r_{i,j} \oplus s_{i,j}$ |
| $r_{i,j} \oplus s_{i,j}$ | $r_{i,j} \oplus s_{i,j}$ | $r_{i,j} \oplus s_{i,j}$ |

Fig 24d

| | | |
|---|---|---|
| $s_{i,j}$ | $s_{i,j}$ | $s_{i,j}$ |
| $s_{i,j}$ | $s_{i,j}$ | $s_{i,j}$ |
| $s_{i,j}$ | $s_{i,j}$ | $s_{i,j}$ |

Fig 24e

| | | |
|---|---|---|
| $s_{i,j}$ | $s_{i,j}$ | $s_{i,j}$ |
| $s_{i,j}$ | $s_{i,j}$ | $s_{i,j}$ |
| $s_{i,j}$ | $s_{i,j}$ | $s_{i,j}$ |

Fig 25a

| | | |
|---|---|---|
| 1 | 0 | 0 |
| 1 | 0 | 1 |
| 0 | 1 | 0 |

Fig 25b

| | | |
|---|---|---|
| $S_{i,j} \oplus V_{i,j}$ | $S_{i,j}$ | $S_{i,j}$ |
| $S_{i,j} \oplus V_{i,j}$ | $S_{i,j}$ | $S_{i,j} \oplus V_{i,j}$ |
| $S_{i,j}$ | $S_{i,j} \oplus V_{i,j}$ | $S_{i,j}$ |

Fig 25c

| | | |
|---|---|---|
| $S_{i,j}$ | $S_{i,j} \oplus V_{i,j}$ | $S_{i,j} \oplus V_{i,j}$ |
| $S_{i,j}$ | $S_{i,j} \oplus V_{i,j}$ | $S_{i,j}$ |
| $S_{i,j} \oplus V_{i,j}$ | $S_{i,j}$ | $S_{i,j} \oplus V_{i,j}$ |

Ballot number: 9365-4549 xyz General Election

Future President

James Madison

James Monroe

John Quincy Adams

Andrew Jackson

Past President

John Adams

Thomas Jefferson

George Washington

Fig. 36a

Ballot number: 9365-4549 xyz General Election

Future President

James Madison

James Monroe

John Quincy Adams

Andrew Jackson

Fig. 36b

Ballot number: 9365-4549 xyz General Election

Past President

John Adams

Thomas Jefferson

George Washington

Fig. 36c

SECRET-BALLOT SYSTEMS WITH VOTER-VERIFIABLE INTEGRITY

The present application claims priority from: U.S. Provisional Application, by the present applicant, titled "Having your receipt and secret ballot too," U.S. PTO 60/358,109, filed Feb. 20, 2002; U.S. Provisional Application, by the present applicant, titled "Layered receipts with reduced shared data," U.S. PTO 60/408,909, filed Sep. 7, 2002; and U.S. Provisional Application, by the present applicant, titled "Layered receipts with reduced shared data," U.S. PTO 60/412,749, filed Sep. 23, 2002.

BACKGROUND OF THE INVENTION

1. Field of the Invention

The present invention relates generally to the field of information security systems, and more specifically to receipts that are binding but not revealing.

2. Description of Prior Art

Election systems generally, as an application example without limitation, have long been recognized as being unable to satisfy two apparently contradictory needs: to convince the voter that the voter's chosen vote has been included in the tally and to prevent the voter from being able to convince others of what that chosen vote was. As an illustrative but hypothetical scenario, suppose each voter were to receive a standard receipt indicating what vote has been counted as a consequence of their voting act. On the one hand, accuracy and integrity of the tally could be verified by each voter in this scenario. But on the other hand, the "secret ballot" principle, which has been widely adopted in public elections at polling places, requires that voters be unable to provide anyone with convincing proof of how they voted, because of the potential for "improper influence" of voters.

Vote selling has historically been a major type of improper influence and continues today, particularly in certain areas. Coercion, such as by groups or family members, is another type of improper influence and also varies regionally. Although many remote voting systems, such as those used for absentee ballots, do not effectively address the problems of improper influence, they tend to be used most freely in places without a tradition of such abuse. (Abstention or participation in voting are generally not considered subject to improper influence, especially in those countries, such as the United States, where who votes is generally a matter of record and often used by parties.) While communication infrastructure such as the Internet can facilitate some improper influence schemes, facility to secretly cast a replacement vote, such as at a polling place, that takes precedence over a remote vote is known in the art to provide some protection against improperly influenced votes.

There are powerful authentication techniques known in the art that could be used to establish the first of the two apparently contradictory requirements with little room for doubt, such as document security, digital signatures and publishing on computer networks. These could provide the integrity of tallies without relying on trust in any "black box" or poll-worker conducted process. But these strong authentication techniques have been ruled out by limitations of the known ways to satisfy the second requirement.

Receipts are known in voting systems, though to the extent that they are acceptable in terms of ballot secrecy they are ineffective in terms of integrity. Some naive proposals simply print full receipts identifying both voter and candidates chosen, potentially satisfying the first requirement but almost completely sacrificing the second. Others have shown the offices voted, but not the particular candidates chosen. Even these may be too revealing, since voting for a particular office under some scenarios can be the subject of improper influence and this is of course in exchange for little if any real integrity. Even without voter ID, such receipts become a kind of bearer instrument for improper influence, for example establishing that a certain contest was not voted. Schemes that request voters to place the machine-generated receipt in a ballot box before leaving can be divided between those in which the content of the box are used for the actual tally and those that only use it for audit or recount. In the former, a voter that has taken the receipt out of the polling place could use it to show others that no vote was cast. In the latter, the receipt could be convincingly shown by the voter (even though its value would diminish in a recount). It has even been suggested that receipts be kept behind glass before they enter a ballot box.

Where proofs are provided over networks, more generally, there are some known approaches to "non-transitive" convincing. One known type of proof that cannot readily be shown to others is the "private proof systems" developed by the present applicant; however, these require that each voter have a private key and corresponding authentically known public key. Another type of non-transferable proof is one that is convincing to those who are able to choose a random challenge; however, challenges could be chosen other than at random, such as by a coercer or vote buyer. Yet another type of proof is where the proof is conducted in a booth; however, in practice the voter would not be able to bring tools from outside, since they could be provided by those seeking improper influence, and can have only limited trust in whatever tools are provided inside the booth. Universally trusted hardware devices in booths can in principle solve the problems, but themselves pose a very unattractive tradeoff between cost and ability to convince all parties.

Moreover, other shortcomings of various known voting systems are recognized. For example, there are several obvious scenarios allowing a voter to compromise a votes' secrecy or abdicate a vote altogether to persons in the polling place: the authorization the voter has to vote once inside the polling place can be given to and used by another person in the polling place, the voter's freedom in voting can be constrained by voting processes already partially completed by another voter, or evidence of how the voter voted can be revealed to another person within the polling place. A related example is the lack of adequate administrative processes to ensure the proper operation of polling places, including preventing improper allowance or spoiling (canceling) of ballots. Another example is that it may be cumbersome for many different ballot styles to be supported at a polling place, sometimes called "non-geographic" voting, such as for systems with pre-printed ballots, and also the tallies from that place may reveal the votes of voters who are alone in (or among a similarly voting group) using a particular ballot style there. Some systems cannot, after the close of polls, retally by adding or removing the votes of selected voters, such as under court order or for provisional or contested ballots. Some automated systems do not handle write-in ballots in an integrated, privacy protecting and secure manner. Yet other systems require online connection of polling places and/or tamper-proof voting machines.

The present invention aims, among other things, to allow forms of evidence to be removed from the polling place and be verifiable by powerful means and thereby substantially convince the voter of what vote is to be included in the tally, while ensuring that the evidence is in a form that makes it safe against use for improper influence. Objects of the invention also include addressing all the above mentioned concerns including generally providing practical, privacy-protecting, secure, fair, influence-free, robust, verifiable, efficient, low-cost, and flexible voting systems. As an example of flexibility, write-in, non-geographic, offline, and re-tally, are included among objects of the invention for those applications in which they could be beneficial. All manner of apparatus and methods to achieve any and all of the forgoing in voting and in other applications are also included among the objects of the present invention.

Other objects, features, and advantages of the present invention will be appreciated when the present description and appended claims are read in conjunction with the drawing figurers.

BRIEF DESCRIPTION OF THE DRAWING FIGURES

FIG. 1*a* through 1*g* each show example split ballots in accordance with the teachings of the present invention.

FIG. 6 discloses some exemplary symbologies, in accordance with the teachings of the present invention.

FIG. 7 discloses some exemplary symbologies, in accordance with the teachings of the present invention.

FIG. 8 shows an exemplary ballot in accordance with the teachings of the present invention.

FIG. 9 shows another exemplary ballot in accordance with the teachings of the present invention.

FIG. 10 is a combination block, functional and flow diagram schema for an exemplary voting system, in accordance with the teachings of the present invention.

FIG. 11 is a combination block, functional and flow diagram for an overall exemplary voting system, in accordance with the teachings of the present invention.

Figure 12:
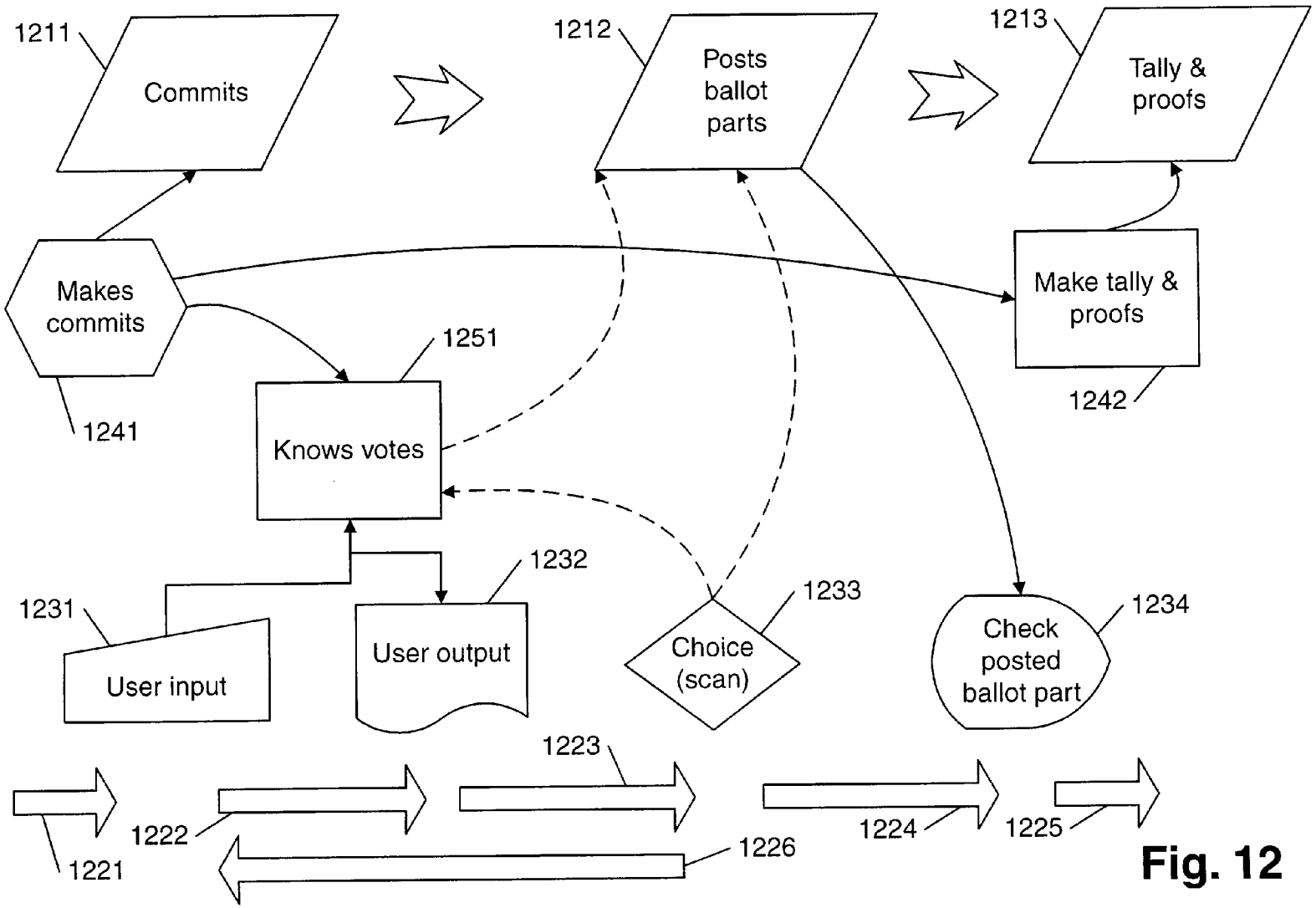

FIG. 12 is a combination block, functional and flow diagram for an overall exemplary voting system, in accordance with the teachings of the present invention.

FIG. 13 shows some exemplary write-in ballots in accordance with the teachings of the present invention.

FIG. 14 shows combination block, functional, schematic, and protocol diagrams for exemplary ways to control voter interaction for some embodiments in accordance with the teaching of the present invention.

FIG. 15 shows combination block, functional, schematic, and protocol diagrams for exemplary ways to control voter interaction in some exemplary embodiments of the invention.

FIG. 16 shows various views of an example single voting station, with automatic paper handling capabilities, in accordance with the teachings of the present invention.

Figure 17:
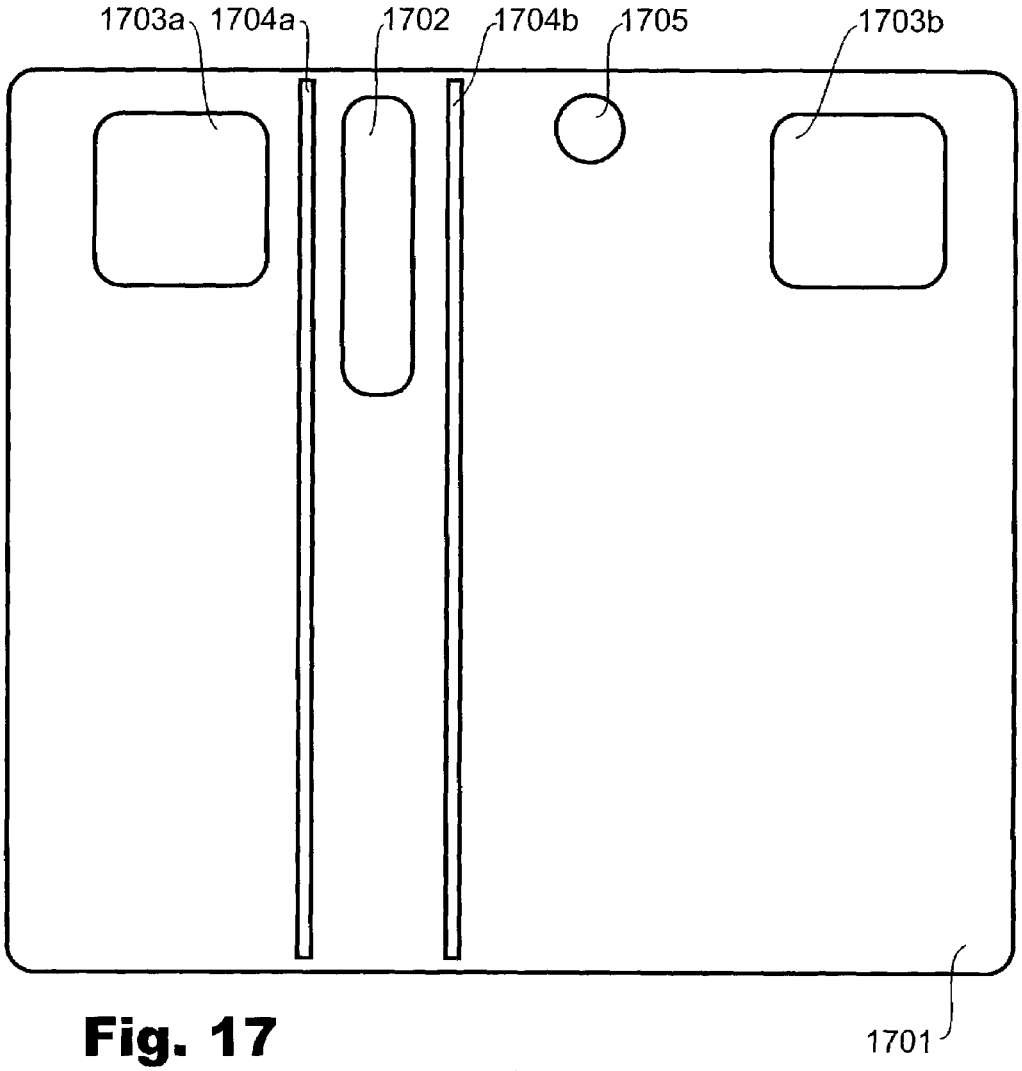

FIG. 17 shows a plan schematic functional view of an exemplary inventive ballot carrier cassette in accordance with the present invention.

Figure 18:
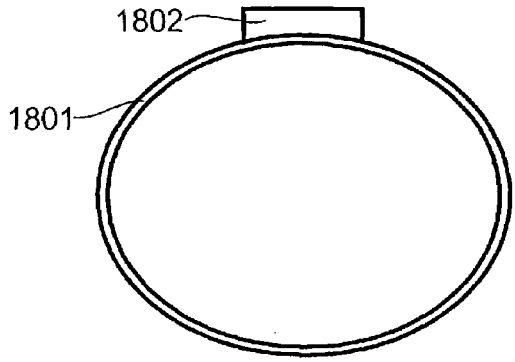

FIG. 18 shows an exemplary band in accordance with the invention.

FIG. 19 shows an exemplary scratch-off ticket in three states in accordance with the teachings of the invention.

Figure 20:
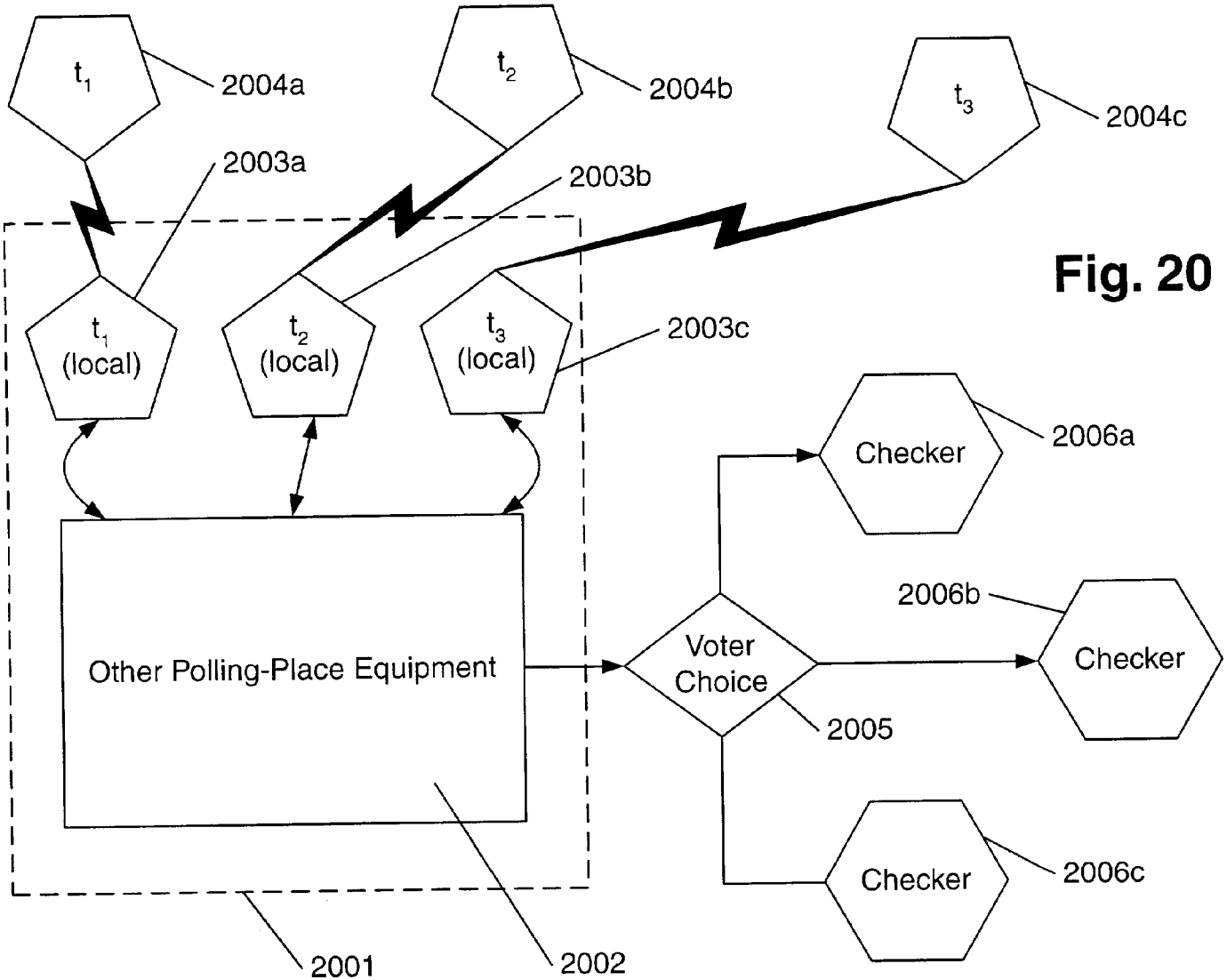

FIG. 20 shows a combined block, functional and flow diagram of an example voting location with trustee modules, online connections and plural checkers, in accordance with the teachings of the present invention.

Figure 21A:
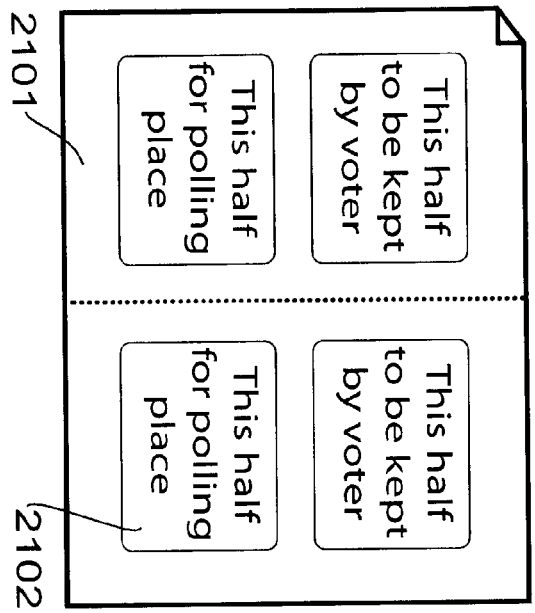
Figure 21B:
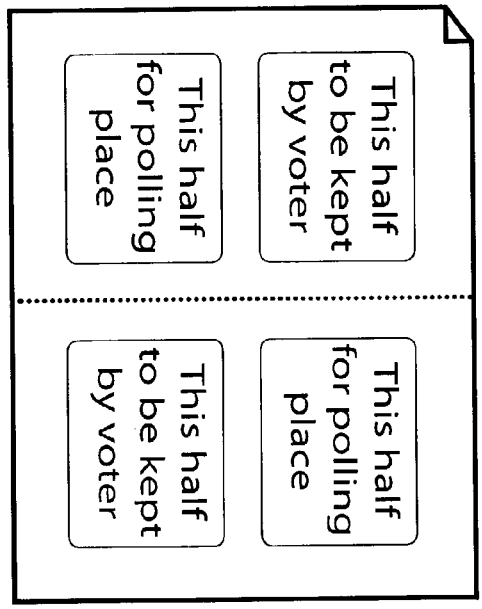
Figure 21C:
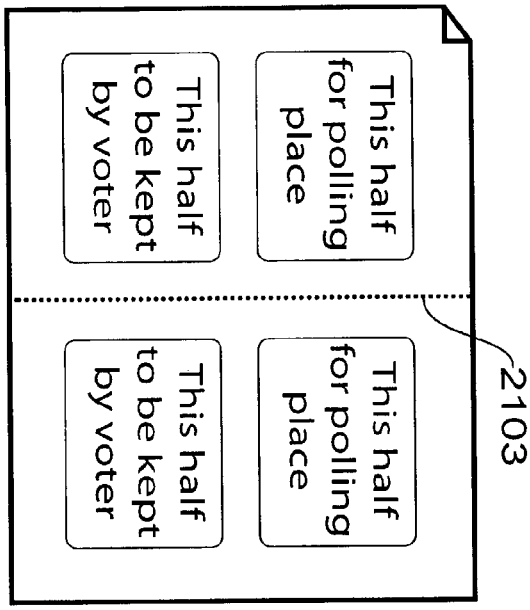
Figure 21D:
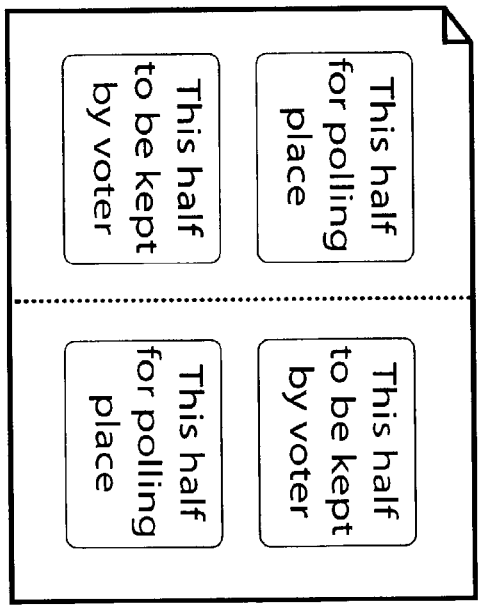

FIG. 21*a* through 21*c* each show exemplary scratch-off coin-flip ballot features in accordance with the teachings of the present invention.

Figure 22A:
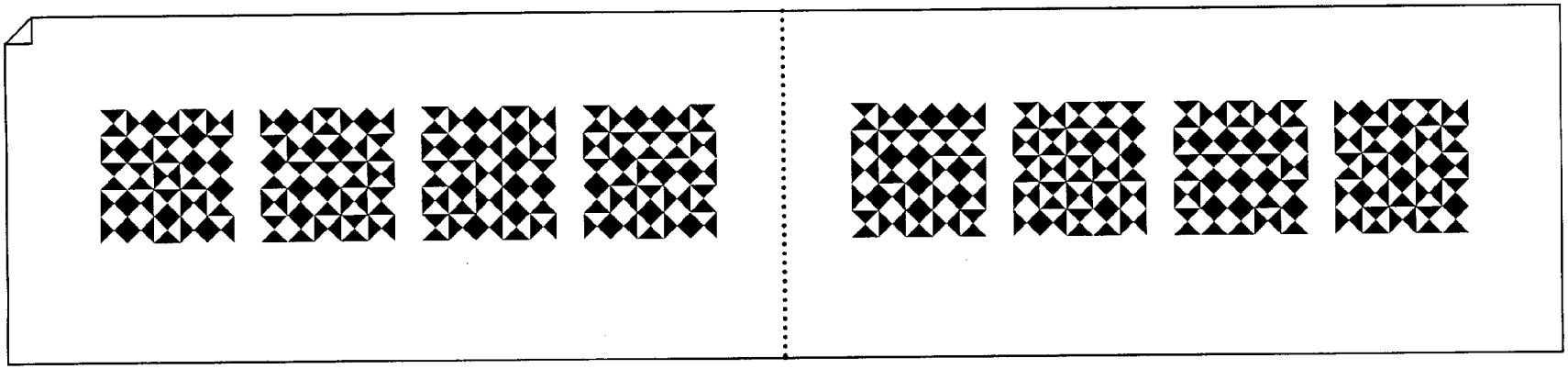
Figure 22B:
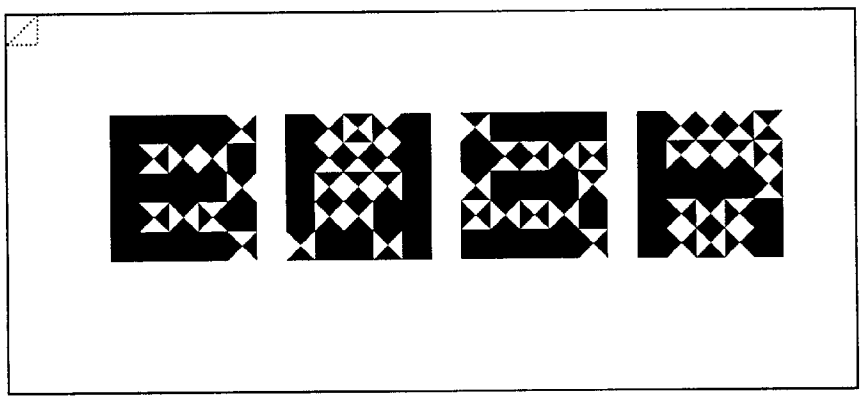

FIGS. 22*a* and 22*b* show exemplary monochrome overlay ballot features in accordance with the teachings of the present invention.

Figure 23A:
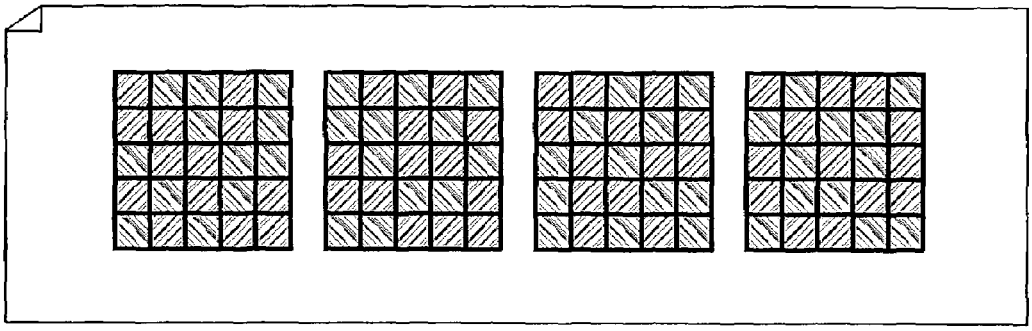
Figure 23B:
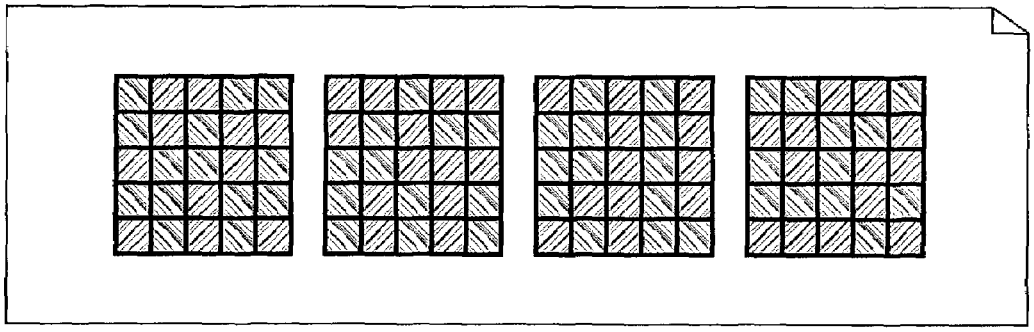
Figure 23C:
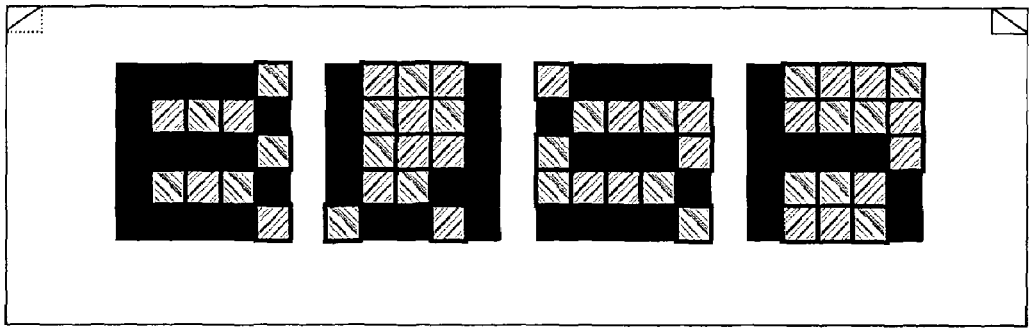

FIG. 23*a* through 23*c* each show exemplary color overlay ballot features in accordance with the teachings of the present invention.

FIG. 24*a* through 24*e* show example schemas and formulas for overlay systems in accordance with the teachings of the present invention.

FIG. 25*a* through 25*c* show example schemas and formulas for streamlined overlay systems in accordance with the teachings of the present invention.

Figure 26A:
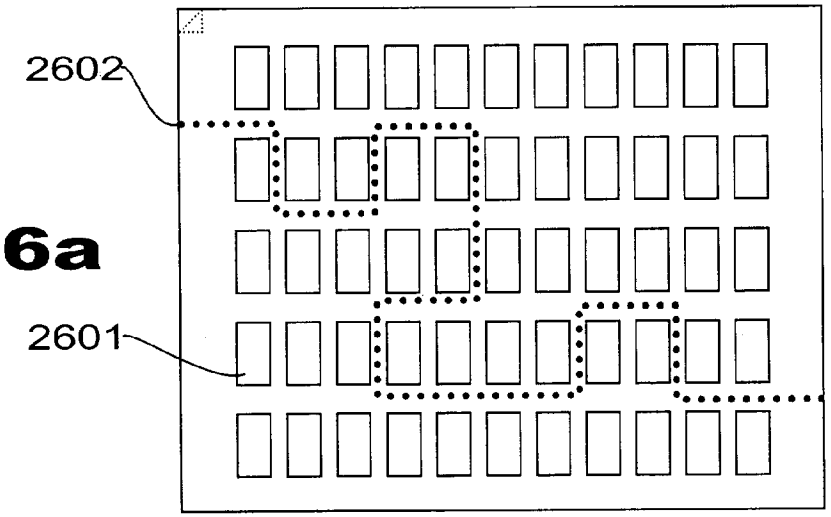
Figure 26B:
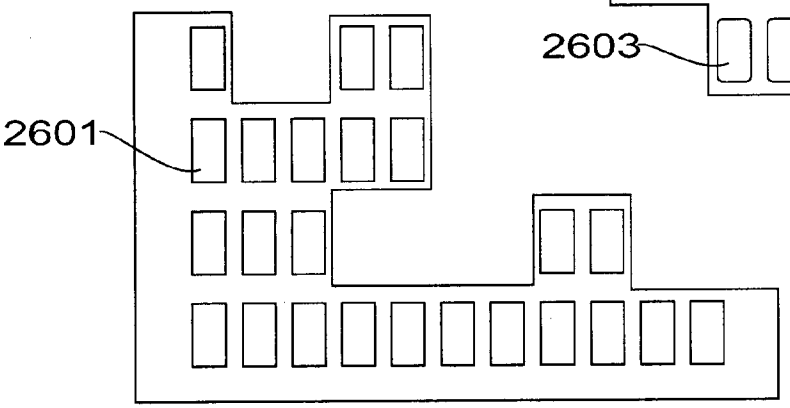
Figure 26C:
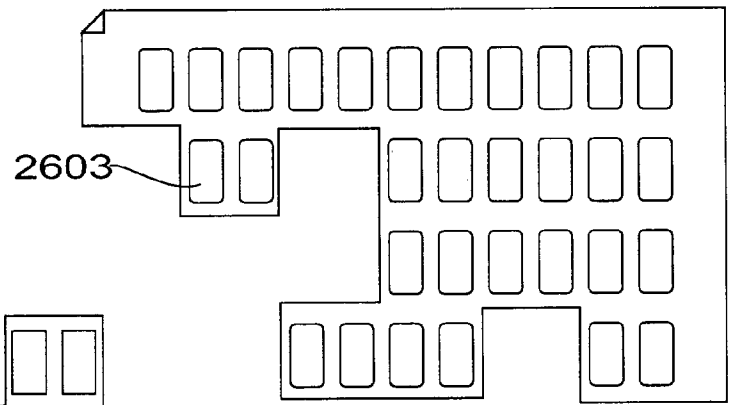

FIG. 26*a* through 26*c*, show an exemplary ballot form splitting comprising more than two potential parts in accordance with the teachings of the present invention.

Figure 27A:
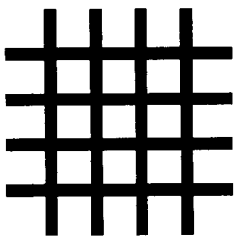

FIG. 27 shows exemplary ballot form material and printing technique in accordance with the teachings of the present invention.

FIG. 28 shows an exemplary single pixel spacing around a block of pixels in accordance with the teachings of the present invention.

FIG. 29 shows exemplary stacked window sizes in accordance with the teachings of the present invention.

FIG. 30 shows an exemplary embodiment of staggered pixel locations in accordance with the teachings of the present invention.

FIG. 31 shows exemplary pre-laminated media in accordance with the teachings of the invention.

FIG. 32 shows exemplary media that changes from one transmissive color to another in accordance with the teachings of the present invention.

FIG. 33 shows sections of exemplary printhead and roller arrangements in accordance with the teachings of the present invention.

Figure 34:
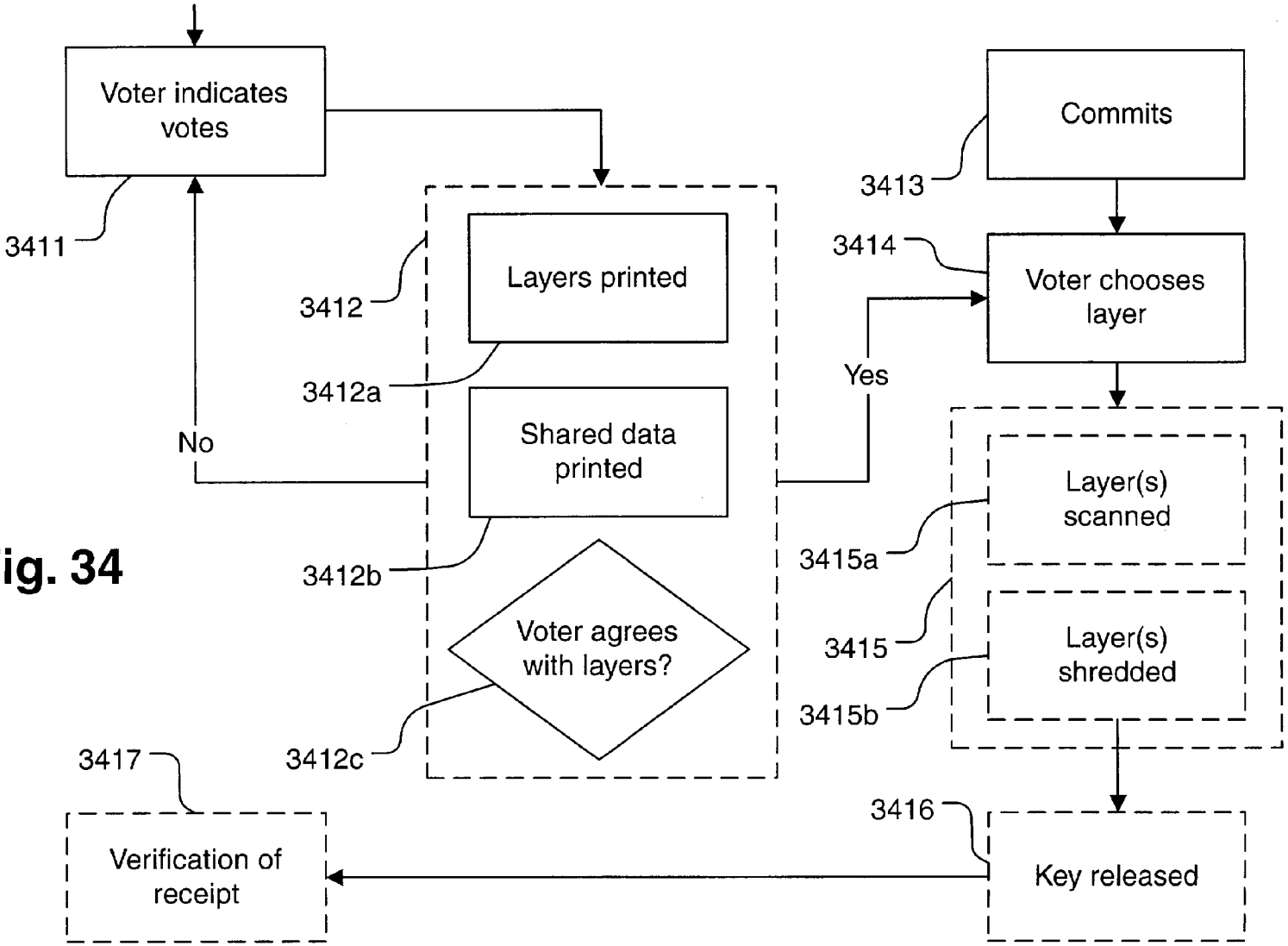

FIG. 34 depicts an exemplary overall detailed block, schematic, partial ordering, flowchart, plan view, and protocol schema in accordance with the teachings of the present invention.

Figure 35A:
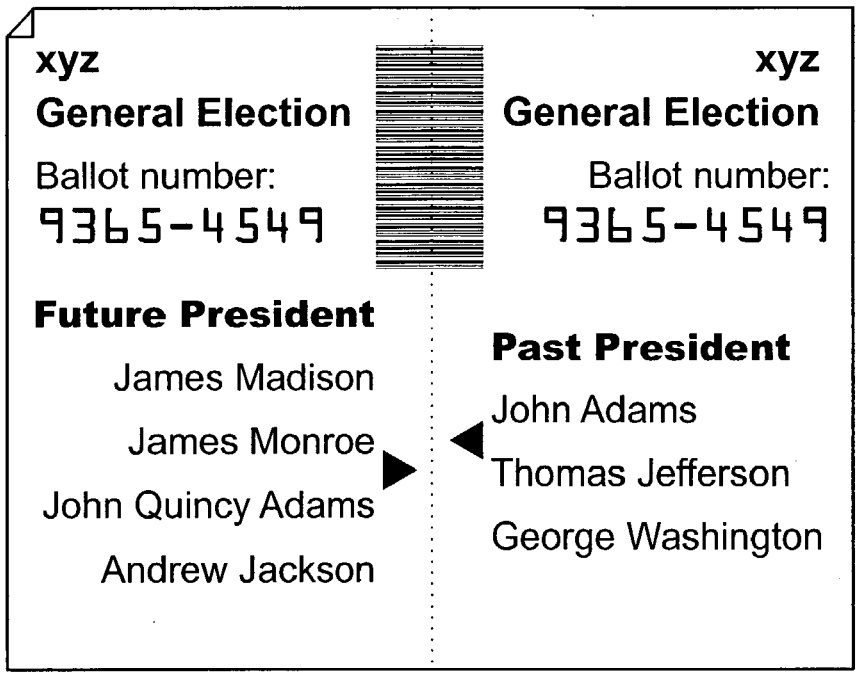

FIG. 35 shows a plan view and schematic diagram of an exemplary printed two-layer receipt, in accordance with the teachings of the present invention.

FIG. 36 is a variation on the embodiment of FIG. 35.

FIG. 37 presents a plan view and schematic diagram for an exemplary multi-layer receipt with a marked ballot, in accordance with the teachings of the present invention.

Figure 38C:
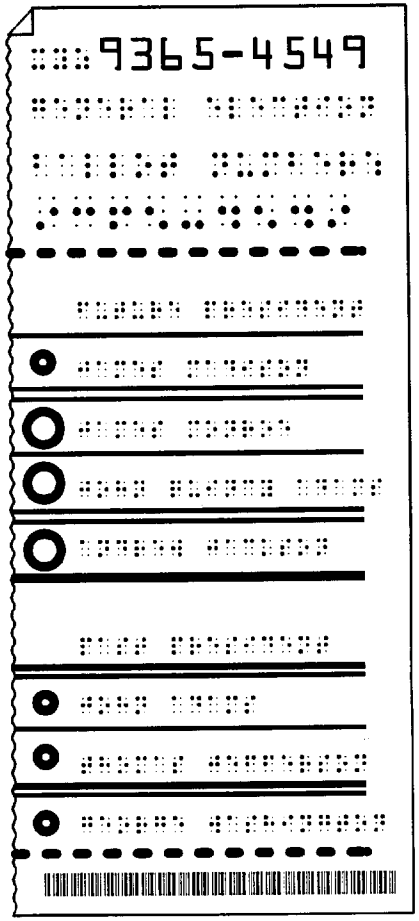
Figure 38B:
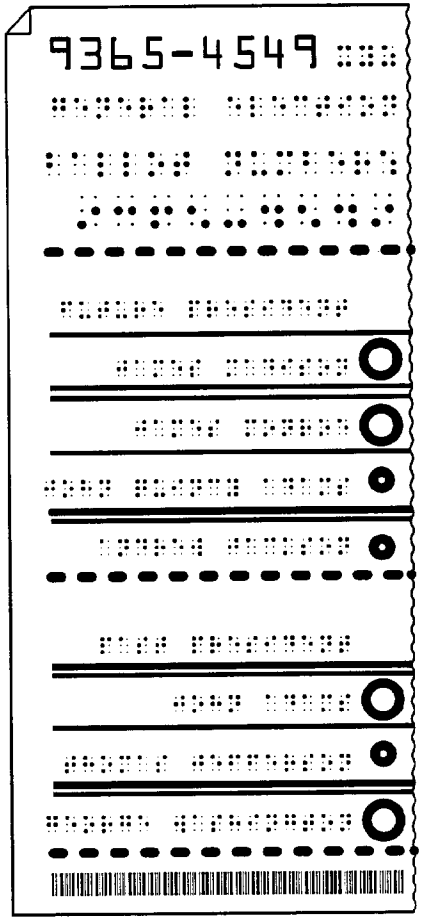
Figure 38A:
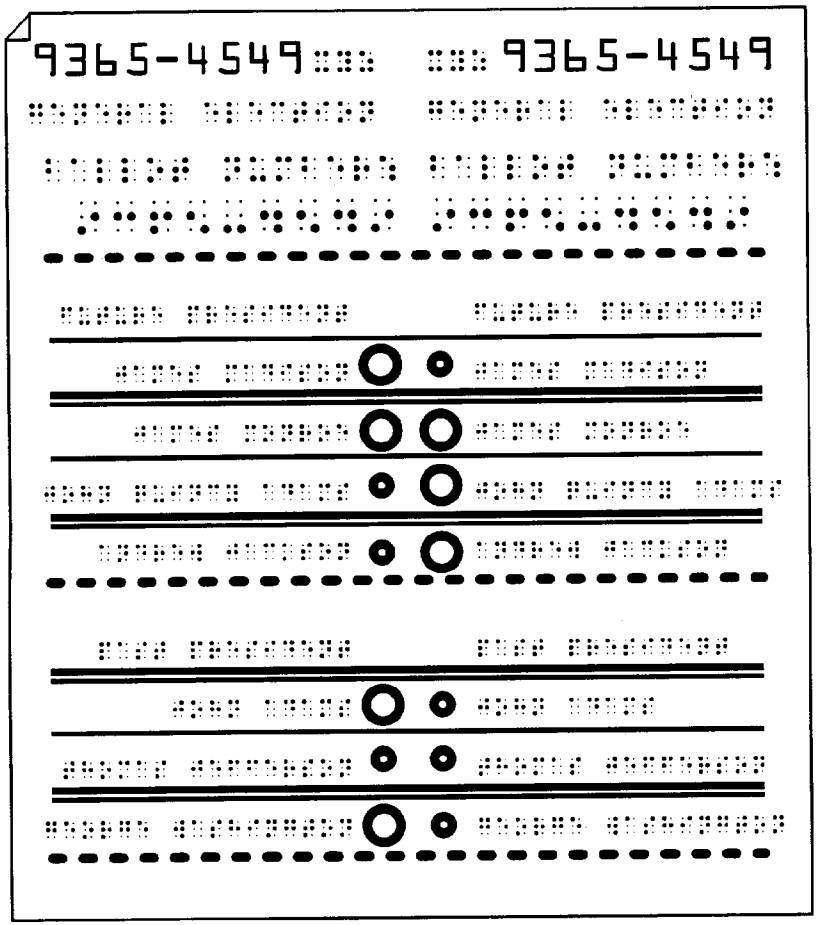

FIG. 38 gives a plan view and schematic diagram for an exemplary tactile receipt, in accordance with the teachings of the present invention.

FIG. 39*a* through 39*d* present a plan view and schematic diagram for an exemplary multi-layer receipt with a marked ballot, in accordance with the teachings of the present invention.

FIG. 40*a* through 40*d*, shows a plan view and schematic diagram for an exemplary two-layer receipt, in accordance with the teachings of the present invention.

BRIEF SUMMARY OF THE INVENTION

This section introduces simplifications to allow some of the inventive concepts to be more readily appreciated and makes omissions for clarity and should not be taken to limit the scope in any way; the next section presents a more general description.

An example application for attendance voting is as follows: The voter first makes a selection of candidates, for instance by substantially known techniques, such as marking a form and scanning it in or by using a man-machine interface such as a touchscreen. A "ballot form" is then generated and printed that unambiguously shows the voter' choices. The voter can review the printed form and, if it is acceptable, proceed to cast the ballot. (If not acceptable, it can be spoilt and all or part of the process repeated). A part of the ballot form is selected preferably at least randomly by the voter (and preferably in a way, such as by tossing a coin, that prevents the voter from being able to cause certain outcomes). The non-selected part is destroyed (or retained in whole or part by the polling place). Authentication of the selected part is provided, such as by special paper, printing, ink, attachments, digital signature and/or posting on a network by the voting authorities. The selected part of the form is then physically released to the voter, who can take it out of the polling place and allow anyone to verify it and its authentication.

The ballot form is preferably arranged so that, no matter which of the two the voter chooses, it does not reveal the vote. One example way to achieve the desired property with a two-part ballot is that a first part contains the index of the voted candidate in the second part and the second part contains the candidates listed in an apparently randomly rotated order. Thus, the first part alone reveals nothing about who was voted for, since the indices it contains are in effect "randomized" by the cyclic shift of candidate names on the second part. And, the second part alone reveals nothing about who was voted for, because the amount of shift should be random and independent of the choice.

The link between the ballots and the tabulation process is the coded vote, which is printed on the ballot form in such a way that it (or at least a part of it) is included on every half that is released to a voter. It remains to convince the voter that (at least with reasonable probability) this coded vote is formed correctly from the actual vote. There are three steps. First, before the voting, certain secret numbers are committed to by publishing them in encrypted form. Second, when the voter has a printed ballot form that is acceptable, a preferably random choice is made of which part is released to the voter and which is shredded, as already described. Third, depending on which part is released, different information about the commits is made public and/or otherwise authenticated and can be readily checked for consistency with the released part of the form. Since the randomly-selected part satisfies the consistency check, the voter knows that there is at least a fifty-fifty chance that the coded vote is correctly formed.

(As is well known in the field of cryptography, a value is committed to by in effect encrypting it and publishing/printing the encrypted form. To "open" the "commit," the key used to form the encryption is revealed and anyone can verify the value committed to. A type of commit preferred here can be opened to reveal a single value, because mathematically there is only one key that can open it and in only one way.)

An example will now be presented of what is committed to and what is revealed when the different ballot parts are released. A single contest and particular ballot number are considered for clarity. The rotation amount and the shift amount are each values that are committed to separately. The rotation amount is what is added to the actual vote to form the coded vote. The shift amount is the amount by which the candidate names are cyclically shifted when printed. If the ballot part comprised of the shifted candidate names is released, then the commitment to the shift amount is opened and it is checked that this value correctly determines the order in which the candidate names are printed. If the ballot part with the index of the candidate is released, then no commitment is opened, but the difference between the two is (commitment schemes allowing differences between commitments to be opened are well known). This difference is checked for equality with the difference between the index and the coded vote.

As will be appreciated, if both of these checks were to be made, then the coded vote would, it is believed, have been shown to be correct. (Checking both, however, would entail revealing the vote.) Even though only one check is made, it would detect an incorrect coded vote with probability at least 50%. And since the choices of which halves are revealed are preferably independent, it is believed that the probability that n coded votes in an election could be incorrect is less than $2^{1/n}$. For instance, this means that 10 undetected incorrect coded votes in total could be present only with probability less than a tenth of a percent and 20 with probability less than one in a million.

Other embodiments encode votes graphically, for example, treating each pixel of each letter of a candidate name separately. The pixels of one half ballot can be combined with those of the other half by superimposing the two halves and viewing the light transmitted through the sandwiched combination. A kind of "exclusive-or" combining can be achieved by known and substantially improved novel techniques. For example, effective media and printing techniques are disclosed as well as the use of metamer filters that eliminate background speckle and substantially increase image clarity. By committing to some of the pixels on one half and some on the other, in such a way that letters are determined by either half, and opening all the commits of bits of the half removed, no separate encrypted value is needed. Moreover, allowing each half to be divided into parts substantially in the same random way, and releasing different parts from different halves, the probability of a substantially improper ballot yielding a proper half is significantly reduced.

The keys used in the commits can be obtained from (or made known to) plural trustees, in such a way that they cannot count the coded votes until they all (or some agreed subset) cooperate in so doing and also that no subset (possibly below an agreed threshold) will be able to link votes tallied with the individual ballots. Information can be retained and/or destroyed by the parties to limit or allow reconstruction of data in various scenarios.

GENERAL DESCRIPTION

Various aspects of the inventive concepts will now be described in general terms to illustrate some of the scope of the invention but without any implied limitation whatsoever. First some of the main concepts are introduced more generally.

A voting system in some examples has multiple physical "layers" that the voter is able to choose between, so that the voter preferably takes a subset of the layers as a kind of receipt and the other layers are retained and/or destroyed by the system. The actual vote is not readily revealed by the "voter" layers, those taken by the voter; the other layers, the "system" layers when combined with the voter layers, however, reveal the vote. For clarity, although any number of layers greater than one, any number of contests, and whatever ballot logic, as will be appreciated, can be used, a single 1 out of m contest and two layers will be primarily described here for clarity.

In some examples, for concreteness, what is printed on one layer can be thought of as an element in a finite group; and on the other layer an element of the same group; the vote itself would then be the result of applying the group operation to the two elements. For example, in a single binary contest, one layer contains a 1 or 0, the other also a 1 or 0, and the vote is the exclusive-OR of the two. In another example, one layer contains a cyclic rotation of a list of m candidates (or m−1 candidates and a no-vote option position) and the other layer a pointer to one of the m positions; when these two elements are combined by the group operation the result is the index in the standard rotation of the candidate voted for. In still other examples, each group element corresponds to a part of the vote. For instance, an element can correspond to a single choice in an n out of m contest, where the element indicates whether or not that item is selected and/or the order in which it is selected. In still other examples, a symbol representing an element appears adjacent to the vote candidate name on each of two lists; the selected candidate(s) are the ones where the two elements labeling it are equal. In yet another example, the "visual X-OR" of bits on one layer with those on another layer.

Each layer has a corresponding "commitment" value, that is preferably fixed by being physically instantiated, such as by printing or publishing, before the choice is known of which layer will be taken as the voter layer. In some exemplary embodiments the commitment value of a layer corresponds with an "onion" that will be used when that layer is the voter layer. The onion allows, in some example embodiments, a series of mix nodes or another multiparty arrangement or a single party to determine the value of the group element it encodes.

In some exemplary embodiments, the onion of each layer encodes the group element of the indicia of the opposite layer. In counting the votes in some such embodiments, the group element of the indicia of the voter layer is combined using the group operation with the element in the voter-layer onion, such as by the first mix node. Thus, the output of the series of mix nodes should be the vote and is the result of applying the group operation on two elements: the one in the onion of the voter layer and that of the indicia on the voter layer. This vote should be equal to what was seen by the voter: the group operation on the indicia of the system layer (as contained in the voter-layer onion) and the indicia of the voter layer.

The indicia for the system layer would, in these examples, preferably not be available along with the voter layer when it is to be verified and the vote is to be concealed. Nevertheless, the commitment for the system layer (which, in some examples, at least would be physically with the voter layer) can also be checked along with the voter layer, such as by being opened or re-constructed, to ensure that it is properly formed and that it commits to the indicia printed on the voter layer. Thus, each commit is believed to have a chance of half of being checked (when its layer is the system layer) and the choice of which will be verified is preferably made after the commits are fixed.

In some other exemplary embodiments, two further "compensation" elements are shared between the layers, both being printed across both layers and/or by other means preferably so that they are substantially verifiable as the same on both layers. One compensation element applies to each onion, with the correspondence between onions and compensation elements for example being known and fixed. The role that the element encoded in the onion played alone in processing in the preceding examples is replaced by the group element resulting from applying the group operation to the onion and its compensation element. When the voter layer is processed using its onion, the result of combining the compensation element for that onion and the indicia element is used instead of the indicia element alone. Thus, the output of the mix series would then be the group operation applied to three elements: that of the voter-layer onion, its compensation element, and the indicia on the voter layer. Verification of the voter layer preferably includes verification that when the voter-layer indicia element results from combining by the group operation the contents of the system-layer onion and the system-layer onion compensation element. One believed advantage of such embodiments with compensation elements is that they allow the onions to be able to be formed and committed to independently of the voter's vote, such as before votes are cast.

In some embodiments there is "shared data" that is preferably included in the voter layer, no matter which layer the voter chooses to take. One way to achieve shared data, already mentioned, is by indicia that overlaps a shear line separating the two parts, such as for instance using barcode bars that extend across all potential positions of the shear line. Another way to achieve shared data is to print it on both layers in such a way that it would preferably be obvious to voters if the two were not substantially the same, such as by a pattern that produces a solid field when combined but whose separate layer parts are each individually verifiable as properly formed. Yet another way is by having the layers overlap in part. For example, two vertical perforation lines allow the voter to take either the left or the right two-thirds of the form. Another exemplary way is to provide the shared data as at least part of a form not included among the two layers but that is supplied substantially along with them, in some cases as a self-adhesive label. Still another novel approach is to provide the shared commit after the voter has reviewed the layers but before the choice of layers is made. One technique that can be applied generally is breaking the effective shared data into parts, a first part is provided before the voter choice and the second part is provided afterwards, but in such a way that the first part substantially determines the second, such as by a cryptographic hash or the like.

In some embodiments the effect of shared data can be achieved by allowing choice. For instance, if a voter can choose between plural instantiations of what should be substantially the same shared data, such as at substantially the same point that the choice of layers is made, then it is believed that some attacks based on providing different shared data depending on the choice of layers are substantially thwarted, since the choice of which shared data will be used is outside the control of the attacker.

Dividing the secured processing and storage between system components is preferably accomplished according to a variety of factors, including local preferences, although some exemplary arrangements can be anticipated. For instance, the secret seeds values used to generate all the commits can be generated by the voting machine itself. This can be done on the fly, and even with so-called "forward secrecy," by signing new signing keys using old ones and destroying old secret key matter. Where the onions are not to be provided to voters but rather published in advance, they can still be generated by the individual voting machine. In systems, as other examples, where a second "check out" device is to provide keys allowing the commitments to be checked, it may obtain these from the voting machine itself, it may compute everything itself and supply the voting machine what it requires, or the two machines may cooperate in forming and releasing the various values. Various types of security modules, smart card, key guns, secure channels, pass phrases, random number generators, hash functions, digital signatures and so forth may be combined in various ways to provide security of handling secret values, as is known in the art. More generally, a variety of parties/devices may be involved in producing and in some cases re-constructing the various values used at various points in the system and arrangements may be such that various subsets of parties will be required to cooperate in various aspects.

In one exemplary system, a printer prints a receipt in two columns, each listing the names of candidates (or other items to be voted on). Each list is in a cyclically shifted order. Additionally, pointer indicia in each column point to the voted items in the other column. A web or sheet-fed printer can be used. One example embodiment allows the voter or a poll-worker to separate the layers, such as according to a pre-perforated line, and then process them manually—preferably scanning the user layer and shredding the system layer—and providing the voter with additional information that in effect provides a digital signature on the user layer and/or allows opening the commits on the system layer. In another example, after voter verification of the combined layers, a device captures part of the form and then allows the voter to choose between the layers. In some examples of this embodiment, the choice of the voter is by operating a mechanical device that causes the columns to be physically split: the column not to be taken is diverted to a shredder; the column to be taken leaves the device, preferably in a way that the voter can readily see that it has not been substituted or modified, such as being continuously visible through at least a window. Final information, such as keys unlocking signatures on the chosen layer, for instance, can be printed for the voter to take, by the apparatus at least once the choice is made but preferably once the chosen column has been fully scanned and verified. In some embodiments shared data is on a part of the from that is included no matter which of the two layers the voter selects.

In another exemplary system, a so-called "mark sense" style ballot form can be used, on which a voter is to fill-in or connect shapes, such as circles, ovals, squares, broken arrows, and so forth, such as those that are known. What the voter applies, typically visible indicia by pencil, pen, dauber, or whatever, preferably in combination with pre-printed indicia giving it meaning, will here be called a "mark." This form can in some examples be pre-printed and waiting for the voter or "demand printed" just as it is needed to be made available to a voter. Having marked the choices on the form, the voter provides it for processing by a device that scans it and returns it, preferably visibly without being able to substituted or modify it. Then two layers are printed on substantially transparent material. (In other exemplary embodiments, holes are punched in material so that they overlap or not.) These layers preferably are arranged one over the other and the combination is arranged over the ballot. The printing on the layers is such that, in some examples, there are two possibilities for each layer over each mark: when the combinations are the same on both layers, the mark is not selected; when the combinations differ on the layers, the mark is selected. For instance, each possibility for a layer can be a half circle/oval or other shape, such that only when different halves are selected on the different layers is a complete circling or enclosing of the mark visible to the voter. After reviewing the layers, the voter surrenders the ballot, so that it can optionally be retained for recount or audit purposes and/or destroyed at some point. Also, the voter chooses one layer to keep and the other is preferably destroyed in a way readily witnessed by the voter. One example way to achieve this processing is a scanner that re-scans the ballot and the one layer for shredding, and/or scans the voter layer for correctness before it prints any final keys preferably on the voter layer or on a self-adhesive part. The candidate/question names, possibly in abridged form, are preferably printed on the overlays and/or divided among them, for instance, providing audit of the names on the ballot styles.

Some embodiments may be suitable for use by the blind, some of whom read Braille, and a majority of whom do not. An audio ballot can be provided, such as the familiar "IVR" telephone systems, where prompts would be provided in the familiar style such as "Touch 1 for George Washington, 2 for Abraham Lincoln . . . " and so forth. Preferably after each contest is voted, a strip of embossed paper emerges. Pairs of symbols are printed for each candidate and the pairs are separated by horizontal lines. Scanning down the list, the voter can find the pair in which the symbols are identical, as mentioned above, and that is the position voted for. The lines provide that the compensation bits are verifiable by the voter as shared data, such as by the use of two readily distinguishable types of lines.

In some systems where the votes are visible because of the relationship between the two layers, such as by the visual XOR, the final output includes only half of the pixels. The present techniques allow each pixel to be treated as a bit as already described and thereby provides the entire set of pixels as the output.

Ballot Format

A ballot form can be arranged in a variety of ways to allow what will be called "splitting" or "stretching" into parts in accordance with the inventive concepts disclosed. One approach is physical separation of a single piece of paper into two or more parts, either with overlapping areas that go with the selected part or without overlap. Another can allow more selective destruction of information, such as by erasing, blotting out and/or changing visible indicia. Whatever way and media to render indicia for the voter may be suitable, but it preferably does not readily allow undetected changing while or after the voter makes the choice of which part to keep.

Whatever graphic devices may be used to allow the un-split ballot to indicate the voter choice. Indicia, positions, patterns, or whatever can indicate the choice by relying on information on the two or more parts. One kind of example uses unique indicia for each index on one part and substantially the same indicia for the names on the other part. Another example kind indicates a position within a graphic on one side and the corresponding name appears in that position within a similar graphic on the other side.

Various supplemental information can be included. The political party or the like of candidates can, for example, be listed with them and even as an alternate choice without a candidate. Also offices or ballot questions can, for example, be appear along with explanatory text.

Overlay Ballots

Another example approach to ballot format is to consider each vote to be composed of a collection of smaller elements, such as for example the pixels comprising symbolic indicia representing the vote. For clarity, rectangular arrays of square, binary-valued pixels will be used in the examples. (Pixels can, however, be of any number of values and of any shape and/or arrangement, including a honeycomb packing of round pixels; moreover, various kinds of "segmented" display of text are also known and could be applied.) Techniques know as "visual cryptography" were proposed by Naor and Shamir in 1995 and received subsequent attention in the academic literature. They were concerned primarily with splitting information across two copies. The present invention can utilize some of the optical combining techniques proposed for visual cryptography but also discloses substantially improved techniques for this.

Recovery From Lost Data

If the electronic version of the vote cast were to be lost, in some examples, the votes cast could be reconstructed by anyone using both ballot halves. It may be desired in some applications to allow the vote to be re-constructed from either collection of ballot halves, being of mixed types; for instance, those ballot halves held by voters.

It may be desired in some applications that the choice of a voter is not revealed by either half alone, even to the trustees at least up to some point. This can be provided by, for example, local precinct equipment that creates the same random "change" in both halves in such a way that the choice is unchanged. For instance, increasing the values used on both sides of a contest by the same amount (e.g., increase the index on one side by a number and then further cycling shifting the candidates on the other side by that same number of positions). In the case when the trustees are to sign the ballot half, the precinct computer can prove to the trustees that the correct perturbation value previously committed to was applied. At a later point, in one example, everything can be opened to the trustees by the precinct equipment. Or, in another example, the precinct equipment can at a later point also prove to the trustees (or the public) the correctness of the coded tallies for the precinct per office. These partially aggregated values can, in some examples, then be further aggregated by the trustees.

Serial Numbers

The notion of a "ballot serial number" used in the included application, "Physical and Digital Secret Ballot Systems," can be applied to some examples in accordance with the present invention. In particular, the serial number of a ballot can be used by the trustees and other entities to manage the data and can be printed on both halves. More specifically, the serial number printed would preferably, in some exemplary embodiments, contain redundancy to make guessing by voters difficult, thereby preventing false printed ballot halves from being able to be prepared in advance. Furthermore, barcode printing of ballot numbers can allow for efficient and economical machine reading (also by machines not capable of reading more confidential information). Yet further, running each of the bars of a linear barcode from one ballot part to the other illustrates ways to allow voters to immediately see that both halves contain the same serial number. And still further, serial numbers in some examples are printed on the back of the forms, or on parts of the forms that are revealed through windows when properly folded and/or contained in a cassette, so that scanning can be conducted without having to reveal confidential data.

Multiparty Protocols

As would be appreciated, the protocols disclosed in the abovementioned application titled "Physical and Digital Secret Ballot Systems," can be adapted and applied in some example applications of some of the present inventive concepts. In particular, that application uses terms "shift amounts" and "public position" (for instance, in the description of FIG. 13, page 31, line 18, of the PCT publication). When these two values are added (or in some embodiments subtracted, but in the appropriate group such as modulo the number of effective candidates) the result determines the candidate. One example way to apply these techniques to the present invention is that the shift amount determines the shifting of the candidate ordering and the public position is the position within that ordering of the selected candidate. Both values would be used to compute the ballot form to be provided to the voter; however, the tally cannot be computed until the trustees agree to compute it, and when they do they would preserve the secrecy of the linking between ballots and candidates voted. The individual trustee "contributions" to the shift amount could be provided in encrypted form to the local device responsible for creating the image to be rendered (or, for efficiency in communication, seeds to generate ranges of them could be provided).

Ballot Styles

Plural so called "ballot styles" are used in many public elections. A definition for the present purposes is: ballots of different styles can differ in the choices that are available to the voter and/or in language/presentation; within a style these are both fixed.

Generally, there may be rules for which ballot styles or combinations voters are allowed to have and/or too choose between. Typically, in practice, a decision is made at the time of check in that determines the style, but a restriction on the options may suffice at this point and the final determination be made by the voter deeper in the voting process. (One example of this would be styles that are equivalent except for the language that they are rendered in and another example would be where the choice of style can be decided by the voter up to the last minute.) It will be preferred in practice that the voter not be able to vote styles outside the allowed range of choices. One advantage of the systems disclosed here over known techniques is believed to be that, while the style a voter can use may be fixed, it can appear in a coded form in the register and not be know to those doing check in. Also, the voter can choose between a range. And, the voter should preferably also be unable to have the wrong style accepted in checkout.

What is sometimes called "non-geographic," "statewide," or "county-wide" voting can call for many ballot styles to be available at each precinct location. Also, systems may be desired that are able to operate when precincts are offline during voting. Since the number of candidates per office can vary according to ballot style, if pre-defined shift amounts are used, compatibility of modulus may be an issue. One example way, as will be appreciated, to provide for this is that the greatest common multiple of the moduli anticipated would be used and then reduced to the appropriate range as needed. Another way would be to have lists of the various sized moduli and use the entries up sequentially. In the case that seeds or the like are provided for local use, values with the needed ranges can be generated directly.

Whether the set of contests voted is to be revealed (all or in part) by the form taken by the voter can, depend on the application. By including a "no-vote" virtual candidate and printing all contests, nothing is revealed. (As will be appreciated, such a "virtual candidate" need not be the same as an "abstain" type of virtual candidate provided for in some jurisdictions/contests.)

Process Control

Generally, a voter in attendance at a poling place enters a voting process by "checking in," where a decision is made to allow the voter to vote. The process ends for that voter at the instant when, usually after the voter's vote is "cast" or finalized, the voter "checks out" of the poling place. The number of "stations" or places that the voter visits in voting can be one, two, three or even more. In some systems, stations can also be re-visited in exceptional circumstances and/or the same station can serve multiple functions and routinely be visited more than once.

An example single station system is a so called "kiosk," where the voter provides information establishing the right to vote and then votes on the same machine, typically in a public place such as a shopping or transportation center. In a typical example two-station system, the voter checks in at a first station and is given some sort of permission or authorization to go to a second station, such as a so called DRE machine, to cast a vote. The typical three stage example comprises check in during which a blank form is provided, filling out of the form in a booth, and checkout by turning in the filled form, such as in traditional paper ballot or so-called "optical scan" systems. Schemes where voters must move forward through a series of stations are known in which poll workers simply have to ensure that nobody goes backwards.

In some cases a single station can be used for two or more functions, such as for check in and checkout. Sometime the basic functions of a station are spread across multiple poll workers at a single desk, such as check in comprising a first poll worker making a lookup on a roster and then a second poll worker providing a ballot. When a mistake is made by a voter and the voter wishes to spoil a ballot, for instance, the voter can return to a check in desk and exchange the spoilt ballot for a fresh one.

There are also, as mentioned already, various scenarios for cheating by voters allowing improper influence of votes during the voting process: the authorization the voter has to vote can be given to others, the voter's freedom in voting can be constrained, or evidence of how the voter voted can be provided to others. Examples of transferring the authorization to vote include the voter giving to another person a code, token, or form that allows that person to vote instead of a voter abandoning a voting machine in a state that allows it to be voted by, someone else. Examples of constraints are those in which a voter is supplied an already filled form or nearly voted machine and is to complete the casting of the vote, possibly while at least the time taken is under observation. Examples of providing evidence include showing a form while transporting it or exchanging filled forms at an intermediate point with someone else.

Single station systems are attractive when fully automated. Manually staffed check in suggests at least two stations. Three station systems, where the check in and checkout are manually staffed offer advantages, including the ability of poll workers to interact with voters outside the booths but still control the flow; however, they do admit more possibilities for the right to vote or votes themselves to be disassociated with voters or to be observed by others. Two or more stations can be configured to provide a kind of privacy resulting from an unlinking of the check in with the voting, though linking can still be provided in some examples by ballot styles and possibly to a very limited extent by timing.

Consider a two stage system. The voter takes with him from the first station to the second, for example, nothing special, some information carrier, or an active device. When nothing is taken, the ballot style requirements can be communicated by other means, such as a network connection between the two stations. When information is taken, such as by a code printed on a piece of paper that the voter enters on the second station or a passive ID tag, the information can determine the ballot style. In either of these two cases, if the voter is to be kept from voting a second machine, or for a second time, by the information, then it should presumably identify the voter instance and then could also be used for linking as mentioned. An active device, by contrast, can provide authorization for voting, and also for a particular range of styles, without providing further identification. An example novel technique for accomplishing this is where the active device engages in authenticated communication sessions first with the first station and then with the second station, accepting the vote authorization and ballot style information from one and providing it to the other. By suitable state transitions, such as between "authorized," entered when a transaction with the first station is consummated, and "not authorized," entered once a transaction with the second station is consummated, the authorization will not be transferred more than once. Furthermore, plural active devices can use the same keys, and thus under some assumptions be indistinguishable to the various stations, thus removing the source of linking.

Physical embodiments of active tokens can comprise many forms and include various communication means, such as those known as contact or contactless and provide for proximity detection. One preferred form is a large object. This allows easy observation of the movements of the object and its physical association with the voter. To enhance this effect, each object would preferably be substantially visibly different, such as being of a substantially unique color, texture, pattern, graphic, and/or shape. The object would preferably also serve as a ballot form carrier and filled ballots should preferably be contained within a carrier at least during transport by the voter between stations. Furthermore, in some embodiments the carrier can selectively expose parts of the form that are needed at checkout and also allow the separation of parts of the form without requiring removal of all parts from the carrier.

Another example preferred in some applications is a "wrist band," something resembling a wristwatch that contains an active device. Preferably, the band would be configured to detect the removal of the band and change the behavior of the device as a consequence. For instance, cutting or opening the band would break a signal path and the device would then cease functioning until reset by suitable authenticated communication. So called "quick release" style of wristwatch strap, in at least some variations of the known art, allows closing at plural size positions to fit a range of voters.

As in other embodiments, the objects could be "recycled," that is turned in at checkout and then brought back for issue at check in, either by poll workers or because the two stations are located in close proximity. In this way, presumably the number of tokens needed would not be substantially greater than the number of stations.

Two stage systems can be more susceptible to vandalism and voters leaving frustrated or otherwise without fully voting. Traditional paper ballot systems are three-stage. The known approach of a poll worker taking the voter to a booth has the disadvantage that the poll worker may conceivably linger or otherwise influence part of the voting process, although the voter may be able to change this part once the poll worker has left. Such escorted authorization can work for chains of stations is of length two; for longer chains, it becomes cumbersome and the issue of tracking the connection of visits is believed to require other techniques. Furthermore, it is believed that voter choice of which booth to enter is desirable in applications. Reasons may include increased sense of non-discrimination, safety and privacy. Also efficiency can be improved as there may the discrepancy between what is in fact open (or about to open up) and what the system considers to be open. Voters with various disabilities may wish to quietly choose the appropriate booth or weigh the options themselves. Moreover, less poll-worker time is needed.

Administrative control processes can improve security. One example is control over who is allowed to vote. For instance, in known systems, the number of names crossed off the roster may be less than the number of ballots in the box or counts on a DRE machine. Often there is no way to determine how this situation has occurred and, perhaps more importantly, no way to correct the situation without throwing out all the ballots, which generally is not done. Linking voters to ballot numbers in the present systems can solve this problem, because of the way the role of trustees in tabulation addresses privacy.

Familiar and easy to administer processes are also anticipated. For instance, a "ticket" can be issued to the voter at check in, used to enable the voting machine, and finally at least part of it becomes at least a part of the receipt. The ticket can be the paper stock on which ballots are printed, for instance. Spoilt ballots can require the corresponding ticket. A retained part or counterfoil of the ticket can, for example, then provide a traditional physical control for the checkout station.

Exit Devices

Checkout is a transaction that goes two ways: (1) the voter ideally gets a receipt or other proof that they did not run out with both halves and (2) the officials preferably get convincing evidence that the voter was crossed off the rolls and even that the voter really gave them the half and that they are not just voting permissions given voters that left without consummating a vote. Various ways to provide various aspects of it are also disclosed elsewhere here. An exit device or procedure can provide this transactional functionality.

An example embodiment "exit device" is one into which the voter inserts the two ballot parts, preferably still attached to one another. In some exemplary examples a random dice roll visible to the voter can be initiated; the result of which is used to determine which half to shred (and/or retain) and which half the voter gets back. (The result of the toss could also printed on at least the half that is returned, thereby providing other assurance that the signature is not one that could have been provided to others.) The signature is preferably obtained from the prover and printed on the form before it is returned. All or part of the exit device functions can be done manually as well.

Additionally, some exemplary embodiments implement the notion of a ticket (physical or "virtual" as in a wristwatch or other active token) which would preferably be read by the exit device as well. It is believed that many voters who would leave a ballot un-voted would not be inclined to actually give the ticket to a poll worker (especially if a virtual ticket had to be delivered in close temporal proximity to the casting of the ballot).

The associating of ballot numbers (or at least parts of them) with the voter entry on the roster, such as is believed to be done in some current practice, provides a way to identify ballots that are cast that are not associated with a voter and then to cancel them. The publication of lists of who voted helps deter abuse where voters would be falsely marked as having appeared.

Coin Flipping

Coin-flip values, used as the "random" value to determine which half is released to the voter, can be arrived at in various ways. In some examples a value is used that preferably cannot be readily manipulated by at least one party. In other examples, a trusted "oracle" can supply the bit. If the prover supplies it, it is believed that the recipient may be cheated. If the voter supplies it, it is believed that in some applications the recipient may be lazy and thus predictable and/or subject to collusion with the intermediary channel to give up the ability to see what the prover has sent. Accordingly, preferred, at least for some examples, is a system where a physical event is observable by the recipient and then authenticated to the prover.

Authentication Technologies

A range of techniques can be applied to "authenticate" the ballot information to the voter and others who may inspect it. One example is the ballot printing itself. Whatever document-security techniques can be employed, such as serial or other numbering, special papers inks and printing methods, and various inclusions/coatings such as holograms, ribbons and fibers. Scratch-off validation, described elsewhere can, as another example, be employed. Various digital signatures and other authenticators can be applied to the data on the document, as is known in the cryptographic art. The data can, in other examples, be posted electronically and various time-stamping and other known techniques applied to the posting. Further objects can be associated with the ballot, such as other pieces of paper, stickers, holograms, chips, and so forth. The binding of multiple objects can for example be by serial number, physically attaching them, and/or by their information content.

Scratch-Off

So called "scratch-off" printing technology can be employed advantageously in a variety of ways. One example use of scratch-off is for committed values. The pre-image of a one-way function commit can be printed under latex; when it has not been scratched away, the secret is substantially hidden. One example use of this approach is with a ticket or ballot form. Once voted, the half to be retained is checked (manually and/or automatically) to verify that it has not been read and the other half is released to the voter. One advantage of this approach is believed to be that the retained parts can be audited/verified later to ensure that the hidden data was not released, since it could be used to invade privacy or in coercion schemes. Another advantage of the approach, for some applications, is that local computer security need not be relied upon to protect these secrets, even in offline operation. Flexibility in what secret is revealed can, for example, be obtained by a second number released, such as being printed next to the scratch-off, that is combined (such as, for example, by X-OR) with the hidden number to reveal what is in effect the secret value.

Another example use of scratch-off is to provide some kind of authentication to the voter or other checking parties. Indicia are printed at the polling place, such as after voting, that can be checked for agreement afterwards with what is below the latex. Some example related techniques have been previously disclosed in the previously mentioned "Physical and digital secret ballot systems."

Still a further example use of scratch-off is to provide some protection against improper spoiling of ballots. In one example approach, not requiring latex, information from both ballot parts is required to send in the spoil request. In another, information required for the spoil request is at least under latex. If the information required for spoil requests in divided among the two parts, then shredding one part provides assurance to the voter that the precinct should be unable to spoil the ballot once it is committed to. Another way to lock against improper spoiling is that information needed for this is printed on top of latex and the latex is scratched off by the voter once it is determined that the ballot is not to be spoilt.

Destruction

In general, shredding or retaining a piece of paper are not the only options. In other embodiments, "erasing" of printed data can be accomplished by abrading, overprinting, non-mechanical destruction of ink, and/or non-macro destruction of structure. For instance, printing over the information to be destroyed can be accomplished, particularly by using optical reading, such as is known in the printer art, to ensure alignment. As another example, ink remover and/or combinations of various hiding overprint patterns can be used. Also, substrate etching or destroying solvents or activators could be applied and/or heating and/or pressure. Imaged data can be "retained" electronically, photographically, and so forth.

Proof Systems

Various aspects of voting proof systems include what is committed to in advance of the election or vote as well as what is released to the voter and/or published. Commitments in advance of the election are believed to offer advantages, such as for instance, that potential controversy has time to be resolved, it relatively easy for the voter to know that they are made before the choice, and also commits can be stored offline for use by offline checkers. Whatever can be released to the voter, it is believed, in an example can also be published and vice versa, since it will all potentially become public. Checking of the consistency of such published data can, it is believed, be done most efficiently on a wholesale basis and by anyone for all voters. The posting or at least inclusion in the tally of the coded vote may not be effectively verified, it is believed, by the voter at the time of coin-flip; but, such verification can at least to some extent be made wholesale or audited based on polling-place records and/or by data obtained by checkers positioned outside polling places. The numbers held by individuals provides it is believed definite verification, but may not be checked by a large proportion of voters due to such things as laziness and complacency. Nevertheless, the less that is known about which voter is likely to check, the harder it would be to cheat voters without a substantial chance of being detected.

An example technique, suitable for a wide range of applications, in simplified introductory form, is as follows: An "assertion" or statement is divided or "stretched" into two parts. Taken separately, each is ambiguous without the other as far as what assertion or statement is made by the combination; taken together, the parts constitute a complete, unambiguous, statement or assertion. (As an example, consider a half statement like "if this number, 343423, is added to the number in the other half statement the result is my public key".) Both half statements are provided, such as by the prover to the recipient and/or vice-versa and/or by other parties. This "providing" can be without authentication and even with plausible deniability or by whatever means so that it cannot substantially be verified or authenticated by third parties. Then a "coin flip" is conducted at least in a way that the prover cannot substantially manipulate the outcome toward a chosen value. If the toss outcome is heads, then the first part would be "acknowledged" by the prover and if tails, the second part would be "acknowledged". The "acknowledged" part is authenticated by the prover and provided to the recipient and/or published, and could preferably be verified by the recipient and/or others. As will be appreciated, and unlike some systems, the acknowledged part does not authenticate or even reveal the assertion itself In addition to the acknowledged part itself, proofs of various properties of it and its relation to committed values can be provided, and they need not reveal the assertion either.

In one example, the above defined terminology can be mapped to an example of the inventive election techniques as follows: The term "receipt composite" designates the information provided to a voter; the term "receipt portion kept" designates the portion of the receipt composite retained by the voter and/or acknowledged by the prover; and an example assertion is whether or not the "voting decision between at least one of plural votes" is the vote encoded in the receipt portion kept. In a physical instantiation for elections, the receipt composite is the form(s) provided to the voter for checking in the booth and the receipt portion kept is the part of the forms that the voter is allowed to retain. As will be appreciated by those of skill in the art, substantially all the disclosures made elsewhere here in the context of physical forms can be interpreted as having an analog that is an informational protocol, and such protocol versions should be considered disclosed as well, even though a physical embodiment is presented for clarity.

A number of example generalizations will now be presented: The number of parts that the assertion/statement is stretched into can also be more than two. The assertion can be decomposable into plural sub-assertions, each an independent coded version of what should be the same information, such as a vote. The random value can determine which of the sub-assertions is of interest, such as which encoded vote is processed along with possibly other parts of the assertion in forming the tally of the election. The random value can be chosen by the verifier and/or by verifiers; the prover can also participate, but not exclusively (otherwise the proofs it is believed would be unconvincing). Commits by the prover can be in advance of the whole process when the prover is free to choose the stretch; commits by the prover unable to manipulate the stretch would be after the stretch or the prover could contribute non-committed values to the stretch. Intermediaries can provide the stretch to the verifier. Intermediaries can alter the stretch and also the random choice on its way through the parties. The stretched value need not be fully authenticated, so long as the parts proved are; the whole combination can be convincing to the verifier even if some fraction of the stretched values (such as substantially less than 50% in the two part case) are not properly returned in an authenticated form. There are many variations of commitments, coding schemes, and checking possibilities, such as that the same coded vote can be verified by multiple independent ballot forms to increase the confidence in its correctness or that a single commit can contain the values used to shift or code a set of contests on a ballot.

As an example, consider a system presented in two "phases," a "voting" phase followed by a "tally" phase. First consider the voting phase, which is comprised of a number instances. Each instance is in up to 6 successive steps: (1) the prospective "voter" supplies a "ballot image" B; (2) the system responds by providing two initial 4-tuples: $<{}^{z}L,q,{}^{t}D,{}^{b}D>$, each printed on a separate "layer," the "top" layer with z=t and the "bottom" with z=b; (3) the voter verifies, using the optical properties of the printing, that ${}^{t}R \oplus {}^{b}W = {}^{t}B$ and ${}^{b}R \oplus {}^{t}W = {}^{b}B$ as well as that the last three components of the 4-tuple are identical on both layers; (4) the voter either aborts (and is assumed to do so if the optical verification fails) or "selects" the top layer x=t or the bottom layer x=b; (5) the system makes two digital signatures and provides them in a 2-tuple $<{}^{x}s(q), {}^{x}o({}^{x}L,q, {}^{t}D, {}^{b}D, {}^{x}s(q)>$; and (6) the voter or a designate "checks" that (a) the digital signatures of the 2-tuple verify, using the proper public keys of the system, with the unsigned version of the corresponding values of the selected 4-tuple as printed on the selected layer and (b) that ${}^{x}D$, and the half of the elements of ${}^{x}L$ that should be, are correctly determined by ${}^{x}s(q)$.

More particularly, the relations between the elements of the 4-tuples and the 2-tuple are defined as follows. The m by n binary matrices ${}^{z}L$ are determined by the "red" bits ${}^{z}R$ and "white" bits ${}^{z}W$ (both m by n/2, n even), in a way that depends on whether $$z = t \text{ or}$$

$$z = b: {}^{t}L_{i,2j-(i \bmod 2)}$$

$$= {}^{t}R_{ij}, {}^{t}L_{i,2j-(i+1 \bmod 2)}$$

$$= {}^{t}W_{i,j},$$

$$L^{b}_{i,2j-(i+1 \bmod 2)} = {}^{b}R_{ij},$$

$${}^{b}L_{i,2j-(i \bmod 2)} = {}^{b}W_{ij}$$

where $1 \leqq i \leqq m$ and $1 \leqq j \leqq n/2$. The red bits are determined by the ballot image and the white bits of the opposite layer: ${}^{x}R \oplus {}^{y}W = {}^{x}B$. The white bits are themselves determined (as is checked in the sixth step above) by the cryptographic pseudo-random sequence function h (which outputs binary sequences of length mn/2) as follows: ${}^{z}W_{i,j} = ({}^{z}d_k \oplus {}^{z}d_{k-1} \oplus \ldots \oplus {}^{z}d_1)_{(mj-m)+i}$, where ${}^{y}d_i = h({}^{y}s(q),i)$. The "dolls" are also formed (and checked in step 6) from the ${}^{z}d_l$ using the public key encryption functions $e_l$ whose inverse is known to one of the trustees (as will be described): ${}^{z}D_j = e_l({}^{z}d_1 \ldots e_2({}^{z}d_2(e_1({}^{z}d_1))$, where $1 \leqq l \leqq k$ and for convenience ${}^{z}D = {}^{z}D_k$.

Now consider the tally phase, which takes its input batch from the outputs of an agreed subset of voting instances that reached step 6. For each such instance, only half of ${}^{x}L$ and all of ${}^{y}D$ are included in the tally input batch, comprised of "pairs" ${}^{x}B_k = {}^{x}R$, ${}^{y}D = {}^{y}D_k$, that can be written here as $B_k$, $D_k$. Each such pair transformed, through a series of k mix operations (as described in "Untraceable Electronic Mail, Return Addresses, and Digital Pseudonyms," D. Chaum, *Communications of the ACM*, vol. 24 no. 2, February, 1981) into a corresponding ballot image ${}^{z}B$. The l'th mix transforms each pair $B_l$, $D_l$ in its input batch into a corresponding $B_{l-1}$, $D_{l-1}$ pair in its lexicographically-ordered output batch, by first decrypting $D_l$ using its secret decryption key corresponding to $e_l$, extracting $d_l$, from the resulting plaintext, and then applying $B_{l-1} = d_l \oplus B_l$. The k'th mix performs the same operation on each pair, but since ${}^{z}B_0 = {}^{z}B$ and $D_0$ is empty, the result may be written as B.

The k mixes are partitioned into contiguous sequences of four among a set of k/4 trustees, where k is divisible by 4. The input batch size is, for simplicity, also assumed divisible by 4. After all the mixing is done, half the tuples in each batch are selected for "opening". A random public draw, such as is used for lotto, allows these choices to be assumed independent and uniformly distributed. The tuples selected for opening depend on the order within each trustee's four mixes: in the first mix, half of all tuples are chosen; in the second, all those not pointed to by those opened in the first mix are opened; in the third, opened are half those pointed to by those opened in the second mix and half that are not; and for the fourth mix, as with the second, those tuples not pointed to by the previous mix are opened.

Printing Technologies

System in which the relationship of images on layers of documents allow voters to check their votes are an example application of novel printing techniques that can also be applicable to other applications. Light used in viewing these documents differs at each of plural pixel locations, depending on the relationship of the images positioned at the same pixel location opposite each other on the two surfaces. It is believed generally that preferred, though not necessarily all acceptable, results are obtained with at least a substantially transparent upper layer (the layer closer to the viewer). If a diffusing lower layer is used, then the image should preferably be on its upper surface (the surface closer to the viewer).

Various pigments, dies or whatever techniques are employed to alter the optical properties of the layers, referred to here as "printing," are typically applied to the surfaces of the layers. One layer can be pre-printed and a second demand printed; both layers can be demand printed; one layer can be both pre-printed and demand printed; or both layers can be pre-printed and demand printed. A pre-printing can, in another example, be a layer that is separate from the other two. (A layer that is both pre-printed and demand printed would typically, it is believed, be pre-printed with registration and/or framing, to be described later.)

The distance between the printed surfaces can cause undesirable effects related to viewing angle. Framing by an optical blocking, in one example resembling graph paper, can be printed on one or both layers. The angle of view that is prevented from mixing one region on one layer with a region adjacent to the opposite region can be increased by widening the framing. Framing on both layers is believed to double the effectiveness of framing only a single layer with the same frame width. Registration error between framing layers or between framing and regions is believed to diminish the worst-case effectiveness of the framing.

More specifically, some of these exemplary aspects of duplex optical ballot systems include what will be called: "angle of view", "angle of degraded view", and "error angle". Much as with today's LCD display panels or the like, the range of angles over which the user can see a good image is of interest; however, since ballots contain private information, the widest possible angle may not be desired. The angles over which users can see the correct image without substantial degradation will here be called the angle of view. The remaining angles over which the image can be seen, though in substantially degraded form, will be called angle of degraded view. (Differences in side-to-side, up-down, and other three-dimensional differences will be ignored here for clarity.) There are also angles in some embodiments through which substantial light can pass through non-opposite pixels; such angles are here called error angles. These various angles apply primarily when there is a substantial distance between the two faces and their effect is related to the relative size of pixels and gap.

One example technique for such printing disclosed is the lamination of the two halves and printing both front and back at substantially the same time. This approach greatly reduces the difficulty of registering the two halves for viewing, allowing smaller pixel sizes and more satisfactory operation. Lamination in some embodiments is accomplished in advance, using easily separable adhesive/cohesive, though all or part of it can also be accomplished as a part of the demand duplex printing operation in other embodiments. Some embodiments arrange the printing operations for both sides close together to provide a kind of automatic registration. Other example embodiments use sensors and control systems to obtain alignment, either against pre-printed marks or mutual alignment of the demand printing on opposite sides (such as disclosed for web printing in U.S. Pat. No. 6,285,850 Van Weverberg, et al, Sep. 4, 2001).

One example technique disclosed comprises opposite pixels having different sizes and/or relatively opaque borders around at least one of two opposite pixels. As will be appreciated, if there are no borders and opposite pixels are the same size, then the viewing angle is very limited, degraded viewing starts almost immediately, and the error angle is coextensive with the degraded viewing angle. By, for instance, placing a black border of the same thickness around both pixels the error angle is improved with border width. If one of two opposite pixels is smaller than the other and surrounded with a black border, then it is believed that the viewing angle can be improved by increasing the border thickness. Such configurations are also believed to substantially begin degraded viewing at the error angle. Introducing a second narrower border is believed to increase the error angle beyond the degraded viewing angle.

Different lighting options are anticipated. When viewed with transmissive light, the light penetrates the lower layer and then the upper layer before reaching the eye. When viewed with reflected light, the reflector can be the substrate of the lower layer itself, such as paper, or the reflector can be below the lower layer. Reflected light viewing has the advantage of being the familiar way that documents are read and, in many settings, suitable lighting already exists. It also has the property that typically the unimpeded light passes through whatever printing twice: once on the way in from the top and once on the way back from the bottom. This it is believed allows printed indicia to have a lower transmissive optical density, closer to what is used for normal printing, than would be required to obtain the same effect with the transmissive lighting option.

If two transparent layers are used and a separate reflective layer imposed unevenly below them, shadows may be cast on the reflective layer that confuse the viewing of the images. When viewed backlit, laminated films it is believed can overcome the shadow effect.

Holding the two layers in a uniform relation is preferable for viewing. One example approach to achieve this, already mentioned, is that the layers be adhered together by a suitable bonding technique, referred to here as an "adhesive," such as so-called fugitive or dry-peal and/or static electric or cling. If the adhesive is applied before the images are placed, then the registration of the images is believed to also remain substantially as applied. Another example approach is that the layers be pressed together by additional means, such as a substantially clear glass or plastic sheet. One way to accomplish the pressing is simply by the weight of the overlaying sheet. When the layers are pressed together, registration is preferably provided for at least the mutual relationship of the two layers. One example way to obtain registration is by use of positioning elements, such as alignment pins, registration pins, or sprockets. Another way to obtain registration is by having the two layers attached in at least two points. An example of such attachment is when the layer media is folded to form the two layers. The fold line preferably has a registration relation to the printing, such as by printing after it is folded, registering the printing to a pre-determined fold line or devices related to the same, or registering the fold line to the printing.

Another way to reduce the problem of undesirable degradation of images when viewing from oblique angles is by constraining the angle of view through additional means. Some example techniques use so-called "light control film," which is in effect a micro-louver system in a relatively thin plastic sheet. Orienting two layers of light control film perpendicular to each other, but in parallel planes one on top of the other, creates a combined layer that light does not readily travel through at angles that are too oblique. Such biaxial light-control film can, in one example, be placed between the layers to be viewed and the backlighting source or reflective media. When the laminated layers of media are placed on, for example, a light table or light box that includes such a layer, the oblique angles of view have reduced light levels.

Demand printing in registration on two sides of a pre-laminated media can be accomplished with a double print station, one for each side. It can also be accomplished by a single print station which is brought into a positional relationship successively with one and then the other side of the media. One arrangement for this would be that a single so-called "swath" or row of printing by a moveable printhead is placed on one surface and then the printhead is moved to position over the other surface and a swath is applied there. Multiple swaths are applied, with those on each layer being one directional or two directional, as is known in the art.

Another type of arrangement for repositioning the media with the opposite side facing the printhead is anticipated. In one example if this type, the leading edge of the media loops back while twisting it 180 degrees around the axis of motion; in another example, the media is twisted before re-inserting it into the exit end of the printhead mechanism. Two other examples do not twist the media. One brings the lead end of the media into the exit of the printhead assembly. A second, preferred, technique brings the tail end of the media back to the printhead but then takes it on an alternate path around the head and back to the original entrance. This last example has the advantage of no space consuming twisting and having an un-interrupted grip on the media, such as by pinch rollers just downstream of the printhead exit. These re-positioning single-printhead type of arrangements call for a "buffer" area where the media segment can be retained while the duplex operation is taking place. Such a buffer can also be re-used to store the media section until it is completed and can be released for the user to remove.

In a preferred embodiment, when the media is positioned for printing on the second surface, sensors are used to obtain suitable registration between the two printings. One kind of registration is in the direction of media travel. A second deals with skew of the media. Known so-called "calibration" is generally used to refer to determining the distance in positioning system movement between the printheads of different colors. One kind of calibration is relative between two printed patterns, one of each color. One or more interference patterns are created that allow a macro property to be measured to determine the alignment with substantial precision. For example, slightly different spacing of black lines compared to yellow lines that they are printed over produces some regions where much unprinted media is exposed and others where very little is: the position of the extreme values of these easily measured regions reveals the alignment.

The term "sense-distance" will refer to the positioning system movement between a feature as seen by a sensor and the feature as printed by the printhead. One way to perform calibration between color positions is be determining the sense-distance of each color and then calculating the distance between those. Sense-distance can be measured, in an example where a so-called "edge detector" is mounted along with the printhead, by determining the coordinates of the positioning system that maximize the edge detector output and the coordinates used to print the edge features that was detected. (The edge detector output can itself be calibrated so that it sees a leading and trailing edge at the same point, for example by scanning two such features printed with the same edge line, like one black rectangle touching one above it only just at the corner.) Another example way to determine sense distance is with a grating fixed to the sensor that can then, much as overprinted gratings already described, be used to determine a particular relationship to the printed indicia. Knowing the sense-distance, and measuring a feature previously printed on the other layer, allows the head to be positioned to print any desired distance (along the particular axis used) from that feature, at least in the direction of the sense-distance and assuming no skew.

Media may slip in the roller system and it may skew. One example way to compensate for these potential problems uses features printed on the first surface that are sensed while printing the second surface. Preferably the features would be at opposite sides of the media, so as to maximize the accuracy of measuring skew. Edge detectors can be used to determine the position along the direction of printing that the media is in relative to the printhead. Skew is recognized as the difference between such distance measurements taken at the two sides of the media. Special features can be printed or the known features of the pattern printed can be used.

One example way to deal with skew is to move the media as the printhead moves; another example way is simply to shift the image as printed, such as the row of an inkjet used for the bottom of the swath, in a linear way as the printhead moves. At the start of a swath, preferably each swath, the vertical position can be adjusted physically by moving the media so that it in a pre-arranged or normalized vertical position; such normalization can also be accomplished fully or in part by which elements of the printhead are considered to be the bottom most. If the skew compensation is by moving the media, then the normalized position can be the starting point; but if the skew compensation is by shifting the image pixels, then an offset from the normalized position is preferred if a constant swath width is desired.

Another exemplary approach to dealing with skew uses the full printhead swath width with the whole- image digitally rotated to accommodate the skew. Such skew compensation can be adjusted from time to time and/or as needed in case slip causes changes in skew. It should be noted that backlash considerations would suggest that if the media is to be moved during printing of a swath, then the sensed position would preferably be measured in the same direction of motion as the compensation. By choosing the side skewed upwards to print from, the motion of the media can be kept in the forward direction. Another example approach is for the mechanical motion to remain the same, but for the sensor(s) to report during printing and for the digital image of the pixels to be printed to be adjusted so that the registration results. In such a mode, the sensors are believed preferably leading the printing position so that they allow compensation for upcoming positions.

DETAILED DESCRIPTION OF PREFERRED EMBODIMENTS

Detailed descriptions are presented here sufficient to allow those of skill in the art to make and use the exemplary preferred embodiments of the inventive concepts disclosed.

The application titled "Physical and Digital Secret Ballot Systems," PCT/US01/02883 filed 29, Jan. 2001, by the present applicant, is hereby included here in its entirety by reference.

Turning now to FIG. 1, seven example ways to split ballot information are shown. Each shows the two parts separated by a dotted line. It is believed that taken together the two parts determine the choice of candidate, but that either of them taken separately does not reveal anything about which candidate was chosen (as already described).

Figures 1A, 1B, 1C, 1D, 1E, 1F, 1G:
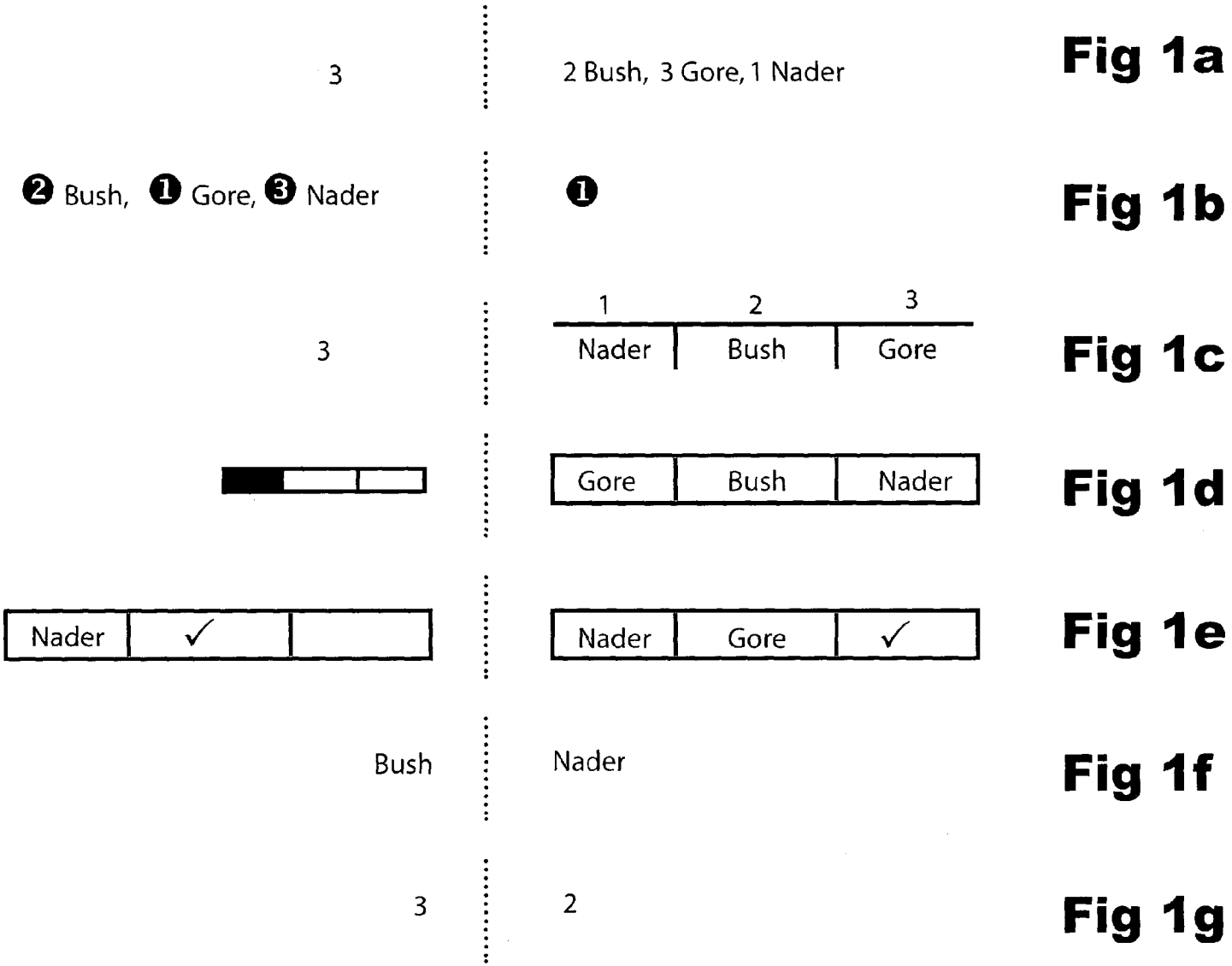

Referring to FIG. 1*a*, for instance, the value on the left is the label of the candidate in the list on the right. The list is in order, except that a random cyclic shift has been made in the ordering of the labels. Clearly "Bush" is the selected candidate, because the label on "Bush" matches the value on the left of the line. But knowing 3 alone, does not give any clue as to the candidate. Similarly, a randomly labeled list by itself also give not clue.

Referring to FIG. 1*b*, variations on the version of FIG. 1*a* are shown. The right and left sides are reversed, which would allow a piece of paper to be more evenly divided if done alternately for each contest or in sections of contests. Also special indicia are used as labels for extra readability and less ambiguity. Furthermore, a full random permutation of labels is shown, rather than a simple shift. As will be appreciated, however, such a permutation can be determined uniquely from a shift amount allowing for the factorial of the number of candidates.

Referring to FIG. 1*c*, on the left are columns of a table that are labeled in a standard way. The candidates have been a arranged randomly in the columns. On the left is the column number of the chosen candidate Referring to FIG. 1*d*, a geometric pattern is duplicated on the two sides. The candidate names are associated with certain positions in the pattern on the right; on the left, one position is marked in a distinguished way.

Referring to FIG. 1*e*, room for preferably about half of the candidate names is provided in ordered locations on both sides. The idea is that one or more locations on a side would contain a selection symbol, shown as a check mark. When the same location on the opposite side of a check mark has a candidate name, that is the selected candidate; when the corresponding location opposite a check mark is empty, it does not select a candidate.

Referring to FIG. 1*f*, on the left is one candidate and on the right is one candidate. The rule is that if they differ, the one on the right is the selected candidate. This can be regarded as related to the game theoretic game, attributed to Von Neumann and Morgenstern, of "Penny Matching". A variation of this not shown for clarity is the familiar children's game, with unclear origin, "Rock Paper Scissors" (known also as "Roshambo" and other names): each side would be marked with one of the three symbols; the selected candidate would be the winner: stone over scissors, paper over stone, and scissors over paper.) Variations and generalizations on these games can, also be applied, in some examples, and if the game admits a draw, then multiple instances for the same office can be present.

Referring to FIG. 1*g*, on the left is the index of the candidate and on the right is the shift amount of the standard candidate order, such as has been described with reference to FIG. 1*a*.

These techniques can be applied for each contest (whether candidate or referenda) and printed on the same form, as will be readily appreciated. Serial numbers and other items described herein can be contained on such forms, not being shown here for clarity. Perforations or other devices to allow the halves to be separated and/or to be folded for privacy are not shown for clarity. Another exemplary variation not shown for clarity is where one strip lists all candidate names and the other contains a check mark next to the one selected. Suitable registration marks would be provided to fix the alignment of the strips and also possibly make alignment of slots more obvious.

Figure 2:
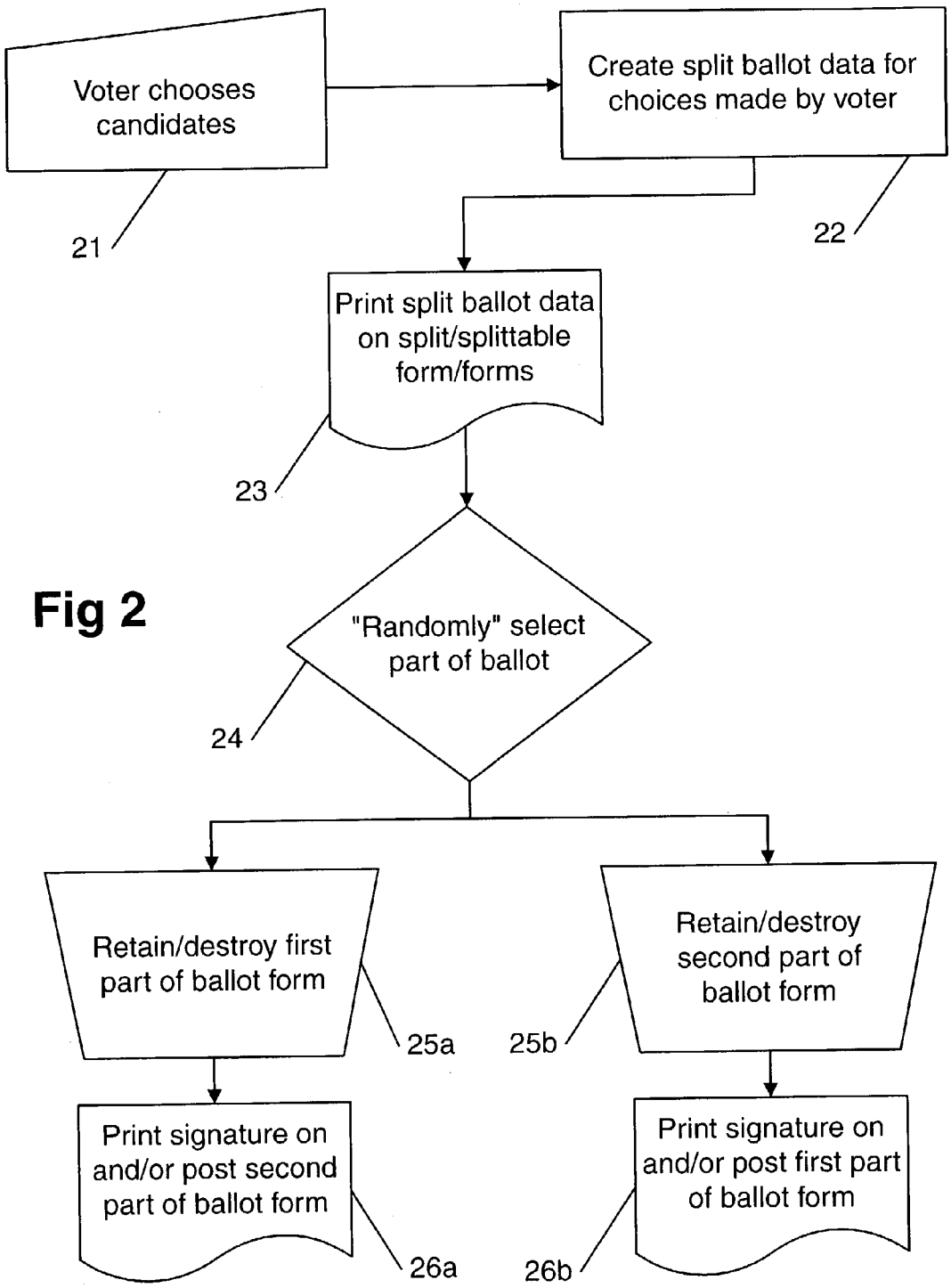
FIG. 2 is a combination block, functional and flow diagram for an exemplary printed split ballot scheme, in accordance with the teachings of the present invention.

Turning now to FIG. 2, first the voter makes a choice of candidates 21. One way is know touchscreen voting that may include optional review and edit features. An inventive variation is that a scan of a paper form filled out by the voter would provide the initial choices that could then be reviewed and possibly edited by the voter (as was mentioned and will be detailed further with reference to FIG. 5). Once the voter decides to in effect "push the cast my ballot button," step 21 is completed and the ballot form can be created and printed. Creation 22 can include choosing random values for shift/permutations, such as those described with reference to FIG. 1. Printing 23 can be accomplished with a single printer for a single form or pre-perforated form ready to be split; two printers could be used, one for each half form; or the output of a single printer could be split before it leaves the device.

The "random" selection 24 of part of the ballot is preferably done in a mutually verifiable manner, such as an automated dice roll as already mentioned. Voter choice or third party choice are also possible. Moreover, additional information beyond the choice bit would further help differentiate the ballot and provide a challenge to the signature, and possibly have other advantages. Once the choice is made, it determines whether the left or right branch is followed. Each branch is similar in the example, except that right and left are interchanged as are the label suffixes "a" and "b".

The processing after the choice is made can take various forms as indicated elsewhere. One illustrative example is presented here in detail, though any of the other variations could readily be realized based on the descriptions provided. Thus, in the case that the choice is for the left branch, the first part of the ballot is retained at the polling place or destroyed 25*a*, such as by shredding, preferably in front of the voter. Then the digital signature is formed on that part and printed for the voter (preferably on the same form) and/or the ballot form data is posted 26*a*. And in the case that the choice is for the right branch, the first part of the ballot is retained at the polling place or destroyed 25*b*, such as by shredding, preferably in front of the voter. Then the digital signature is formed on that part and printed for the voter (preferably on the same form) and/or the ballot form data is posted 26*b*.

Figure 3:
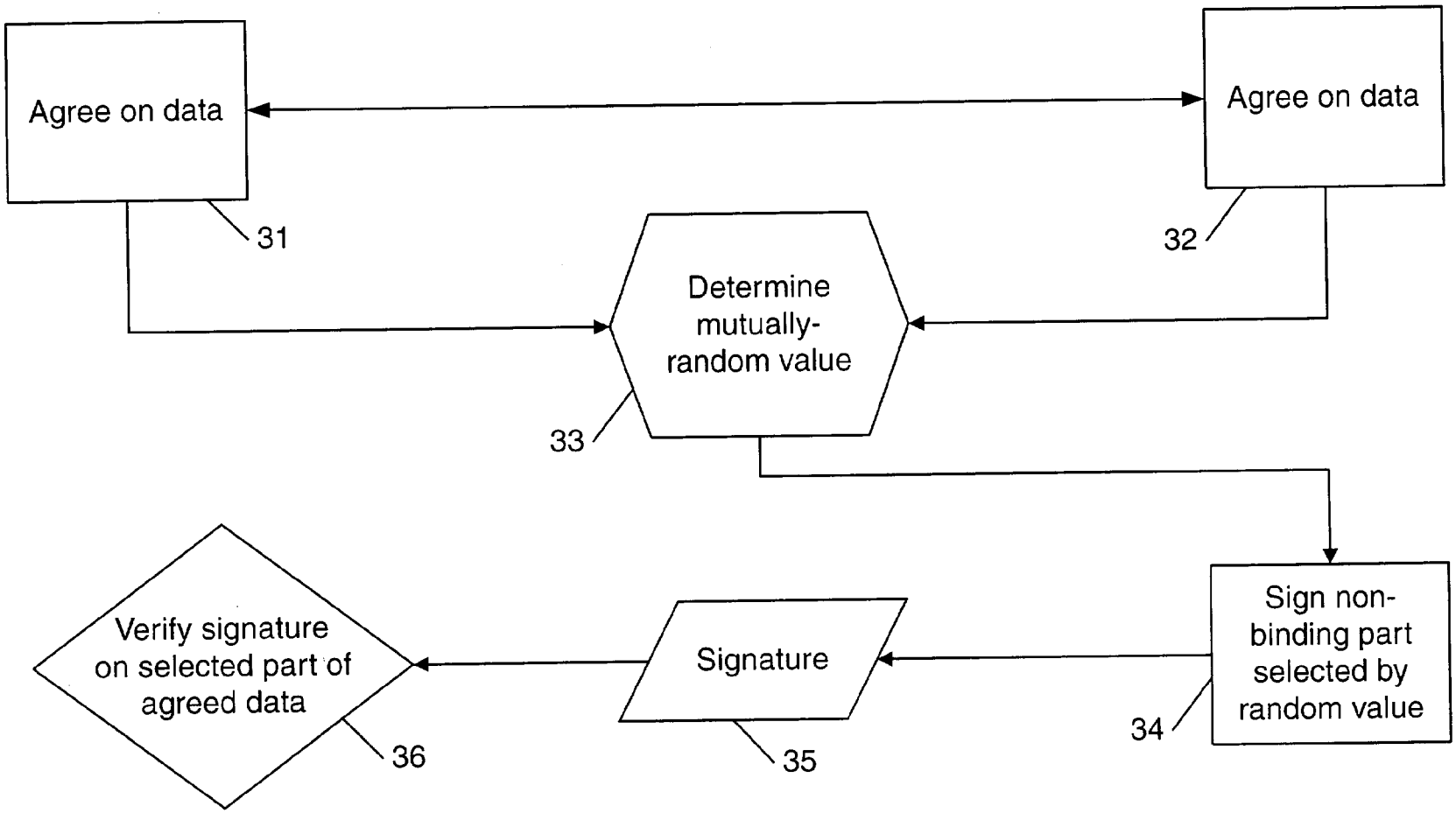
FIG. 3 is a combination block, functional and flow diagram for an exemplary split signature scheme, in accordance with the teachings of the present invention.

Turning now to FIG. 3, a network version of an example of a general embodiment not necessarily related to voting is provided in detail. First the two parties agree on the data, as shown in boxes 31 and 32. In the example of voting, the data could be the splitable ballot image. After this, they complete the determination 33 of a "random" value, preferably "mutually random" so that neither can manipulate it. After this, the prover provides 35 a digital signature on the selected part of the data. The data can be divided into two parts, or in other examples more parts. When more than two parts are used, coding and threshold techniques can be used to make any agreed subset necessary and sufficient to recover the actual data. The recipient party can then verify 36 the signature.

Figure 4:
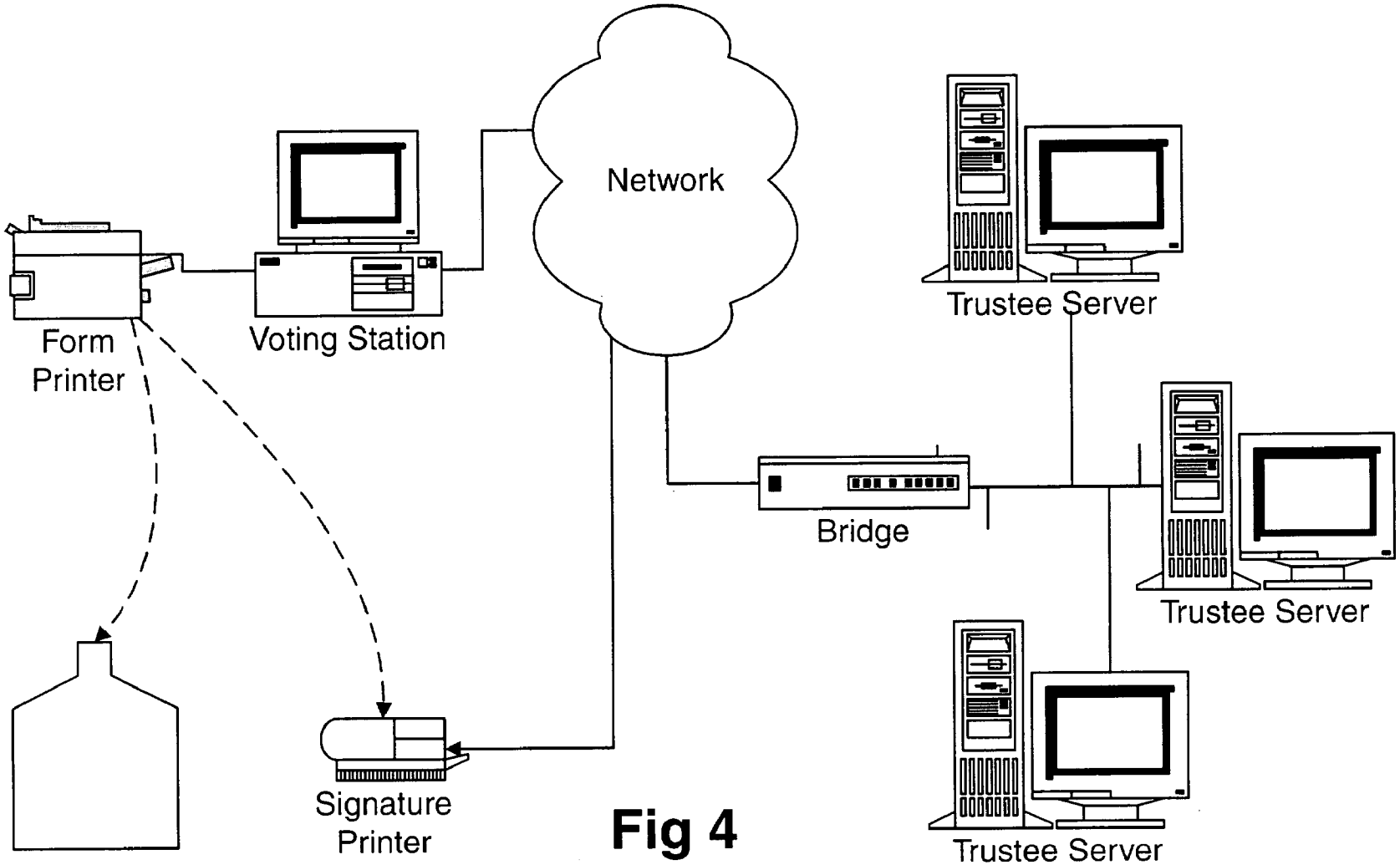
FIG. 4 is a combination block, network, functional and flow diagram for an exemplary printed split ballot system, in accordance with the teachings of the present invention.

Turning now to FIG. 4, an example realization of a voting system is shown in realistic detail for clarity and so that various inventive aspects can be more readily appreciated, but without the intention of any limitation whatsoever. On the right are three Trustee Servers. These are intended to be independent parties to conducting and ensuring the integrity of the election results. Their cooperation (or a threshold of them) is preferably required to accept the votes and make the signatures. They communicate through an optional intermediary, shown as a Bridge and Network. The voter interacts with equipment, shown as a Voting Station, which could include scanner and/or touchscreen equipment, to make and commit to the choice of candidates. Then the Form Printer shown connected to the Voting Station prints the form, such as with entries like those in FIG. 1. The voter, not shown for clarity, then provides as shown by the dotted arcs the two halves to the vessel/shredder shown on the left and the Signature Printer on the right. The choice of which part to send to which is determined preferably by the random event as already described and not shown here for clarity. The Signature Printer can know which form has been inserted for double printing by a small scanner part, manual entry, or other means; alternatively, the printing of the signature may be on a separate sheet with some indicia provided for correlation.

Figure 5:
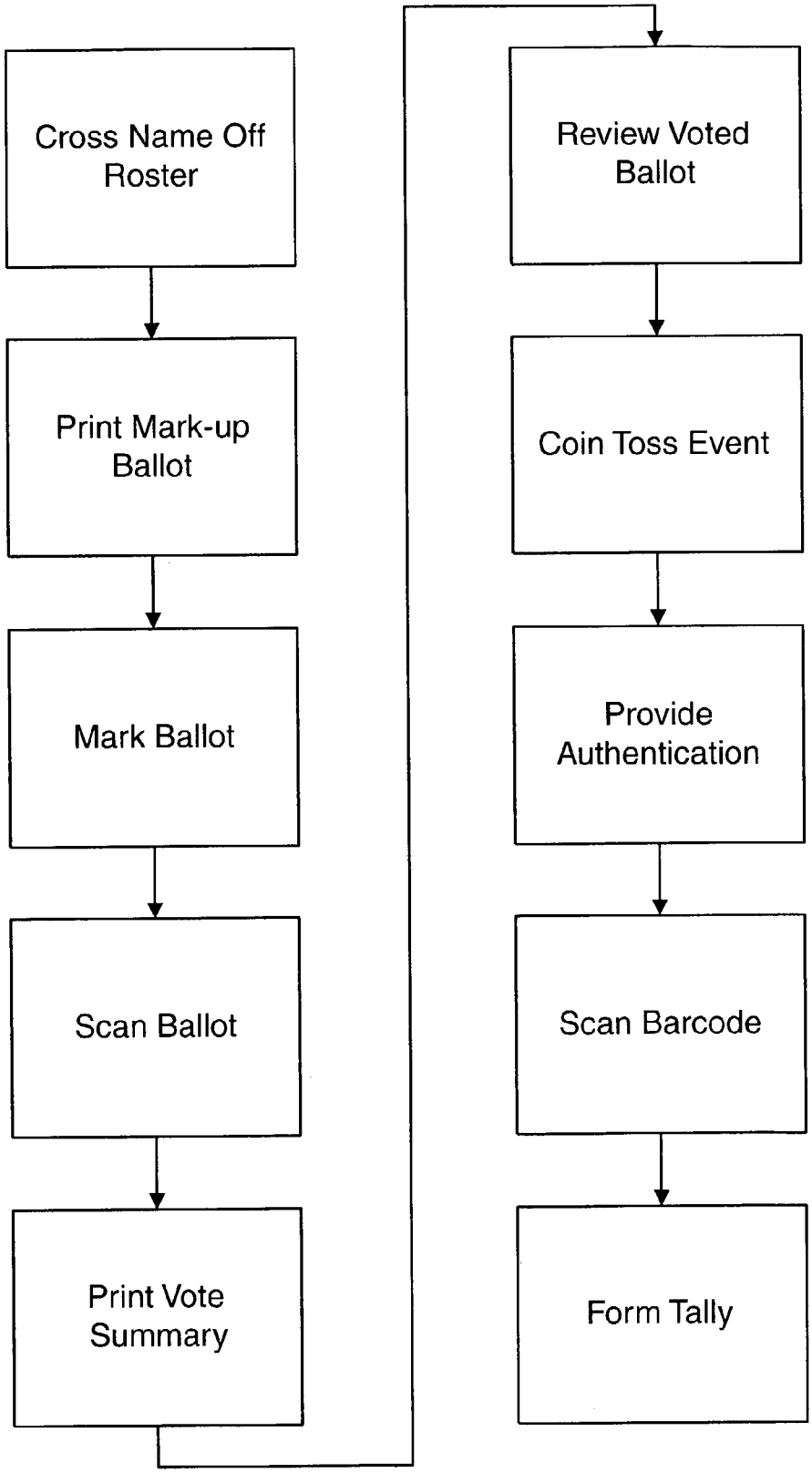
FIG. 5 is a combination block, functional and flow diagram for an exemplary scanned-entry voting system, in accordance with the teachings of the present invention.
Figure 6A:
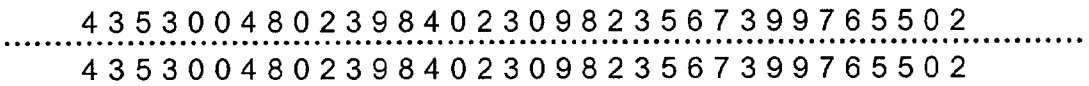
Figure 6B:
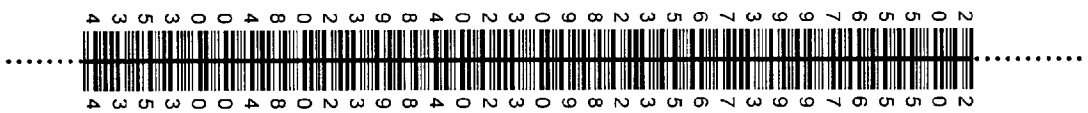
Figure 6C:
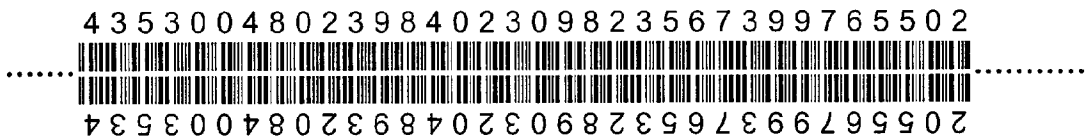
Figure 6D:
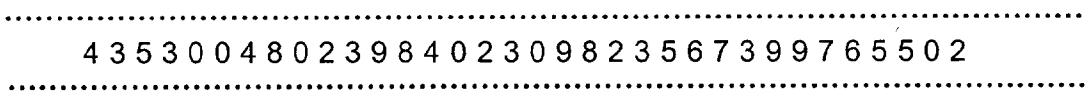
Figure 6E:
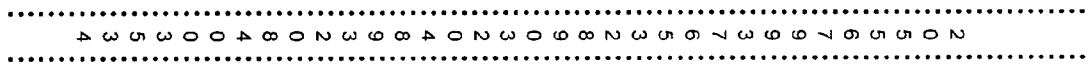

Turning now to FIG. 5, an example application of some of the inventive concepts allows plural voters to be using a single set of hardware, thereby reducing cost and waiting time for voters. Moreover, common ballot styles can be printed in advance; less common ones printed on demand. Each step/element in the figure is described in the bullet item below with the corresponding name:

Cross Name Off Roster—A voter is allowed to vote and prevented from voting again, by whatever means, such as crossing a name off a list of registered voters or modifying a database entry for that voter. The "ballot style" appropriate for the voter is determined in this process, such as by the location where they live, the language they prefer, and/or the political party they belong to. (Only a restriction on ballot style may be determined, as described elsewhere.)

Print Mark-up Ballot—If the particular ballot style required is not readily at hand, perhaps because it is less common or the reserves are depleted for common styles, one can be printed on the spot.

Mark Ballot—The voter enters a booth and can mark the choices of candidates using a marking instrument (such as one supplied for the purpose or one carried by the voter).

Scan Ballot—The marked ballot is scanned by an optical scanner (a standard scanner can be used instead of a dedicated "mark-sense" reader). Preferably, this form would not be returned to the voter, but rather retained or destroyed by the voting equipment.

Print Vote Summary—The candidate choices made are reflected in the two-part ballot form that is then printed out and provided to the voter. The data captured is also recorded electronically, locally and/or remotely.

Review Voted Ballot—The voter can check, preferably inside a booth, the voted ballot.

Coin Toss Event—A bit is determined that is hard for the system to manipulate, (preferably, e.g., a coin toss experiment in view of the voter) to determine which half of the ballot the voter will be able to take away.

Provide Authentication—The ballot part that will be released to the voter can be authenticated by, for example, being posted in an electronic form and/or by a corresponding digital signature. (The ballot part not released can be retained and/or destroyed in whole or in part in a related operation.)

Scan Barcode—The barcode or whatever indicia printed on the ballot half kept (preferably in a way that does not reveal the other information on the ballot) is read. (The ballot part not released can be retained and/or destroyed in whole or in part in a related operation if this has not been done related to the provision of authentication as mentioned above.)

Form Tally—When it is time to tabulate votes, the recorded data can be used to form the tally, by operation on the data by the trustees. If this data is unavailable, the ballot halves that have been kept can be scanned in and used for this purpose or the ballot halves held by voters could be used as a last resort.

Turning now to FIG. 6, disclosed are some example "splitable" symbologies, those that can be identified uniquely even when only a left or right half is provided. The example 6*a* shows the same set of digits repeated on each side of the split line. FIGS. 6*b* and 6*c* show barcodes (of the common 3 of 9 type, as an example), such that each bar spans the split. Optional numeric labels are provided for these codes, and they can be oriented in various ways, two being illustrated (which are also applicable to the style of FIG. 6*a*) and another example provided in FIG. 6*a*. Also shown are example different treatments for indicating the split line through the barcode, black in FIG. 6*b* and while in FIG. 6*c*, though no split or other indicia are anticipated. FIG. 6*d* has two dashed lines. The one that should be used is the one that would make the piece of paper released to the voter larger; in other words, the digits will always be included in their entirety on the portion provided the voter. The other portion would not be sufficient to allow the election results to be calculated in general and might be shredded. FIG. 6*e* is similar to 6*d*, except that the digits are arranged differently.

Figure 7A:
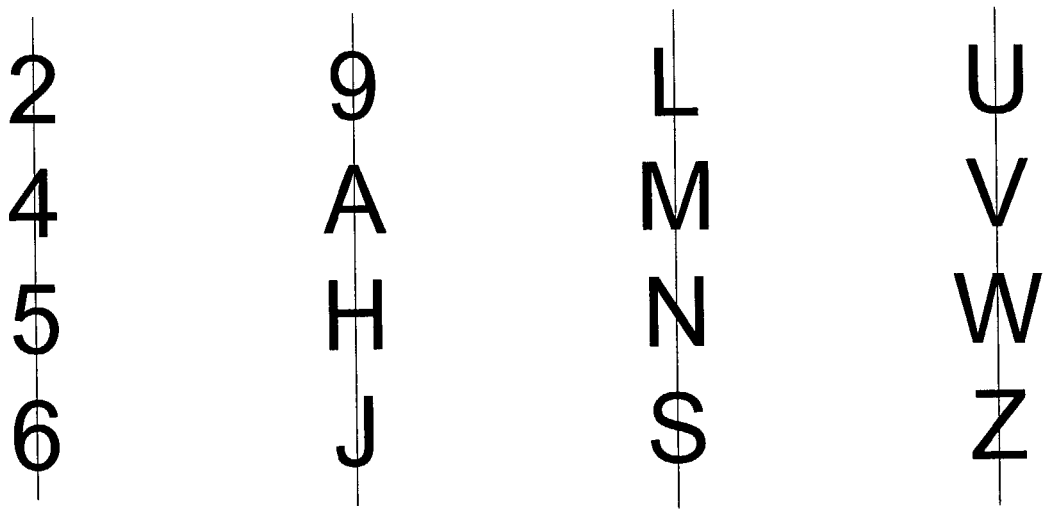
Figure 7B:
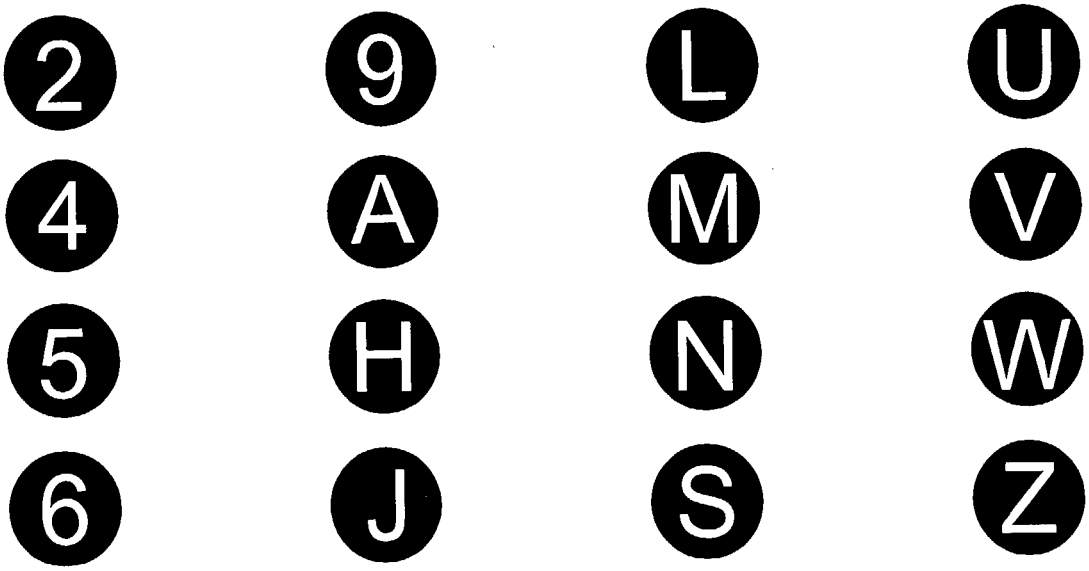

Turning now to FIG. 7, disclosed are some example "splitable" symbologies, those that can be identified uniquely even when only a left or right half is provided. The particular choice of 16 common letters and numbers in a standard upper-case sans-serif font are believed examples of readily recognized such symbologies. More specifically, FIG. 7*a* shows the example with a vertical split line and FIG. 7*b* shows each reversed-out of black circles. Other criteria used in selecting these rejected those with centered vertical lines, as these features might be too registration sensitive. Also, the choice was made in the example not to include a single member from an indistinguishable group, though this might be done to increase the number of symbols, possibly at the expense of ease of understanding or use by the public. The symbologies of FIG. 7*b* are used elsewhere in the figures as examples, but without limitation.

Turning now to FIGS. 8 and 9, example ballots are shown. The split line is shown as a dotted line on that cuts through the splitable symbologies already described with reference to FIG. 7*b*. In both examples, candidates are listed in order of the offices and within the offices shifted by the corresponding shift amount. The "no-vote candidates" are shown as empty strings, but there position is determined by the shift amount (as a canonical position of after all the named candidates, for instance, is used). In FIG. 8 two referenda are also shown, with the "yes" and "no" answers being treaded as candidates, but without no-vote option. The votes are shown in bold outside the candidate field: on the left of the split for FIG. 8 and above the split, and labeled by example office names, in FIG. 9. The split values, that represent an encoding of the concatenation of the ballot serial number with the "vote+hiding rotation" value, are intended to be unambiguously readable on both haves after a ballot is split (although they could be left with the half released to the voter). As an example, note in FIG. 8, the 19 on the left refers to Honda; similarly, in FIG. 9, the 35 vote for Attorney General is for Waxman.

Turning now to FIG. 10, a detailed exemplary schema as will be appreciated to further elucidate an example voting system in accordance with the present invention is described. The schema consists of an upper diagram and separate parts detailing two cases, "A" and "B". For clarity in exposition, a single voter and a single contest are shown, but without limitation. Referring to the upper diagram, two values are shown committed to initially by the conductors of the election: the "shift" and the "rotation", each being shown as the pre-image under a cryptographic function that also takes secret seed values, D and C respectively, as input. Such commit values would typically, in known manner, be digitally signed and published on an open network, such as the Internet, by the conductors of the election; the secret seeds, would however be kept secret by the conductors at least until used as will be explained. The lower line of text in the upper diagram shows the three values that would be contained in the ballot provided to the Voter for review. The leftmost is the sum (all modulo the number of effective candidates, without explicit notation or mention, for clarity, as described elsewhere) of the actual voter's vote and the secret shift amount already mentioned as committed to. The middle is the sum of the actual vote and the rotation, referred to here variously as the "coded vote" or the "rotated voted," also as already mentioned above. The third is the shift, already mentioned for this line. The two underscore lines are intended to indicate that the first two values on this line are what are released in case "A" and that the second and third in case "B" detailed below. The diagonal lines indicate relationships established in the corresponding cases, as will be described.

Referring to the lower part of FIG. 10, the two cases are described in detail. In case "A", preferably chosen at "random" as described elsewhere, two values are released. One is the sum of the actual vote and the rotation, the other is the sum of the vote and the shift. Also, a "proof" such as in the sense of the term used in the cryptographic protocol art, is given. What is proved is that two differences are equal (sometimes referred to as congruent in the present modular setting). One difference is simply that of the two values released, which can readily be computed by any party with access to them. The other difference is between the two values committed to, as already mentioned with reference to the upper part of the diagram: the rotation minus the shift. To establish this second difference, various techniques are known in the cryptographic protocol art. The difference is to be established, preferably with high certainty, but without substantially further disclosing the individual subtrahend or minuend. Plural examples of suitable commitment schemes allowing addition/subtraction are known in the art, but for concreteness see, "Zero-Knowledge Proofs for Finite Field Arithmetic . . . " R. Cramer & I.B. Damgaard, BRICS RS-97-27, ISSN 0909-0878, November 1997.

Figure 11A:
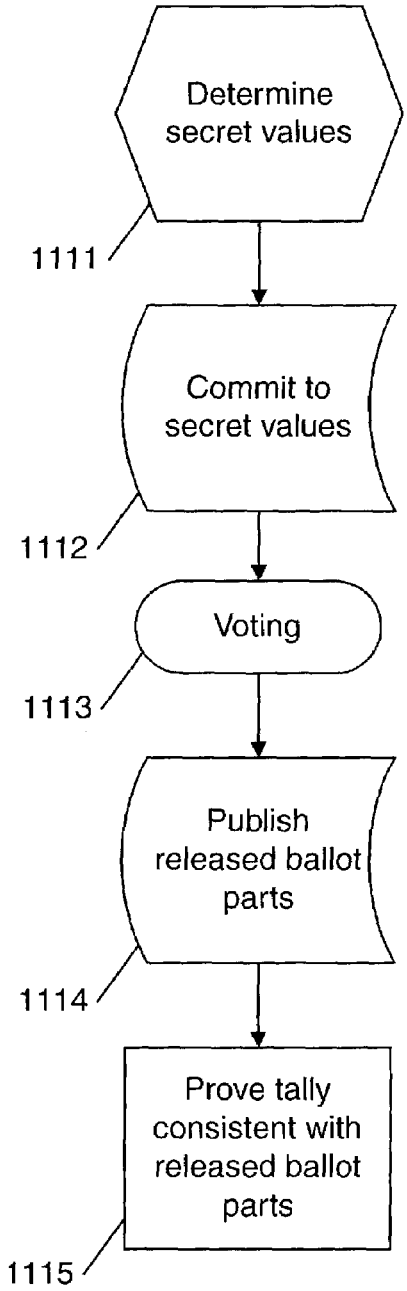

Referring to case "B", three values are released. One is the sum of the vote and the rotation (the coded vote), the value common to both cases, as already mentioned. The second value is the shift, which would for instance be revealed if the amount of shifting a list of candidate names is printed in some embodiments. The third value is the seed D, already mentioned referring to the upper part of the figure, that hid the shift amount in the commitment. Anyone with access to these last two values and to the commitment should be able to readily verify that they properly correspond, such as by applying the commitment function "f" to the last two values and verifying that the result is the first commitment Turning now to FIG. 11, detailed exemplary overall method and apparatus flow and block diagrams will be presented. FIG. 11*a* shows an example overall election, whereas FIG. 11*b* shows an example voting part in more detail.

Overall, in some examples, there are two related parts before the voting and two other related parts after it. The first part before, the "Determining of secret values" 1111, indicates that the party(s) conducting the election, the "conductors," can choose values that preferably will be secret to the conductors at least until the privacy of voting is no longer an issue. After each and any value is determined by the conductors it can be committed to by the conductors, such as by a "Commit to secret values" 1112. Example ways to commit are release of digital signatures/authenticators of whatever type on the data, release of hash functions on the data, publishing values on electronic networks, sending values to others who may do some or all of these things, and so forth, whether iteratively, recursively, redundantly, and/or in combination. The "Voting" part 113 will be detailed later with reference to FIG. 11*b*. The "Publishing of released ballot parts" 1114 is a way to ensure the agreement of the conductors with certain values released during the voting 1113. Example ways to establish agreement include, but are not limited to, publishing over electronic networks, sending in electronic form, releasing of digital signatures/authenticators of whatever type, sending values to others who may do some or all of these things, and so forth, whether iteratively, recursively, redundantly, and/or in combination. The "Proving of tally consistent with released ballot parts" 1115, at least in some examples, comprises revealing certain values and/or responding to certain challenge values, by the conductors, in such a way as to convince others, and preferably any interested party, as is known in the cryptographic art, that appropriate correspondence between the committed, released and tally values holds.

Figure 11B:
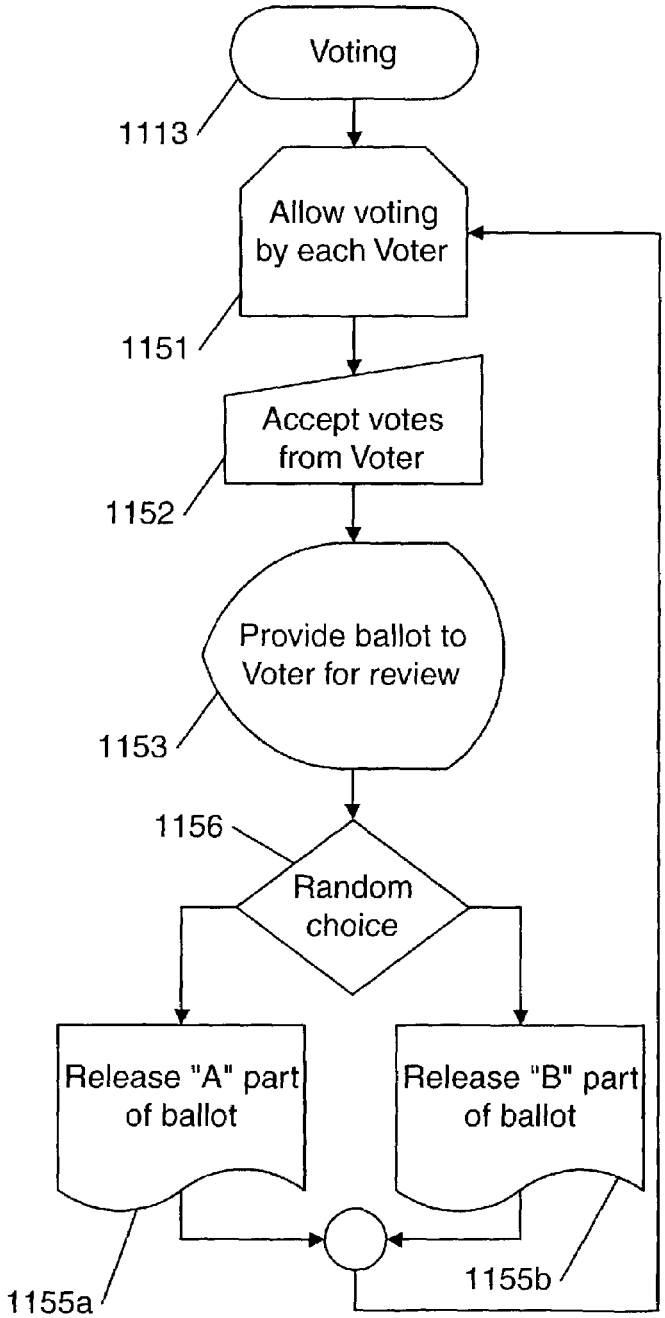

Referring to the "Voting" part 113 as detailed further in FIG. 11*b*, some examples without limitation are given. Voting by plural voters can be in any order and with any degree of parallelism and/or sequentially, but is shown for clarity here as a loop starting with "Allow voting by each Voter" 1151. Considering now for clarity a single voter, the conductors "Accept votes from Voter" 1152 by whatever means, such as, for ex ample, but without limitation, scanning paper, sensing touching of buttons or surfaces, voice, and/or other human utterances, many examples of which are known in the art. After one or more votes are accepted for a Voter, the conductors can "Provide ballot to Voter for review" 1153, such as preferably by printing it out and/or by displaying/voicing it. Once all or part of a ballot has been provided Voter for review, a "Random choice" 1156 is made between alternatives, of which there can in general be any number, but a two-way choice being shown for clarity. Depending on the choice, different parts of the ballot are released to the voter so that the voter can in general have them and take them away for further purposes, such as, but not limited to, further verification, scrutiny, publishing, safekeeping, recovery, and so forth. Other parts provided in 1153, however, are not released, such as by keeping them inaccessible to, or recovering them from, the voter. The two example alternatives shown are "Release 'A' part of ballot" 155*a* and "Release of 'B' part of ballot" 155*b*. As mentioned, voting is shown as a loop iteration per voter, but can in general be comprised of any number of parts per voter and across voters.

Turning now to FIG. 12, another detailed exemplary overall method and apparatus flow and block diagrams will be presented. The upper row, 1211, 1212, and 1213, show what are public postings of information in the corresponding temporal order. The lower arrows, 1221 through 1224 show the voting of an example voter (or a collection of voters, depending on how it is viewed) also in a temporal ordering from left to right. The second layer up from the bottom shows things the voter interacts with, 1231 through 1234, also correspondingly ordered. First, the voter approaches the user input 1231, as shown by arrow 1221. Once having entered input (at least in some embodiments) the voter next, as shown by arrow 1222, collects the user output 1232 and then proceeds, as shown by arrow 1223, to the choice 1233. At this point, the voter may decide to finish voting as shown by arrow 1224 or to spoil the ballot and try again, as shown by backwards pointing arrow 1226. The voter may also check 1234 the posted ballot part for equivalence with the ballot part released to the voter (such as at 1232 or 1233) The middle layers, where computation is done by the voting system, can be structured in a variety of ways in keeping with the inventive concepts disclosed here, one example being shown for clarity. A preprocessing makes 1241 the initial commitments, as a post processing makes 1242 the tallies and proofs (these could be by the same parties or, for instance, by potentially different quora of the same set of trustees). Knowledge of the vote is believed inherent in some local intelligence 1232, which maps the choices from the input 1231 into what is output 1232. Not shown for clarity are potential ballot style databases that devices need to know to render choices to voters.

Two sources for posted ballot parts are shown, the local party that knows the votes 1241 and the choice or scan 1233. Either could supply the data. For example, the released part could be scanned 1233 and the scan data posted. Or, as another example, the device that knows the votes could retain and then provide the ballot part data once it learns the choice of parts.

Not shown for clarity in the figure are various possible multiplicities. Naturally, there might be many precinct locations and even multiple installations at a single precinct. Similarly, "posting" can be accomplished at multiple venues and also in combination with digital signature or other authentication. Possession of the secrets used to form commits and later proofs and tallies, are also naturally spread across multiple parties. In the cryptographic protocol art, it is common for secrets to be divided across a set of parties, such that a quorum comprises a majority of parties and can perform the computations.

Multiple ballot styles can introduce other complexity not shown for clarity. For instance, a party not shown could be in charge of deciding which ballot style (or from which set of ballot styles) the voter is to be allowed to vote. The authenticated message from this party would then be provided to the system shown, and voting would be conducted with the appropriate ballot style(s). The tallies at least would reflect substantively different ballot styles. In some settings, the set of trustees might vary with ballot style, as would the postings.

Turning now to FIG. 13, some exemplary write-in ballots are shown in accordance with the teachings of the present invention. In FIG. 13*a*, a scheme is illustrated with two digit coded write-in candidates on the upper part of the ballot and the coding table on the lower part. The rule is to map each letter of the candidate name by looking up the corresponding two digits in the table. In FIG. 13*b*, a substitution that includes mainly letters in the ciphertext, with a couple of digits (3 and 5 in the example). The rule here is to look up each character in the middle bold row and choose the first unused symbol, starting from above, then below, then above to the right one, and so forth. This way, unlike with FIG. 13*a*, repeated characters in the write-in name do not yield repeats in the cyphertext printed on ballot. As would be appreciated, the mapping would preferably be treated essentially as a shift amount.

Figure 14A:
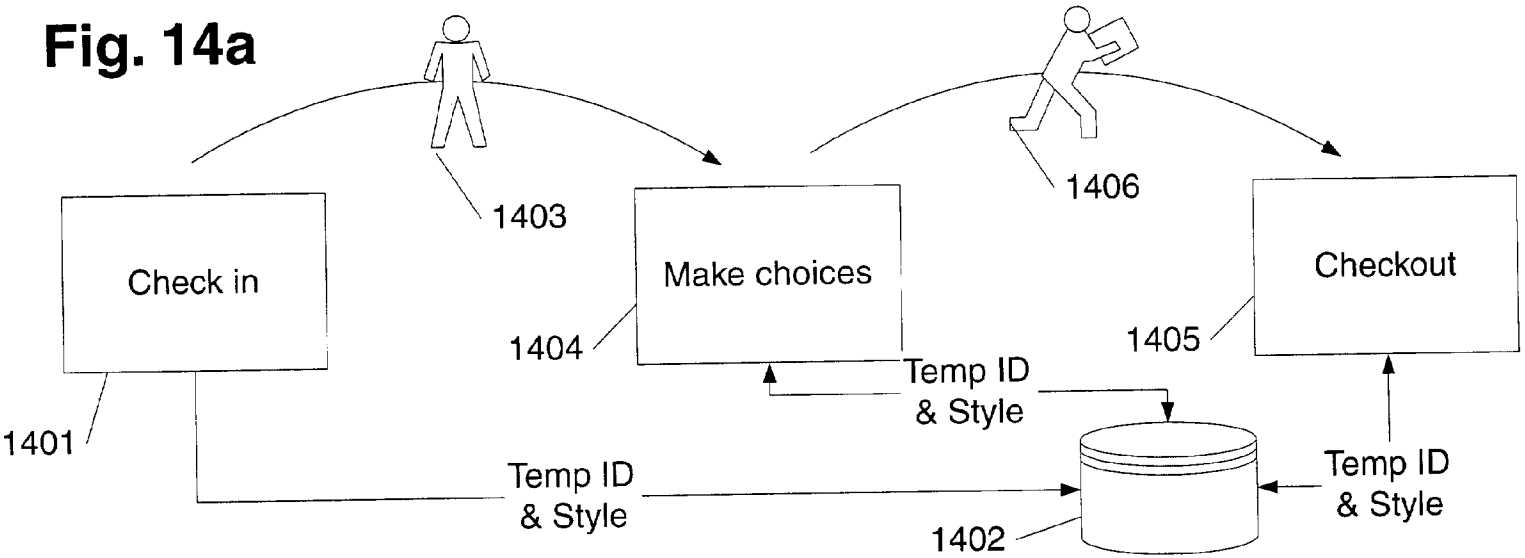

Turning now to FIG. 14, shown is a combination block, functional, schematic, and protocol diagrams for exemplary ways to control voter interaction in some exemplary embodiments of the invention. Referring to FIG. 14*a*, first the voter checks in 1401, which typically comprises checking on a voting roster or register and marking the voter as having checked in. At this point a ballot style range is determined and a temporary voter ID is assigned. The ballot style range can be the single authorized style, or a set of styles that the voter is free to choose between as will be described. It can be in coded form in the roster and only readable to the station. The ID can for instance be created afresh, preferably at random, or as a serial number. It is believed preferable from a privacy perspective to use a temporary value, but an actual voter ID could also be used.

Next the voter moves 1403 from the check in 1401 to the make choices 1404 processing stage; the ID and style range are agreed between the database 1402 and the make choices. In this embodiment, no objects are shown being transported at this stage. One example way for this agreement is that the voter supplies some kind of identifying information, such as a PIN code corresponding to the temporary ID, not shown for clarity, and this is provided to the database 1402 that then determines the choice range and returns this. Another example is where the poll worker(s) in effect indicate, such as by entering into a control device connected to one or more of the make choice 1404 or database 1402, the correspondence between voter ID and the particular make choice that the voter will visit. In some embodiments, the make choice 1404 is merged with the checkout 1405 to be described, in others the voter may make visits to plural make choices before checking out. For clarity, a separate checkout is shown. The style used at make choice 1404 can be left uncontrolled, and only controlled at checkout; however, voters may appreciate being sure that they are voting the correct style (so that they don't have to redo it). Not shown for clarity is that there can be plural instances of check in(s) 1401, make choice(s) 1404 and checkout(s) 1405.

The voter takes 1406 the printed ballot from the make choices 1404 to the checkout 1405. Checkout 1405 preferably is able to ascertain that this ballot is of an allowed style for the voter and that the voter has not checked out yet, and to make records sufficient to ensure that the voter cannot check out again. One example way to perform these functions is that the temporary voter ID is read from the ballot, database 1402 is queried and updated, and the vote lodged. Linking to the temporary ID at making of choices 1404 and also at checkout 1405 can provide an impediment to those who would allow others to vote for them and provide them with a ballot to checkout with. Linking can be by ballot number containing the ID. Verifying that the ballot style is allowed can be unnecessary in some configurations, where the ID was used to control the ballot styles voted and then the ID also remains associated with the ballot. It is believed sufficient to enforce whatever restriction on ballot style at either the make choices 1404 or alternatively at the checkout 1406—provided that there is enforcement of the ID correspondence at the two points.

Figure 14B:
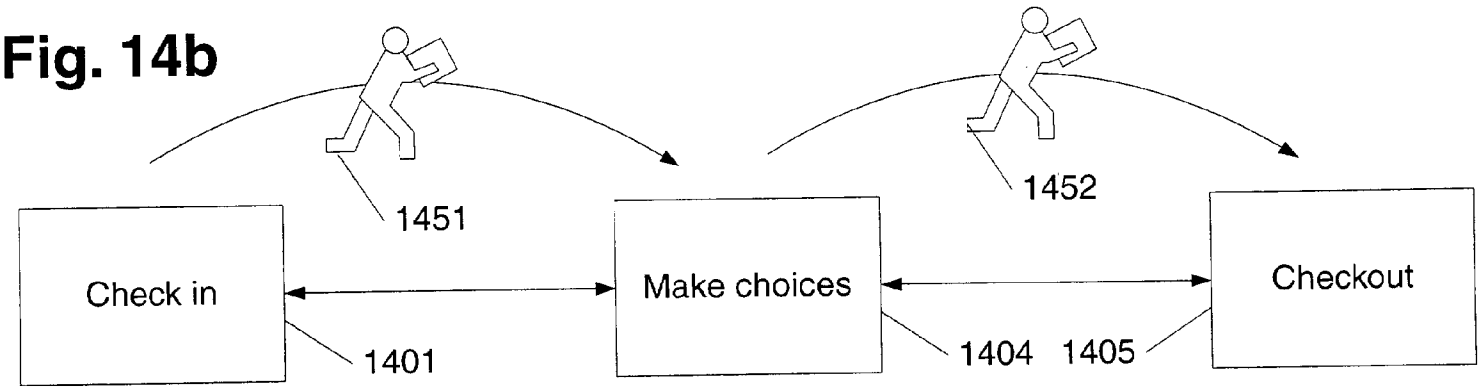

Referring now to FIG. 14*b*, check in 1401, make choices 1404 and checkout 1405 are shown as in FIG. 14*a*. Movement 1451 by the voter from check in 1401 to make choices 1404 is shown with one or more objects being transported with the person; similarly, movement 1452 by the voter from make choices 1404 to checkout 1405 is shown with one or more objects being transported with the person. Examples of suitable objects are microcircuitry, such as computers, memory, battery, wireless/contact communication, cryptographic functions and so forth, as are known, combined with carriers, such as metal touch buttons, smart cards, bracelets with erase-on-open features, or ballot cassettes. Instead of the central database architecture shown in FIG. 14*a*, this approach of maintaining the data by the devices and then recycling the devices can be used, such as by employing cryptographic authentication as is known. Another example approach, that can be combined or used separately, is direct communication between the check in 1401, make choices 1404 and checkout 1405, instead of communicating to a common database; as is known in the art, such a database and its functions can be distributed over these points in general.

A PIN number or the like printed on a paper or sticker or the like and handed to the voter at check in 1401 can then be used by the voter to get the correct ballot style or style range during making choices 1404 and then optionally, but preferably, again to allow checkout 1405. (As will be appreciated: interchanging of such slips or the information on them can allow styles to be swapped by cooperating voters; physically checking them at checkout can require physical swapping. Including a photo or the like can require swapping and re-swapping.) A plain large ballot carrier, can also be used in combination with such a slip, and the slip can be placed as a sticker or otherwise bound to the carrier. A passive or active data token can also be taken with the voter in the movement 1451 and 1452. An active carrier can be used without the database and communication between stations. A passive token can be used in combination with communication between instances of the same station type, not shown for clarity.

Turning now to FIG. 15, shown is a combination block, functional, schematic, and protocol diagrams for exemplary ways to control voter interaction in some exemplary embodiments of the invention. In particular, three examples are shown: one with an active token carried by the voter, one with a passive token, and the third with no token. Each is shown as three parts, the actions/mechanisms of the three stations with respect to a voter visit; some of these can be combined and/or one or more could be split.

Figure 15A:
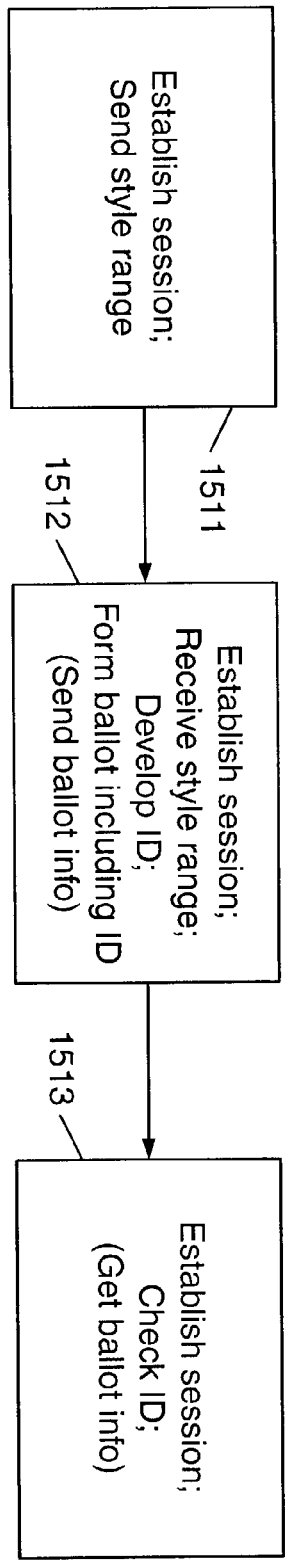

Referring to FIG. 15*a*, an active token example is shown. The first station, as indicated in box 1511, establishes a preferably cryptographically authenticated session between the station and the active token carried by the voter (not shown for clarity). Within the authentication of this session, the style range established by the station is communicated to the token. Not shown for clarity, however, is that the token state changes as a result of this transaction to one ready for voting.

The voting station, as shown in box 1512, first establishes a cryptographically authenticated session with the token. Then the token communicates the style range to the station. An ID for the ballot is developed preferably through a cooperation between the station and the token in such a way that neither can manipulate the outcome. One example known approach to this is where each commits to a random value by disclosing to the other the image of the value under a suitable one-way function; then the ID is taken as the modulo two sum of the two random values, released after both commitments are received. This ID is then formed into the ballot to be taken to the next station. Optionally, some or all of the ballot image information can be transferred through the active token.

The checkout station, as shown in box 1513, first establishes a preferably cryptographically authenticated session with the active token. Next the ID of the ballot is checked against that in the token. This optionally resets the token so that the ballot cannot be cast again, such as in the case of multiple disconnected checkout stations. Optionally, instead of scanning the ballot for the ballot info, the ballot info can be obtained by the checkout from the token.

Figure 15B:
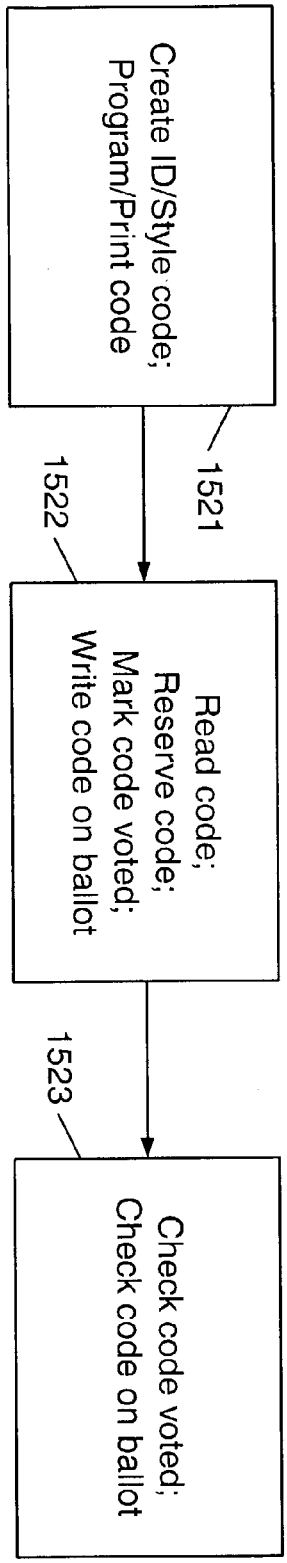

Referring now to FIG. 15*b*, a passive token example is shown. The first station, as indicated in box 1521, can create and ID and determine style range information and encode these in the token, whether it be a writeable tag, such as by RF or galvanic contact, or printing on paper or the like. Alternatively, a tag that has a fixed and preferably unique ID can be chosen from a pre-established collection of such tags; it may include the style indication, or a mapping to such indication may be otherwise provided to the voting station.

The voting station, as shown in box 1522, first reads the code from the token. It then in communication with the other voting stations makes sure that it has exclusive use of it, at least for the moment, by "reserving" it; all the other stations agree that it is reserved by this station. Preferably once the voting is completed, the station informs the other stations of this by "marking" the code. Stations could mark the code initially, but then if the station failed for some reason to be voted, the voter would not be able to visit another station. The code is preferably incorporated in the ballot.

The checkout station, as shown in box 1523, first checks the code on the network to ensure that it was voted. Also, the code is checked against that on the ballot. Then the code can be "tagged" to indicate that the ballot has been cast, either over the network if there are other checkout stations, or simply by local memory if there are not.

Figure 15C:
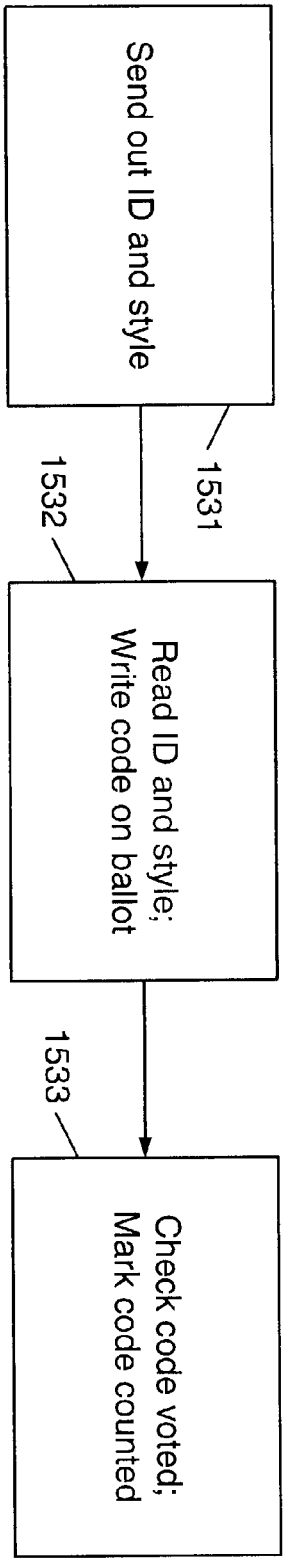

Referring now to FIG. 15*c*, a no token example is shown. The first station, as indicated in box 1531, transmits the ID and any style restriction to the voting station that the voting official(s) have designated for the voter.

The voting station, as shown in box 1532, reads the ID and the style. The code is preferably included in the ballot information.

The checkout station, as shown in box 1533, first checks the code voted. As one example, it could be a digital signature and self authenticating, as another, it could be received from the voting station. Recycling fixed codes would, it is believed, allow an imposter ballot to be fabricated and counted. If there is more than one checkout station, the code should be marked as voted.

Turning now to FIG. 16, shown are various views of an example single voting station, with automatic paper handling capabilities, in accordance with the teachings of the present invention.

Figure 16A:
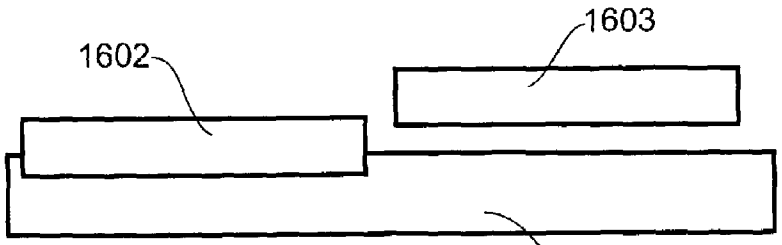
Figure 16B:
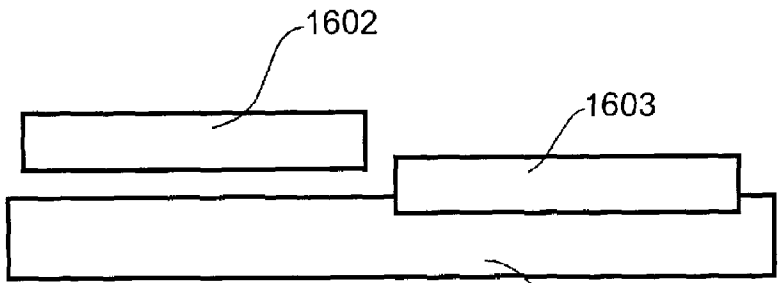
Figure 16C:
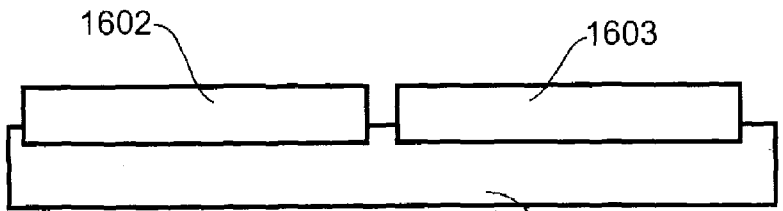

Referring to FIG. 16*a–c*, the apparatus can be seen in front view looking at the rollers where the paper would come out. Referring to FIG. 16*a*, a configuration in which the left side of the ballot is shredded and the right side passed through, roller 1601 remains in a spaced relationship to roller 1603 while roller 1602 engages roller 1601. Referring to FIG. 16*b*, a configuration in which the right side of the ballot is shredded and the left side passed through, roller 1601 remains in a spaced relationship to roller 1602 while roller 1603 engages roller 1601. Referring to FIG. 16*c*, a configuration in which both sides of the ballot are shredded, such as in the case of a spoilt ballot, rollers 1602 and 1603 engage roller 1601.

Figure 16D:
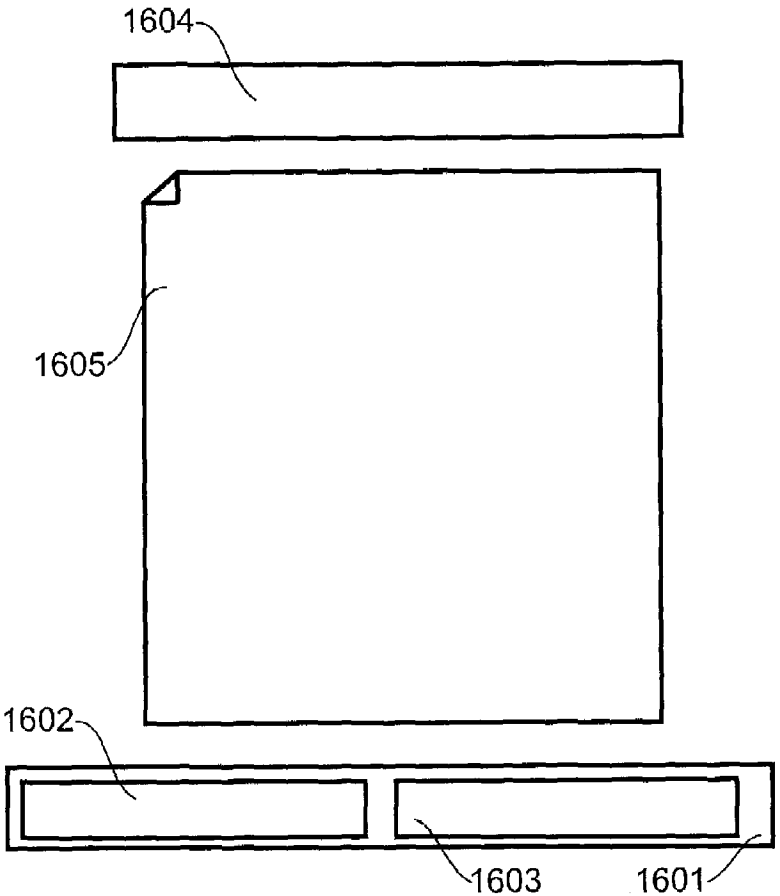

Referring to FIG. 16*d*, the apparatus can be seen in plan view. The print engine 1604 can be seen at the beginning of the paper flow. An example piece of paper, on which typically a ballot would be printed, is shown at rest on its way between the printing and shredding stations. The shredding rollers shown in FIG. 16*a–c* in a front view, are shown in top view in FIG. 16*d*. The two smaller rollers, 1602 and 1603, are shown on top of lower roller 1601. In operation, ballot 1605 would be printed by print engine 1604. The voter would then be given an opportunity to review the ballot, preferably through a transparent window or the like, not shown for clarity, so that the voter cannot readily and/or undetectably remove the ballot. Also, not shown for clarity, is a mechanical lever or the like that could alter the configuration of the mechanism between those shown; alternatively, the position of the rollers could be changed under solenoid or other actuator control as would be understood in the electromechanical arts. Then, the voter can be presented with two or three options. The voter can, in case of three options, choose to spoil the ballot, in which case both smaller rollers 1602 and 1603 would be in engagement with lower roller 1601 as the ballot is moved forward and shredded substantially in its entirety, possibly leaving a middle segment. In case it is decided that the voter should be able to retain the right half of the ballot, then the configuration of FIG. 16*a* would be entered and roller 1602 would shred the left half of the ballot on its way out, with the chips falling into a receptacle not shown for clarity; the right half of the ballot would leave the device and be available to the voter. In case it is decided that the voter should be able to retain the left half of the ballot, then the configuration of FIG. 16*b* would be entered and roller 1603 would, in cooperation with roller 1601, shred the right half of the ballot on its way out; the left half of the ballot would leave the device and be available to the voter.

In some embodiments, part of the ballot 1605 would remain under the print engine while the decision about which part to shred is being made; once it is made, additional information would be printed on the part that is not to be shredded, such as a digital signature or other compact proof such as a pre-image. In some embodiments, the ballot form 1605 could be moved backwards some distance to allow for this final printing, such as when print engine 1604 requires too much bite.

Turning now to FIG. 17, a plan schematic functional view of an exemplary inventive ballot carrier cassette in accordance with the present invention is shown. In operation, first the ballot would be placed into the cassette, either by the voter or automatically, not shown for clarity. The cassette comprises a structure 1701 that is preferably substantially not transparent and not too flimsy to conveniently hold the ballot. Window 1702 preferably allows a part of the ballot, preferably a part of the serial number or other identifying information, to be viewed. Furthermore, cutouts 1703*a* and 1703*b* preferably allow the placing of markings, such as adhesive labels, on the ballot form without removing the form from the carrier 1701. Apertures 1704*a* and 1704*b* allow, in some example embodiments, a slicing by manually or automatically operated cutter not shown, of the ballot into parts without removing both from carrier 1701. Also shown is a label, passive, or preferably active tag 1705 as described elsewhere here. In operation, various indicia and/or scratch-off elements could be applied, such as by adhesive, to ballot through the cutouts 1703. After the choice of halves is made, the ballot would be split physically using one of the corresponding apertures 1704, and one part would be taken by the voter and the other would be placed in a ballot box or shredded. The cassette 1701 could be configured to accept the ballot form in a folded arrangement, where the lower edge is brought up in front to just below the top of the form, exposing the upper part of the form but hiding the vote information when halves are removed. Optional tag 1705 would be used at check in, voting stations, and checkout as described elsewhere here.

Referring now to FIG. 18, a section of an exemplary bracelet or band in accordance with the invention is shown. The band is intended to be placed around the wrist of the voter at check in and removed at checkout, with recycling a possibility, all as mentioned elsewhere here. The structure comprises a substantially un-stretchable band 1801. The fastening means, not shown for clarity, would preferably be capable of adapting to various sizes of wrist, much as with quick-release watch bands. Preferably active tag 1802, as also described elsewhere here, would be affixed to band 1801. As mentioned elsewhere here, it is preferable that when the band is opened and/or cut, the tag is able to change state or at least sense this configuration at a later point, thereby deterring people from transferring the band because the tag behavior would be changed, preferably destroying ballot information and reporting only a tamper or ready to be re-checked-in.

Figure 19A:
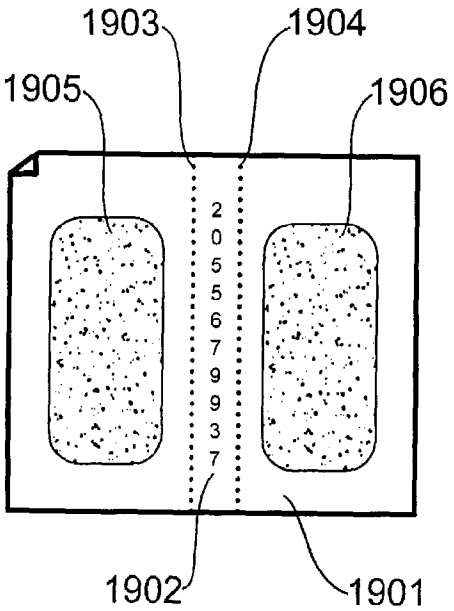
Figure 19B:
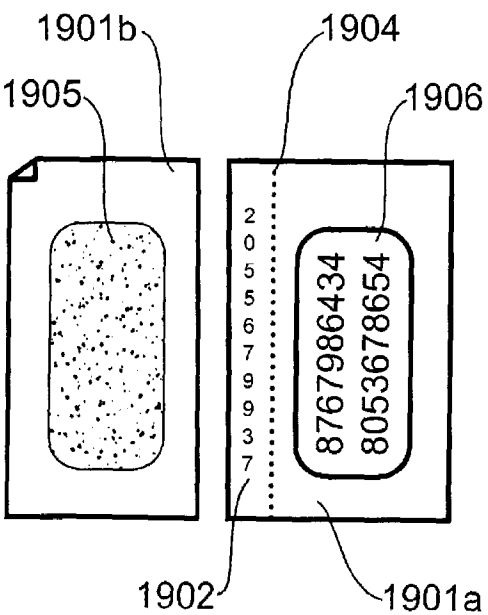
Figure 19C:
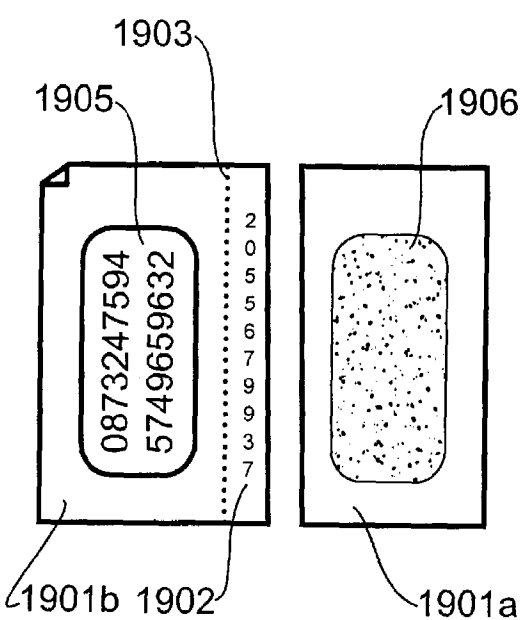

Turning now to FIG. 19, an exemplary scratch-off ticket in accordance with the teachings of the invention is shown. The paper ticket or sticker 1901 is shown with the scratch-off latex intact in FIG. 19*a*, with it removed on the right in FIG. 19*b*, and removed on the left in FIG. 19*c*. All three bear the same serial number indicia 1902 and the two separation lines 1903 and 1904 where not split. The regions bearing the twenty-digit pre-image or key for the respective commits are 1905 and 1906. Both are hidden by latex in FIG. 19*a*, number 1906 is revealed by scratching off the latex in FIG. 19*b*, and number 1905 in FIG. 19*c*. As mentioned elsewhere, when the form is split, the serial number 1902 will, in the example, stay with the part given the voter. When the half with 1906 is to be given the voter, as shown in FIG. 19*b*, the split is made on destroyed line 1903; similarly, when the half with 1905 is to be given the voter, the split is made on destroyed line 1904. Of course the indicia on this ticket or sticker can in some example embodiments be on the ballot form itself. The seed numbers 1905 and 1906 can serve to prevent false spoiling, as already mentioned. Number 1905 can, in some embodiments be the key used to decrypt the difference between the value added to the vote and the shift amount; number 1906 can, in those embodiments, be the key used to decrypt the shift amount (and the tally process would use the difference between the commits as the encrypted vote).

Turning now to FIG. 20, shown is an example voting location in a combined block, functional and flow diagram, with trustee modules, online connections and plural checkers, in accordance with the teachings of the present invention. Box 2001 is intended to denote the equipment that is inside the polling-place. This equipment is anticipated to be comprised of various computers, communication, I/O means, and storage including for software. Additionally, preferably tamper-resistant modules 2003*a–c* are shown (three strong, though the number used can depend on the application) for holding and administering the secret values of the trustees that can be used during an elections, such as those used to make digital signatures and/or to open or show relationships between committed values, as described elsewhere. For each local trustee module, there can also be an online server managing those secrets, 2004*a–c*, shown connected to the corresponding local module by a telecommunication facility. In some embodiments, only local modules could be used without connections, in others, only online connections could be used without the need for local modules. Having both, of course, allows offline operation, but lets control revert to the online center when there is a connection. The communication facilities could be independent per trustee, as is shown, but various kinds of sharing are potentially more practical. The actual transmission of the coded votes can also be by the means shown here.

Voter choice box 2005 indicates that the voter can, after leaving the polling place, choose to have the ballot checked by one or more checkers 2006*a–c*. The voter might, in some embodiments, for instance, provide the ballot part to the voter's party representative stationed outside the polling place for the purpose. It would be preferred that the checker could completely verify the ballot part. If the polling place and checker are online, then the checker can determine if the coded vote on the paper has been properly posted. The proofs, if any are needed at this stage as has been mentioned depends on the embodiment, can also be verified online. But in those example embodiments mentioned, where the ballot part has (perhaps once the scratch-off layer is removed) the needed information, possibly in combination with data that can be obtained and stored by the checkers in advance of the election, the checker can do everything in real-time except verify that the coded vote is published. The checker 2006 can, however, store the coded votes and check later that they have been properly published and raise an alarm if they have not been. Digital signatures, for example, contained on the form would allow the checker to publish the alarm in a convincing way.

Turning now to FIG. 21*a* through 21*c*, shown are exemplary scratch-off coin-flip ballot features in accordance with the teachings of the present invention. In particular, each figure shows one of the four distinct configurations of a form 2101 that is to be split in two along a line 2103 bearing printed messages hidden by scratch-off covering 2102. As will be appreciated, the rest of the ballot and/or other information could be on the reverse side and/or is left out for clarity. Whatever scratch-off covering, referred to as "latex" here, is applied over each rounded corner rectangle 2102 and would hide the messages printed below it—though the messages are all shown through in the figure for clarity.

In operation, the voter would, at least in a preferred example, be free to choose one of the four rectangles and scratch the latex off of that rectangle and show the revealed printing to the poll worker (or a machine) at checkout. If the text says "This half is to be kept by voter," then the voter would be allowed to keep that part of the form and would have to give the other half to the poll worker. If, in the other case, the rectangle scratched off reveals the message "This half for polling place," then the voter should give the scratched-off half to the attendant (or machine) and take the other half away. In either case, one half remains at the polling place (possibly shredded) and the other half is preferably taken away by the voter. At most one rectangle would be scratched off in front of the election official before the decision about which half goes where. The half the remains at the polling place should have at most one rectangle scratched off. But the voter would be free to scratch off both rectangles on the half that they take away. It is preferred that voters be instructed to do so, since checking that both messages are present gives assurance that the forms are correctly printed and allow the voter to receive both halves, each in case the voter makes certain choices.

Turning now to FIGS. 22*a* and 22*b*, exemplary monochrome overlay ballot features in accordance with the teachings of the present invention will now be described in detail. In FIG. 22*a*, a two-part ballot form is shown with a division mark and illustrates both a single ink color system and a novel type of physical form and way to produce the form. The illustration of FIG. 22*b* shows the same form in the reading configuration.

Referring particularly to FIG. 22*a*, in the example embodiment shown, the two halves are mirrored so that when the form is folded along the division mark, which could facilitate this, for example such as by a perforation and/or scoring, the pixels of the one half can substantially come into registration with the corresponding pixels of the other half. This type of arrangement is believed to have several advantages: the thickness of the substrate on which the graphic elements are supported does not cause potential misalignment due to angle; the graphics bearing surfaces/layers are substantially equally far from the outside surface, making their relative intensity and clarity substantially the same; the user, such as a voter, is able to conveniently fold the form and have the two halves held roughly in alignment; only a single surface is printed; alignment of the printing can be only to the division mark and then only in angle and horizontal position., but not vertical position.

Referring to FIG. 22*b*, the form of FIG. 22*a* is shown folded over the division line, the right half being folded over the left half, as can be seen by the position of the folded down corner and it's being covered by a layer of form. For clarity, the form is shown as if it were a transparent material. The name of the candidate has been encoded in a simple five by five fixed-width font. Of course whatever font, including handwritten drawing captured from the voter, can be used. Also, the inter-character space have been left blank for clarity and economy of ink and partly as an aid to registration; however, whatever field shapes and sizes that may be desired can be realized, with or without various approaches to dummy pixels.

Each pixel on the one half form is intended to correspond with a particular pixel on the other half form. When like pixels are superimposed, both graphics cover the same half of the pixel area. With opaque black ink on paper, as one example, light transitivity would be reduced to about half. When opposite pixels are superimposed, each graphic covers a different half of the pixel area and, again with opaque black ink on paper as an example, light transitivity would be nearly zero. The more transmissive the media, the more light, and the less diffusing, the more clear. Nevertheless, some diffusion may aid in blurring the rough edges of the pixels and the amount of transitivity required for good viewing is believed to depend on the lighting environment and the relative intensity of the backlighting and how well it is masked.

Turning now to FIG. 23*a* through 22*c*, exemplary polychromatic ballot features in accordance with the teachings of the present invention will now be described in detail. The final figure, FIG. 23*c*, represents the superimposition of the form shown in FIG. 23*b* over that shown in FIG. 23*a*. Only clarity, two different pixel colors are used, blue and green, and their overlap is shown as black. Any combination of radiation-influencing pixels that interact suitable would be applicable.

Referring to FIGS. 23*a* and 23*b*, each pixel can be seen to be one of two different types and each appears independently to be apparently random and devoid of information content.

Referring now FIG. 23*c*, the superimposition of the two previous figures, ignoring any interference of the medium/substrate for clarity, the coded image appears in a five by five pixel font, as already described and discussed more generally with reference to FIG. 22.

Turning now to FIG. 24*a* through FIG. 24*e*, example schemas and formulas for overlay systems in accordance with the teachings of the present invention are shown. In particular, these formulas follow an approach already presented but adapted here to binary values for clarity. FIG. 24*a* represents the coded vote that is a part of both haves, FIG. 24*b* what would be on a first half, FIG. 24*c* what would be shown and proved if that half is taken by the voter, FIG. 24*d* what would be on the second half, and 24*e* what would be shown and proved if that half is taken by the voter.

Referring specifically to FIG. 24*a*, each bit of the rotated vote is shown as a table entry corresponding to a particular pixel. Each entry is shown as $r_{ij} \oplus v_{ij}$. The "$\oplus$" symbol is used to denote exclusive-or (or potentially a group operation in whatever Abelian group with more than two pixel values). The subscripts, ij, are intended throughout the present descriptions to refer to the coordinates of the pixel that they correspond to. For clarity, in this correspondence, the matrix entries can be taken as mapping in the most obvious direct and one-to-one way to the individual pixels, as if the two were superimposed in space. Each entry in this matrix is the exclusive-or of the corresponding secret rotation bit $r_{ij}$ and the secret vote pixel bit $v_{ij}$. Thus, instead of a single rotation amount for a whole office with the number of values appropriate to cover all choices for that office, there is a single rotation value for each pixel used to display the candidate name and that rotation value assumes only one of the two binary values 0 or 1. Similarly, instead of a single vote value that ranges over all allowed vote options, there will be multiple values, each corresponding to a different pixel that together represent the vote, and each ranging only over the values 0 and 1. Naturally, the choice of font and layout rules can be fixed to create a one-one mapping between the pixel matrix and the vote, or optionally, such as in the case of a voter written write-in, there may be no single such mapping.

The rotated vote matrix can be encoded on the ballot form, not shown for clarity in FIG. 22 and FIG. 23, in a variety of ways. One is using the same pixel coding as for the parts shown there. Another way would be by a separate machine-readable part, such as a two-dimensional barcode for example.

Referring now to FIG. 24*b*, a few pixels of one part of the ballot form, such as the part shown in FIG. 23*a*, for example, is shown. The formulas shown in FIG. 24*b* represent the bit value $s_{ij} \oplus v_{ij}$ that are encoded by the choice of color in pixel ij of that example. To prepare the ballot part, the secret shift value is added modulo two with the corresponding vote pixel value and the resulting bit determines the particular color that is then printed in that corresponding pixel of the form.

Referring to FIG. 24*c*, shown are some example values, $r_{ij} \oplus s_{ij}$, that would be revealed and preferably proven correct in the case when the ballot half of FIG. 24*b* is taken by the voter. As will be appreciated, when any of these bits is added modulo two with the corresponding bit that is encoded by the color of the corresponding pixel i,j and the corresponding i,j bit of FIG. 24*a*, the result should be zero. This would be checked by a voter or on behalf of a voter, as already described.

Referring now to FIG. 24*d*, a some pixels of one part of the ballot form, such as the part shown in FIG. 23*b*, for example, are shown. The formulas shown in FIG. 24*d* represent the bit value $s_{ij}$ that are encoded by the choice of color in pixel i,j of that example. To prepare the ballot part, the secret shift value is determines the particular color that is then printed in that corresponding pixel of the form.

Referring to FIG. 24*e*, shown are some example values, $s_{ij}$, that would be revealed and preferably proven correct in the case when the ballot half of FIG. 24*d* is taken by the voter. These would then preferably checked for equality with the corresponding i,j bit of FIG. 24*d* on the ballot form, for example by a voter.

Turning now to FIG. 25*a* through 25*c*, shown are example schemas and formulas for streamlined overlay systems in accordance with the teachings of the present invention. First FIG. 24*a* shows an example "checkerboard" arrangement for dividing the pixels between the two kinds of treatment. Then FIG. 25*b* and FIG. 25*c* show the values that would be used to print and also would be proven for the respective halves. The notational conventions introduce din FIG. 24 are used here as well.

Referring particularly to FIG. 25*a*, an example part of a binary-valued matrix is shown. The pixels corresponding to 1 bits are treated a first way in FIG. 25*b* and a second way in FIG. 25*c*. The pixels corresponding to 0 bits are treated the second way in FIG. 25*b* and the first way in FIG. 25*c*. The binary matrix can have a regular structure, such as a familiar checkerboard. It can have an apparently random structure, fixed for an election, or as a preferably cryptographic hash function of random input supplied by voters and/or other parameters fixed or committed to in advance. It is anticipated that the structure optionally may be tuned in accordance with particular properties of particular fonts or handwriting encoding.

Referring to FIG. 25*b*, the entries corresponding to 1 bits in FIG. 25*a* have the value shown as $s_{ij} \oplus v_{ij}$ and those corresponding to 0 bits in FIG. 25*a* have the value $s_{ij}$. As mentioned, the value printed on the particular ballot form part would encode the corresponding bit and the corresponding value revealed and proved correct if this half is taken by the voter should match.

Referring to FIG. 25*c*, the entries corresponding to 0 bits in FIG. 25*a* have the value shown as $s_{ij} \oplus v_{ij}$ and those corresponding to 1 bits in FIG. 25*a* have the value $s_{ij}$. The value printed on the ballot form part not corresponding FIG. 25*b* would encode the corresponding bit and the corresponding value revealed and proved correct if the present half is taken by the voter should match.

Turning now to FIG. 26*a* through 26*c*, shown is an exemplary ballot form splitting comprising more than two potential parts in accordance with the teachings of the present invention. In particular, the type of ballot already described with reference to FIG. 22 and 23 is shown intact but with the location of the separation indicated in FIG. 26*a* and each of two parts retained by the voter in FIGS. 26*b* and 26*c*.

Referring to FIG. 26*a*, the character cells 2601 are places where a single separate character of a candidate name can be made visible in the superposition shown, as indicated by the overlapping corners as already mentioned with reference to FIG. 22. The dotted division line 2602 is shown taking an apparently "random walk" across the ballot form while avoiding the cells 2601. This line can be created physically at random and/or by cooperation of the voter and other parties. It is chosen from a large set of possible division lines. The form, is physically divided according to the line, such as by being separated by following pre-perforated lines or by being cut using whatever arrangement of tearing, knives, and/or shears. The actual separation of the complete form into two parts is not shown for clarity.

Referring to FIGS. 26*b* and 26*c*, however, what is shown are the two parts retained by the voter: that of FIG. 26*b* is from the upper layer but below the dotted line; that of FIG. 26*c* is from the lower layer, but above the dotted line. The folded corner is included and the shape of the character cells 2603 on the lower layer are shown with rounded corners.

As will be appreciated, the example divides the overlayed form into two parts, although any number of parts could be used (including zero as in the previous examples). Also, the example avoids the character cells in an example solution to the problem of a cut through an information bearing pixel possibly revealing the content of the pixel on both layers, part of the pixel being on the upper layer and part on the lower layer. It is believed that the probability of a ballot part that is improper in many cells—even on a single layer—avoiding detection with such schemes is substantially lower than 50%.

Figure 27B:
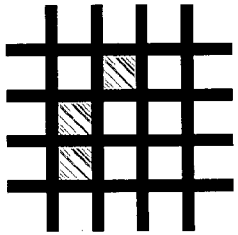
Figure 27C:
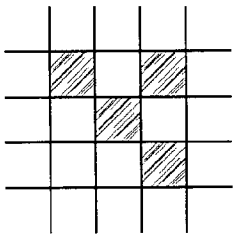

Turning now to FIG. 27, shown are three configurations of an exemplary ballot form material and printing technique in accordance with the teachings of the present invention. The framework lines in all three figures are intended to be pre-printed on the media in this example embodiment. The heavy lines are preferably on one layer of the media in some pre-laminated embodiments; the lines are on both layers in some embodiments in which the layers are printed separately; and in yet other embodiments, the heavy lines are on one layer and preferably invisible or very thin lines are on the other layer. FIG. 27*b* shows that some of the elementary cell locations are filled in by printing. The registration of this printing to the lines can be adjusted based on sensors that detect the position of the lines. As will be appreciated, whatever flaws in the printing registration and edge definition that are covered by the this printing are believed hidden and prevented from doing any harm by the pre-printed lines. Similarly FIG. 27*c* shows another layer with its own positioning of printing. If these lines can be sensed, whether or not they are visible, then they can be used for automatic registration adjustments, as are known in the art. As will be appreciated, the thickness of the heavy lines also provides some non-zero error angle and viewing angle if the heavy lines only appear on one layer.

Figure 28A:
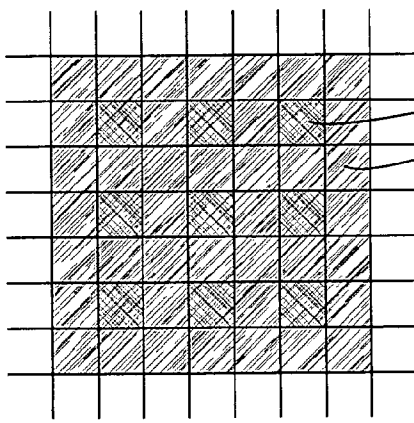
Figure 28B:
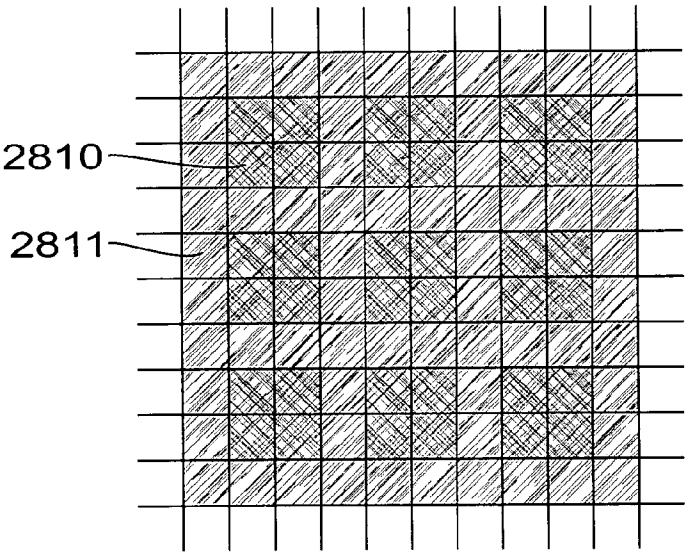

Turning now to FIG. 28, shown is an exemplary single pixel spacing around a block of pixels in accordance with the teachings of the present invention. In FIG. 28*a*, the pixel block can be seen to be comprised of a single pixel 2801 surrounded by a single layer of border pixels 2802, in a regular pattern as shown. As another example illustration, FIG. 28*b* shows a pixel comprising four pixels 2810 but still separated by a single row of border pixels 2811. As would be obvious, any shape of block pixels could be used and surrounded by any number of border pixels. In particular, square block pixels and the grid of border pixels each of any counting number can be envisioned. When both layers are in one of the same such configurations and they are registered above one, another, it is believed that deteriorated viewing begins substantially immediately after the perpendicular but that error viewing does not occur for an angle determined by the relationship of spacing between layers to the minimum width of the border pixels.

Figure 29A:
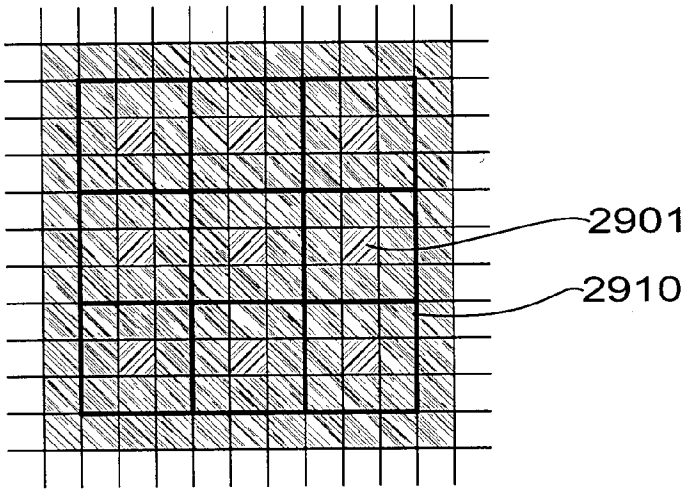
Figure 29C:
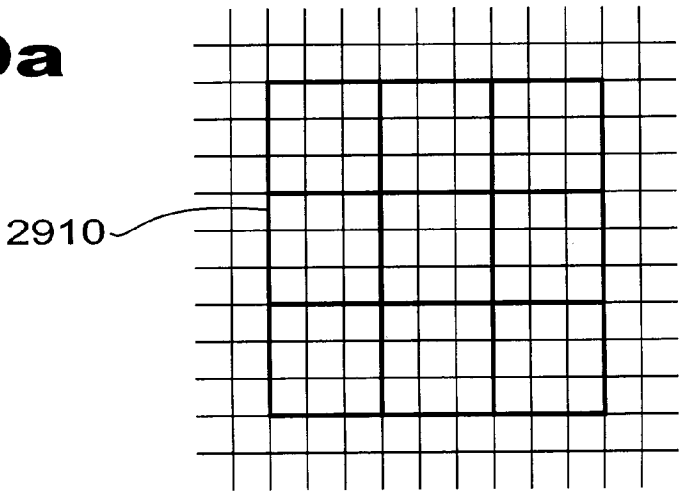
Figure 29B:
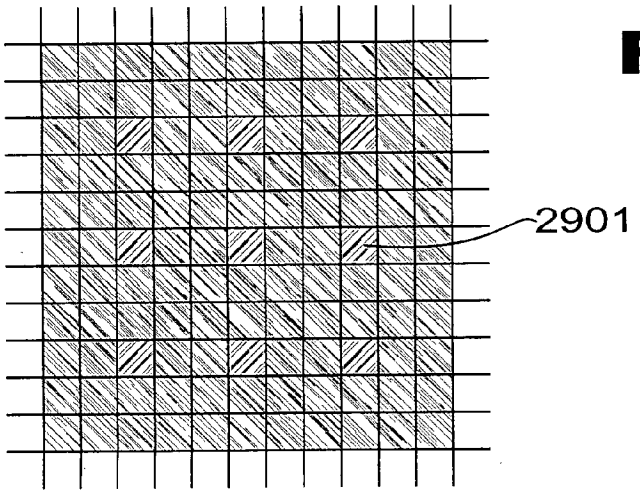

Turning now to FIG. 29, shown are exemplary stacked window sizes in accordance with the teachings of the current invention. The upper FIG. 29*a* shows both layers in superposition, the lower FIG. 29*b* can be interpreted as the upper layer and FIG. 29*c* as the lower layer. As can be seen, each pixel block 2901, comprising a single pixel in the example shown, is surrounded by its own border of a single pixel in the upper layer. The block printing would vary depending on the bit to be printed, as already explained, but the border pixels would always be printed preferably black. The heavy line grid 2910 indicates the pixel blocks used in the lower layer of FIG. 29*c*. Thus, in the example, considering a single cell in registration on the upper and lower layer, and black and white printing for clarity, the upper layer is either opaque or contains a single open pixel in the center, whereas the lower layer is either fully opaque or fully open. Again as in FIG. 28, the inner cells could be any size, not simply the single pixel shown, and the outer cells could be any size, not just only the three-by-three square shown. As will be appreciated, the viewing angle and error angle are believed to be about the same and to depend on the relative size of the pixels and the distance between the layers.

Figure 30A:
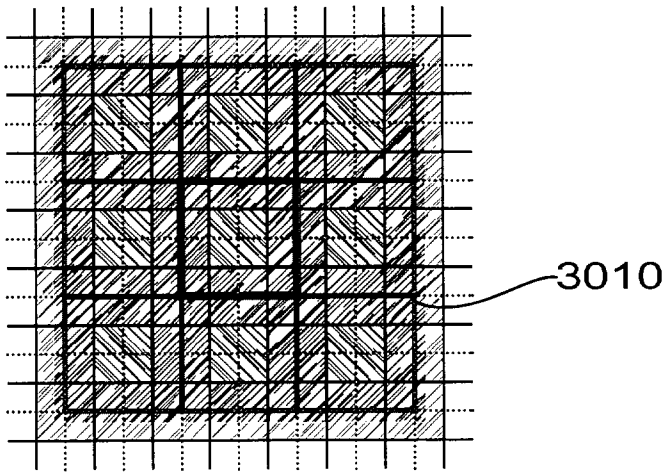
Figure 30C:
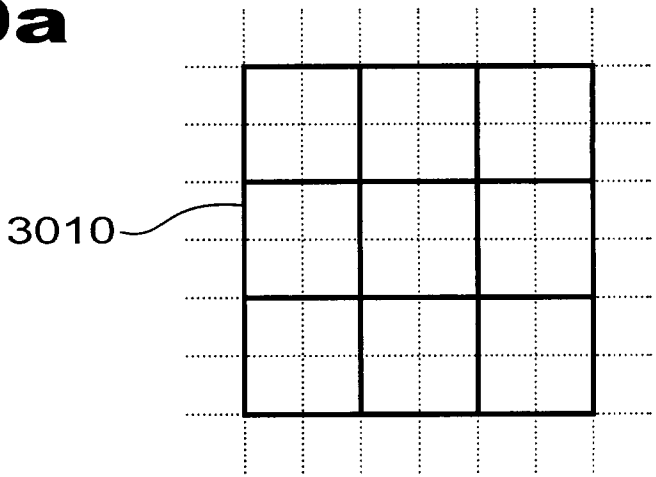
Figure 30B:
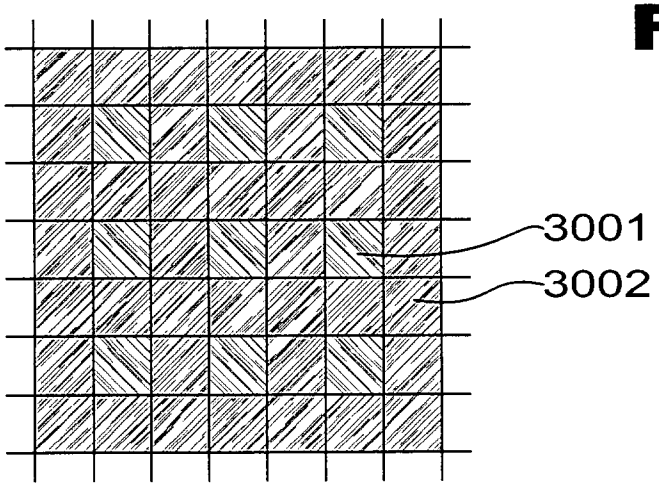

Turning to FIG. 30, shown is an exemplary embodiment of staggered pixel locations in accordance with the teachings of the present invention. An effect much as in FIG. 29 already described is created, but pixels twice as large are used in this embodiment, thereby benefiting by creating higher resolution from a given pixel size or reducing the pixel size used to take advantage of lower cost and tolerances as well as less data. Again the upper FIG. 30*a* shows a composite of both what can be regarded for clarity as the upper layer FIG. 30*b* and the lower layer FIG. 30*c*. In particular, a block 3001 on the upper layer of FIG. 30*b* is shown surrounded by a total border of one pixel 3002, as contrasted with a total border width of two pixels in previous FIG. 29*b*. As will be appreciated, these pixels of the upper layer are shown aligned to the solid thin line grid, whereas those of the lower layer, FIG. 30*c*, are shown aligned to the dotted line grid. These two grids are fully out of phase with each other in both dimensions. Thus, for example, the center of a block on the top layer 3001 is at the intersection of pixel boundaries on the lower layer. The lower layer of FIG. 30*c* is divided into two-by-two blocks, as indicated by the thick lines 3010, that are aligned to the grid pattern shown as dotted lines. As will be appreciated, any block shape and boundary configuration could again be used with these staggered techniques, the example shown believed to be one of the smallest and simplest and chosen for clarity. An example variation would stagger in only one dimension.

Figure 31B:
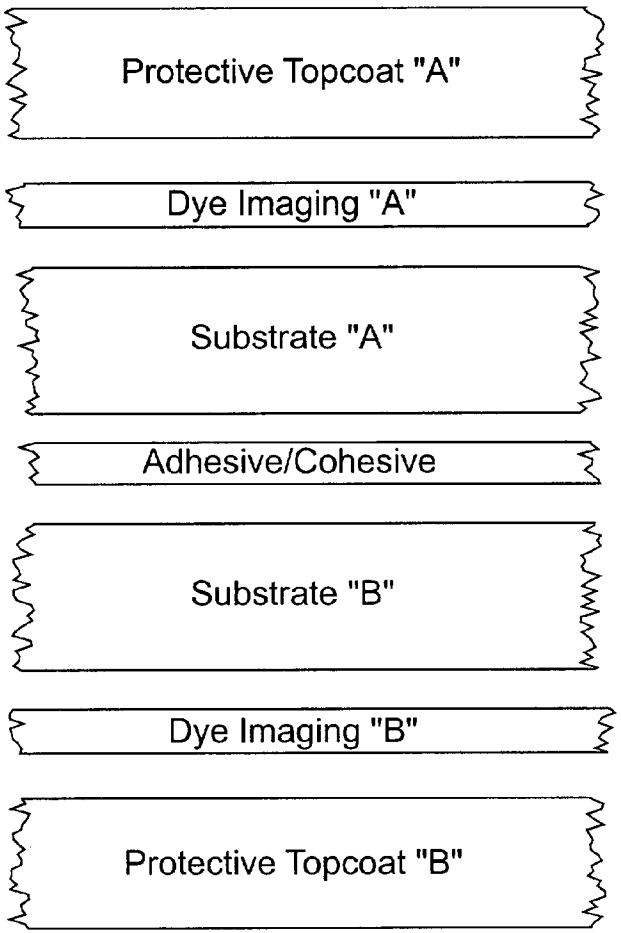
Figure 31A:
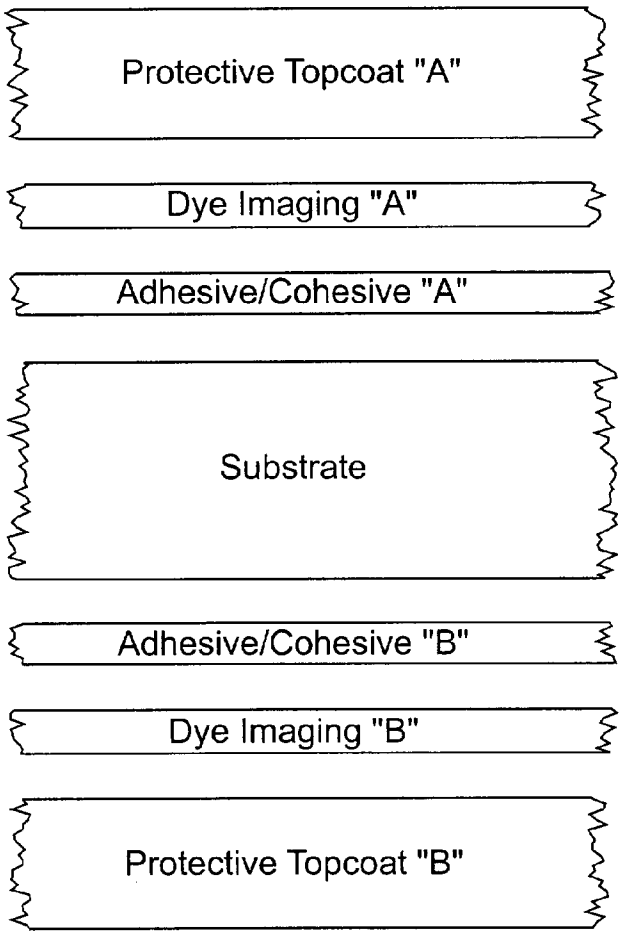

Turning now to FIG. 31, shown is are exemplary prelaminated media in accordance with the teachings of the invention. Both are shown as cross sections through the layers of the laminate in exploded view, using groupings of sub-layers into layers and layer thickness chosen for clarity but without limitation. A shared substrate is shown in the embodiment of FIG. 31*a* while an exemplary split substrate is shown in FIG. 31*b*.

The substrates are preferably translucent and/or transparent, such as so-called "vellum" paper stock or transparent plastic sheet such as, for example, polyester. A total thickness around three to five mil is typical of documents or plastic sheets to be handled by people. The protective topcoat serves multiple functions, as are known in the art, including providing a so called "slip" coat as a possible sub-layer to ease sliding by the printhead and reduce wear as well as to protect the dye imaging layer. The dye layer optionally may comprise protective optional barrier and/or binding sub-layers, for example. In some cases, the protective and dye layers are supplied as a single web to converters, such as with the CL-532 Clear Face stock manufactured by Labelon Corporation of Canandaigua, N.Y. The adhesive/cohesive layer(s) can be any of the well known adhesives, ranging from the very aggressive/sticky and permanent types all the way to the so-called "re-positionable" such as that made by 3M and sold under the trade name "ReMount" and better known as the sticky stuff in "Post-it" products. One advantage of such adhesives is that the ballot part could conveniently be adhered to another surface to aid in handling, such as by the voter and/or by the poll workers and/or by apparatus at the polling place. A cohesive, such as the "exceptionally transparent cohesive" CH252 manufactured by VALPAC Inc. of Hurlock, Md., allows the separated parts to be handled without adhering them to other media. It is known in the converting and laminating art how to prevent air bubbles in such laminations.

Referring particularly now to FIG. 31*a*, shown is a shared substrate labeled "Substrate" that is sandwiched between two similar triple layers, "A" and "B". In order of distance from the substrate, the triple layers comprise: an "Adhesive/Cohesive" layer, a "Dye Imaging" layer, and a "Protective Topcoat" layer, all as already described.

Referring particularly now to FIG. 31*b*, shown is a split substrate system, comprising two triple layers, again referred to as "A" and "B, adhered by a layer labeled "Adhesive/Cohesive," as already described. Each triple layer comprises, in order away from the adhering central layer, a "Substrate", a "Dye Imaging" layer, and a "Protective Topcoat" layer, all as already described.

Figure 32A:
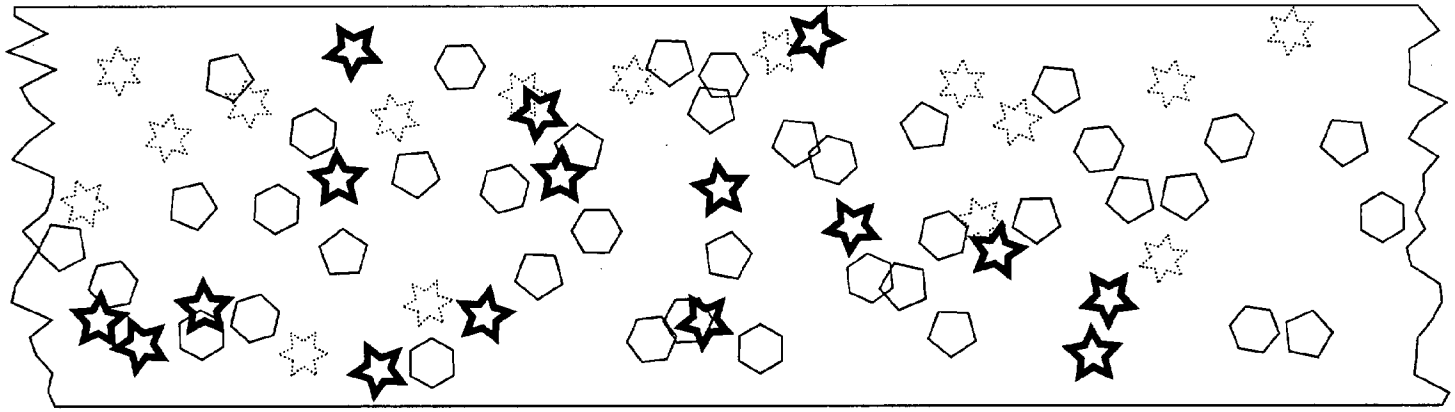
Figure 32B:
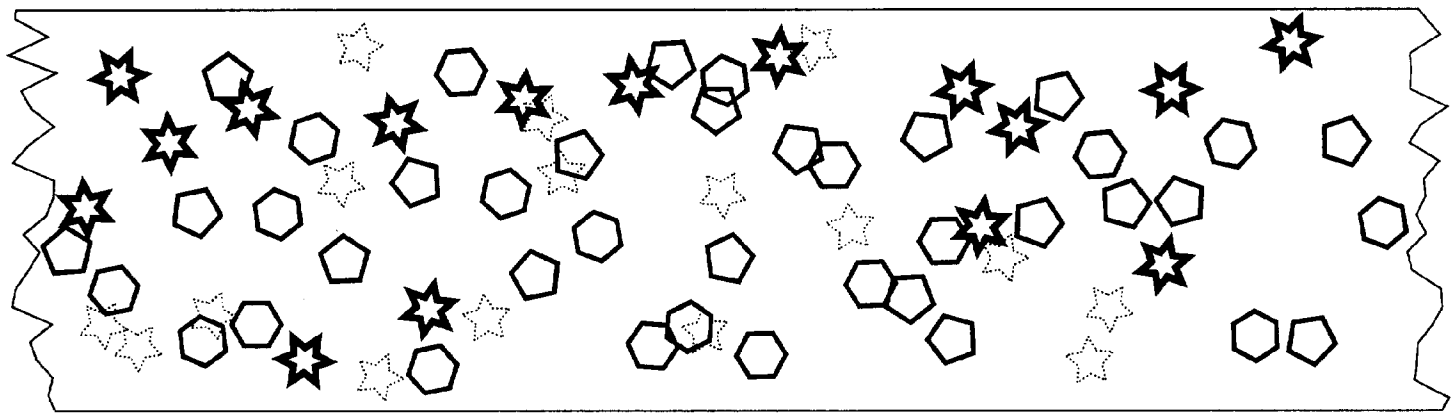

Turning now to FIG. 32, shown is exemplary media that changes from one transmissive color to another in accordance with the teachings of the present invention. Such a dye-based imaging layer would it is believed be suitable for the metamer-based approach described with reference to FIG. 23. Both figures show a cross section of the same dye imaging layer: FIG. 32*a* shows the layer before heating and FIG. 32*b* shows it after heating. Both layers are shown in the example comprised of a matrix containing four types of particles: the convex polygons are activators and the concave or "star" polygons are dyes. The five-point stars are the first color, say for clarity "green", and in the upper state they provide substantially the color for the layer, making it a transparent green filter, while the other color, the six-sided star, is in a dormant inactive state (shown by dotted lines). When heated, however, the convex polygons are activated (shown by thicker lines), such as by various known techniques used in thermal printing. The activated pentagons "destroy" or otherwise inhibit the color properties of the green dye (shown by turning the lines dotted), in a fashion such as is known in photography; the hexagon activators, at the same time, cause the six-sided stars to be developed (shown as bold lines) and their color, for instance, blue, to dominate the filter.

Figure 33A:
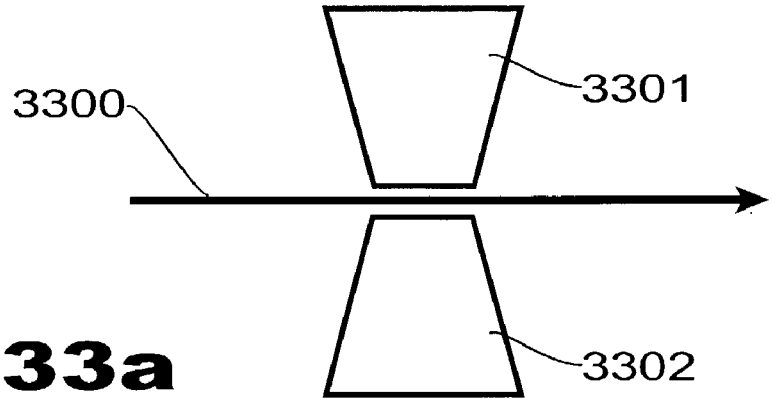
Figure 33B:
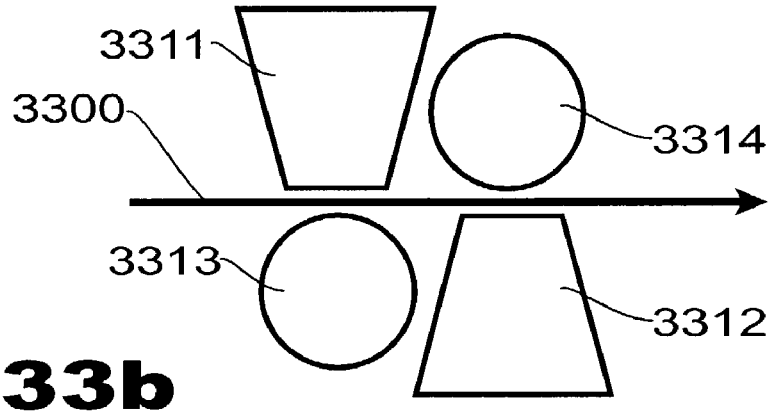
Figure 33C:
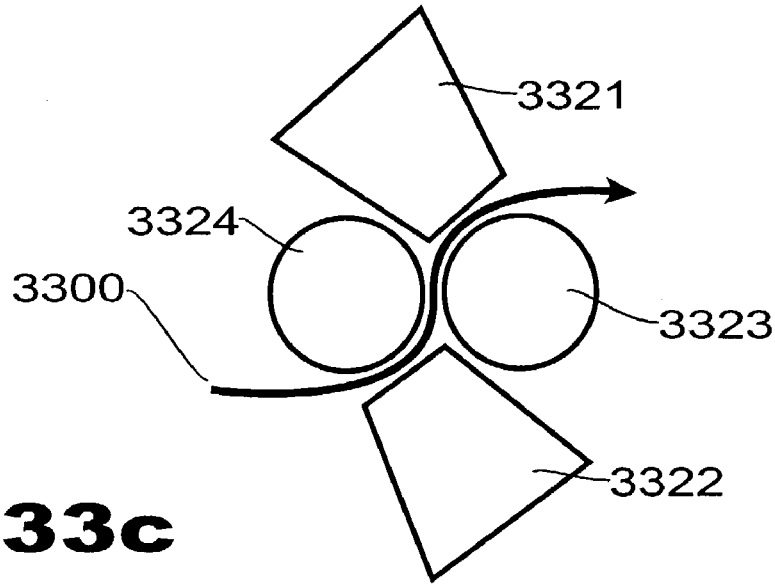

Turning now to FIG. 33, shown in section are exemplary printhead and roller arrangements in accordance with the teachings of the present invention. Three different arrangements of printheads and media are shown, the first FIG. 33*a* is without rollers, while FIG. 33*b* and FIG. 33*c* do contain rollers. As will be seen, the media path is substantially straight in the first two, for instance allowing thicker and/or less flexible stock, while it is substantially curved in FIG. 33*c*. Additional rollers are anticipated, not shown for clarity, that would in some embodiments further guide the media and prevent interference with the mechanism, as is know or could be readily conceived. Also not shown for clarity is the drive arrangement: systems where the rollers shown drive the media and/or where the media is pulled by rollers not shown are anticipated, as are arrangements for synchronously coupling plural rollers in media feed systems and/or providing tensioning with or without sensors. Pressing the media and printhead together is also known in the thermal printer art and can be accomplished, not shown for clarity, by deformable members such as springs or rubber arranged to urge the printheads and/or the rollers towards each other. Various printhead geometries are known in the art, including so called "true edge," shown for clarity, "corner edge" and "flat".

Referring to FIG. 33*a*, shown are two printheads 3301 and 3302 on opposite sides of the ballot stock 3300. If the printheads are flat enough, or broken into sections small enough, then such an approach is believed workable. Additionally, the more deformable the media 3300, the better any aberrations in its thickness and so forth as well as printhead flatness and positioning can be tolerated. Some internal layers, such as the adhesive or even substrate can, it is believed, be made from relatively elastic material, to provide resiliency sufficient to conform to the printheads.

Referring now to FIG. 33*b*, shown are printheads 3311 and 3312 with rollers 3313 and 3314 configured in series with the media suspended between them. This embodiment allows a straight media path, though the gap is believed to potentially introduce more registration errors than a system like that shown in FIG. 33*c*.

Finally, referring to FIG. 33*c*, shown again are two rollers 3323 and 3324 that are substantially in compressing contact around media 3300. Moreover, printheads 3321 and 3322 are also arranged so as to trap media 3300 in between themselves and the respective rollers 3323 and 3324. It is believed that the continuous contact between media 3300 and rollers 3323 and/or 3324 can provide in some example embodiments more control than the configuration of FIG. 33*b*.

Turning now to FIG. 34, exemplary detailed block, schematic, partial ordering, flowchart, plan view, and protocol schema are shown in accordance with the teachings of the present invention. Included are major parts related to a single voter. Shown first is the actual voting choice making by the voter as box 3411.

Next a meta box 3412 is shown following box 3411 temporally, as indicated by the arrow. Three boxes are included, without temporal dependencies indicated. Box 3412*a* is the printing or other rendering of the layers and associated indicia, as has been and will be mentioned further. Box 3412*b* is the printing or other rendering of the shared data, as has been and will be mentioned further. A decision box 3412*c* is shown contained within meta box 3412 that suggests the voter can as optionally part of an ongoing process, presumably based on inspection of the layers, determine whether to accept the layers or not: if not, then optionally the voter may return to make new voting choices, amend choice, or obtain new layers for the existing choices; if yes, the voter moves on to box 3414. In this box, the voter is shown as being able to make a choice between layers, selecting in some examples which layer will be the voter layer and which the system layer, as already mentioned. Preferably before the choice in box 3414 is made, there is a commitment made, box 3413, related to the particular ballot. One way such a commitment can be made is the printing on the form, as has been previously disclosed and as indicated in the present specification particularly with reference to FIG. 36. Another exemplary way to establish such a commitment is by publishing, such as on a computer network, perhaps all the values committed to. Still another approach is to provide as physical storage media, such as optical disc, the commitments. Digital signatures, time-stamping, and so forth can be helpful in ensure the commitments are not surreptitiously changed.

Having accomplished the actions of boxes 3412 and 3413, box 3414 indicates that the voter is preferably able to at least have an influence over what layer will become the voter layer and what layer the system layer. Now meta box 3415 indicates some optional steps, as indicated by the dashed boxes it contains. One is box 3415*a* that scans at least one layer. Scanning the voter layer can for example ensure that it is properly printed and, that it corresponds to the system layer, and/or that the data it contains is made available to the station doing the scanning. The other box in meta box 3415, 3415*b*, indicates that the system layer can be shredded or otherwise destroyed or rendered illegible once the voter choice is made and preferably once it has been at least recognized as correctly corresponding to the voter layer. In some embodiments, to be described in more detail, the system layer can preferably be retained for the purpose of recount and/or audit of ballot style or votes.

Box 3416 depicts that some additional information is preferably but optionally released, after the layer choice is committed, such as that would allow a digital signature to be obtained on the voter layer and/or allow the commit related to the other layer to be verified. Finally, box 3417 provides for the optional verification of the voter layer, which can be by the voter, third parties in person and/or over computer networks.

Turning now to FIG. 35, a plan view and schematic diagram is shown for an exemplary printed two-layer receipt, in accordance with the teachings of the present invention. FIG. 35 a is the form combined as a single piece of material, such as paper, with a dashed line down the middle, which can optionally be a pre-perforation or otherwise allow pre-determined or assisted separation of the two layers shown side by side. The order of the candidates has been shifted, constituting a group element. The position of the indicator, shown as a triangle pointer, on the other layer is a second group element. The pointer points to the candidate chosen by the voter and the voter is believed to be able to readily verify this by inspection of the combined layers. In particular, voted for are James Monroe and Thomas Jefferson. The serial number of the ballot is shown, 9365-4549, and should also be included in the barcode that constitutes the shared data by spanning the shear line as already mentioned.

Figure 35B:
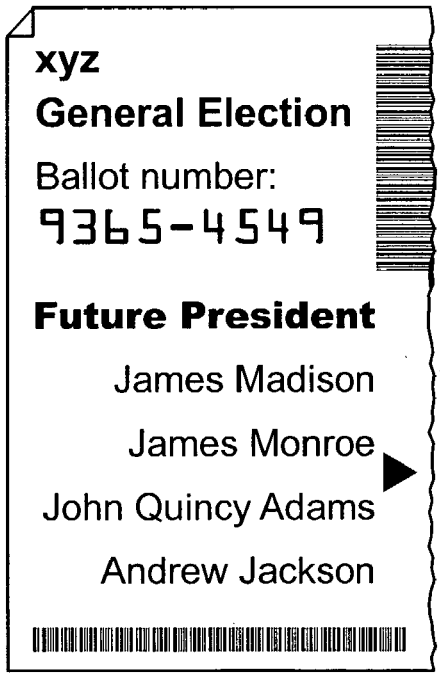
Figure 35C:
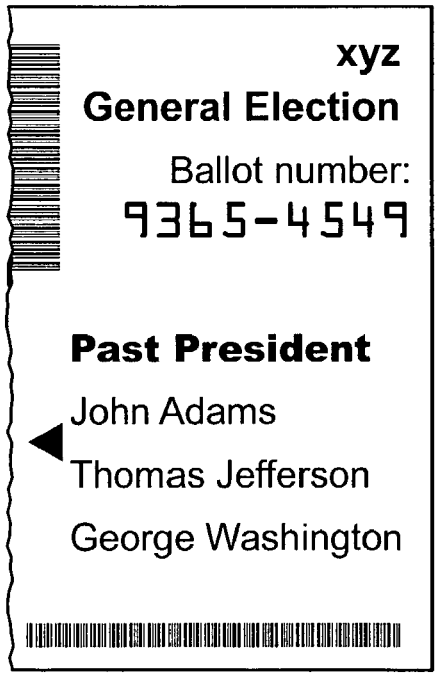

Referring to FIG. 35*b*, what would be regarded as one layer is shown after being processed as the voter layer, as suggested by the barcode at the bottom that would include the key matter providing for signatures and allowing verification of commits published elsewhere as already described. Similarly, FIG. 35*c* is of the receipt represents a layer that has been separated from the whole and has received additional information in the form of extra printing (although this is only an option) as already indicated.

Turning now to FIG. 36, a variation on the embodiment of FIG. 35 is shown in substantially the same way. That of FIG. 36 differs in that the commit is shown included on the form and then when the layers are separated, the commit is kept with the voter layer as shown in FIG. 35*b* and FIG. 36*c* for the right and left layers, respectively.

Turning now to FIG. 37, a plan view and schematic diagram is shown for an exemplary two-layer receipt with a marked ballot, in accordance with the teachings of the present invention. Referring to FIG. 37*a*, the ballot form can be seen with the candidates names for two contests in the canonical order. The rectangular marks along the left edge are traditionally used with mark sense technology to allow registration to the marks filled by a voter; when general-purpose scanners are used, for example, such marks are often omitted.

Figure 37B:
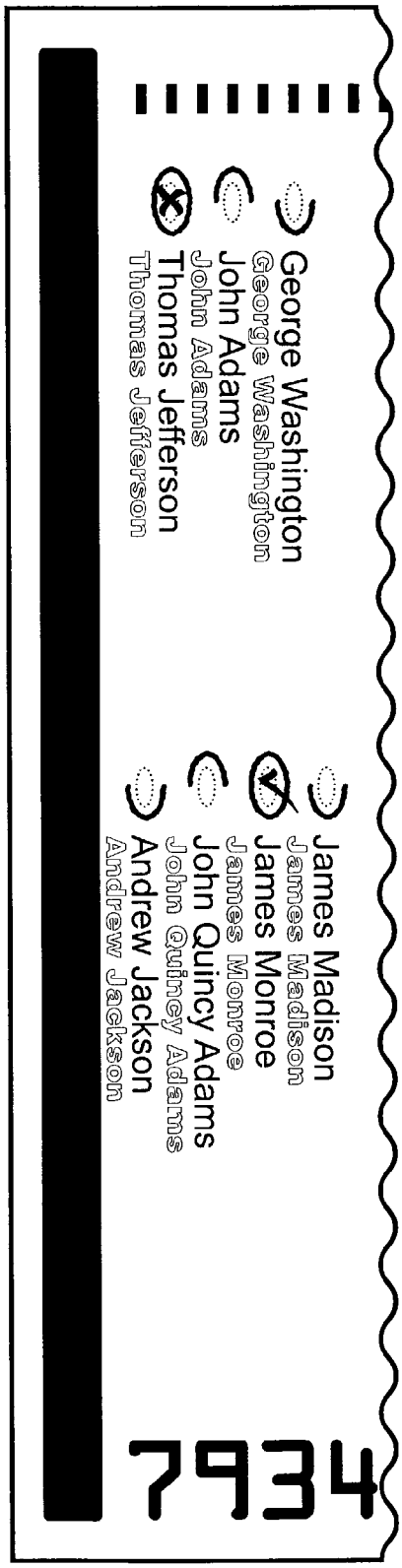
Figure 37A:
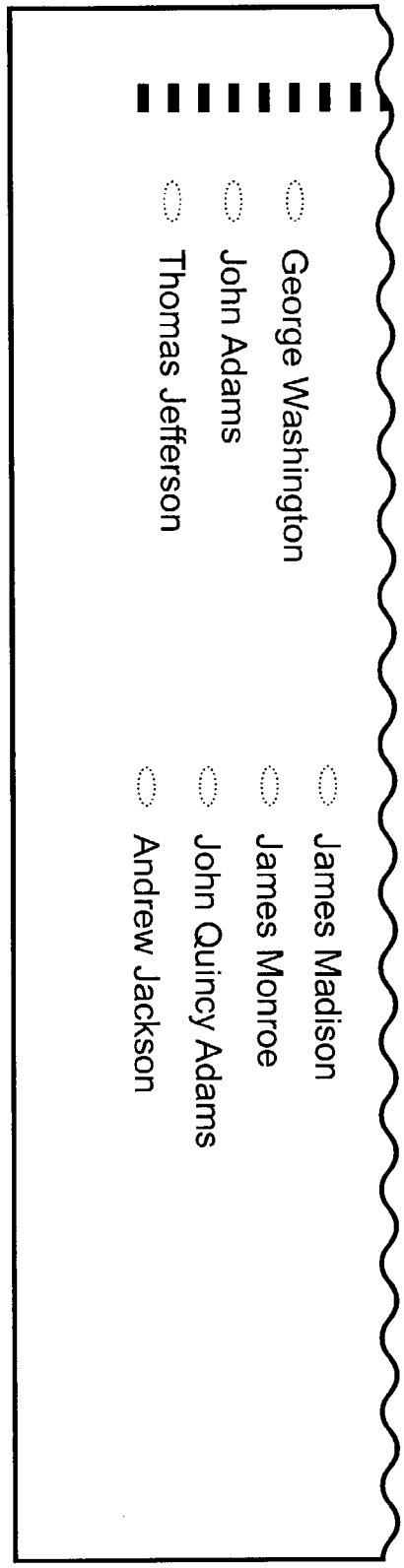
Figure 37D:
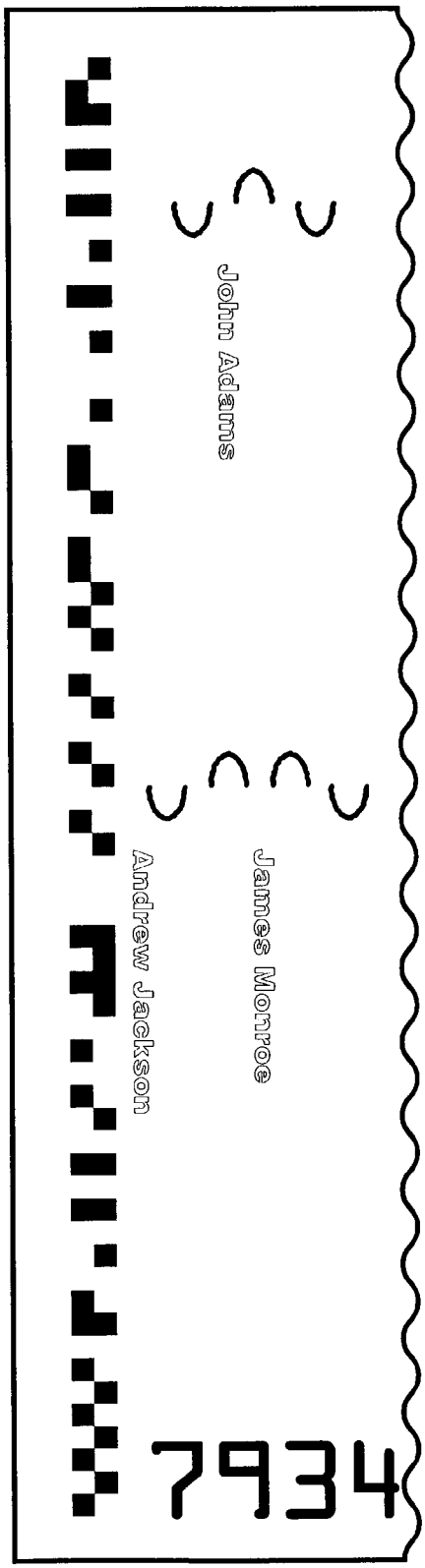
Figure 37C:
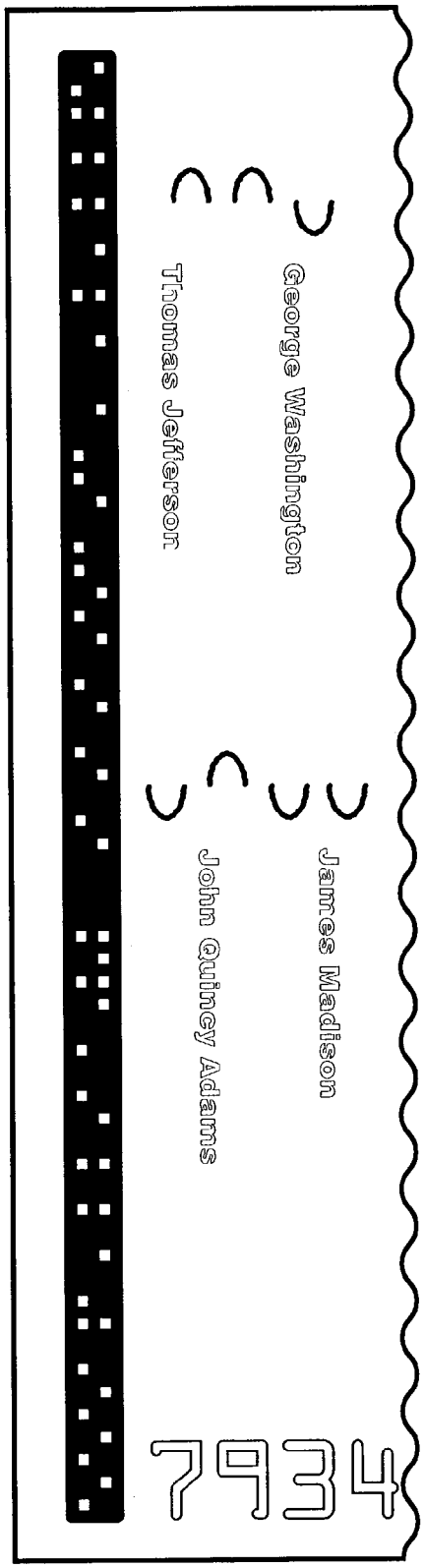

With reference to FIG. 37*b*, shown is the combined ballot: the paper form marked by the voter from FIG. 37*a* on the bottom, and the two transparent foils of FIGS. 37*c–d* to be described layered on top. The marks made by the voter on the ballot are indicated as cross and a check mark, although whatever darkening pattern chosen by a voter and recognized by the scanning technology may be used. The voter marks are encircled by marks that are actually printed on in part on each foil as will be seen; the ovals not marked by the voter have only half of a surrounding symbol, as will be seen to be printed on one or the other transparent foils. The candidate names are repeated in adjacent white space as an optional device to allow the foils to include information that can be used to verify the so-called "ballot style," the candidates and other information contained on the ballot. The solid bar at the bottom is used for the shared data and is made up of parts from each of the two foils. The ballot number is also provided in this example by the foils; this allows the forms to be distributed without regard to the voter instance involved. The serial numbers are show in a font that is intended to allow the voter to easily recognize that the two foils each contain the same serial number, with one being in the example an outline of the other.

Turning to FIG. 37*c–d*, the foils are shown separately. Each can be seen to contain only half of the encircling symbols. The group element being a single bit encoding the direction of the corresponding symbol. The candidate names, as mentioned, appear only once in the example, so as to reduce the issues of registration. Various shortened forms of the candidate names could be included, such as initials, last name only, and so forth. Also the names could be split, say, first on one foil and last on the other. Registration permitting, the letters could be split and/or even finer splits are anticipated. It is believed that splitting the names improves symmetry of the choice provided and includes some checking of ballot style in case either foil is chosen.

Various optical devices, as will be appreciated, can enhance the appearance and clarity of what is presented to the voter. For example, the particular squiggly lines shown are intended to illustrate shapes that have a good tolerance for misalignment. As another example, transparent colors can be printed, so that when two overlap the result is a muddy dark brown or black; but when the two do not overlap, as with the candidate selected, they each appear a bright color, allowing the eye to find the circled candidates even more easily. In some examples, metamer dies are used, so that the combined circle is a single color, but the overlapping half circles are dark.

The bars at the bottom encode the shared data, as already mentioned. The example coding shown is intended to provide substantial tolerance for misregistration of the foils when combined, however, more or less registration may be available as the technology varies and symbologies other than those shown may be more appropriate. Where one coordinate in the matrix is filled in on one foil it should be clear on the other. The framing provided by the symbologies is intended to make the combined layers solid within the registration tolerance. Various schemes can ensure that both are not filled if each is recognizably properly coded. For instance, one scheme would be half open and half filled, another would be including an encoding of the Hamming weight in one's complement. The serial numbers are shown printed one as outline and one as its fill. Since the numbers are preferably also encoded in the machine read part, this readily human-readable version is for convenience in handling. Various other arrangements are possible, including splitting the digits themselves.

Turning now to FIG. 38, a plan view and schematic diagram is shown for an exemplary tactile receipt, in accordance with the teachings of the present invention. Shown is a Braille version substantially similar in parts to that of FIG. 35*a–c*. The optional printing of the serial number in normal text is to facilitate handling by poll-workers and the like. The keys are printed at the bottom in non-tactile form, but could be in tactile as well. The dashed horizontal bars demarcate the contests, which are labeled in Braille. Within a contest, the solid horizontal bars encode the shared data, preferably the bit of shared data corresponding to the candidate immediately below each. The candidate names are printed in Braille. The vote is indicated by the small and large circles, though any symbols could be used. When the two symbols are the same, that indicates the candidate voted for; when the two circles on a given line differ, that candidate is not voted for. It is believed that a voter running his or her finger down the center can readily recognize that the shared data lines are the same across the distance. The double lines encode one bit value, the single the other bit value. The group elements are bits and the operation is exclusive-OR, both for the shared data and for the circles.

Turning to FIG. 39*a–d*, plan view and schematic diagram is shown for an exemplary two-layer receipt with a marked ballot, in accordance with the teachings of the present invention. This figure is shows a variant on that shown in FIG. 37, but here the bars at the bottom encoding the shared data are replaced by the encoding the shared data in the shape and/or orientation of the marks printed on the laminates.

Figure 39A:
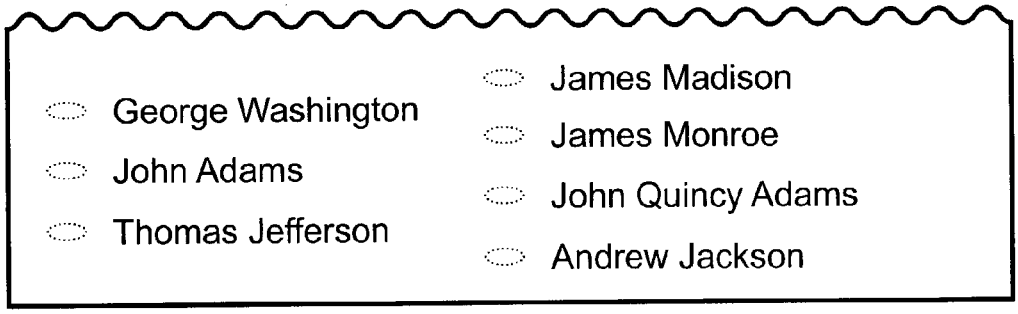
Figure 39B:
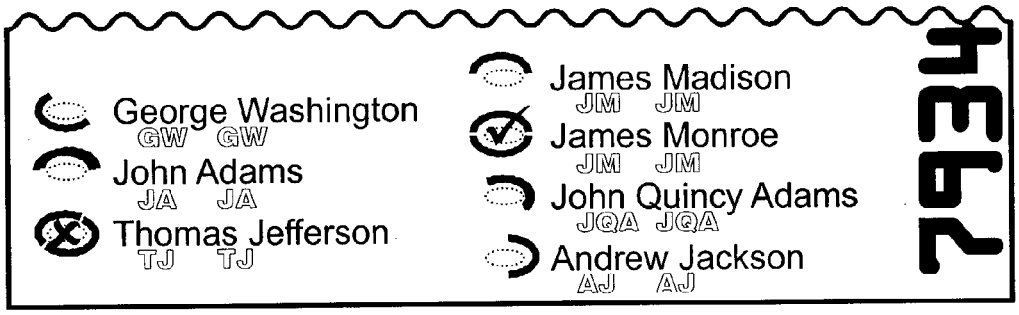

Referring specifically to FIG. 39*a*, the unmarked ballot form can be seen with the candidates names for two contests in the canonical order. Next, referring to FIG. 39*b*, the laminate overlaid on the ballot form is shown. Just as in FIG. 37, the two candidates Adams and Monroe have been marked and have their ovals circled. But, unlike FIG. 37, there are four types of half circles: horizontal split, vertical split, upper-left to lower-right diagonal, and upper-right to lower-left diagonal. The type of half circle chosen for the particular oval position on the form encodes the two bits of shared data corresponding to that location. (Another example way to encode different combinations is with different colors, not shown here for clarity.)

Figure 39C:
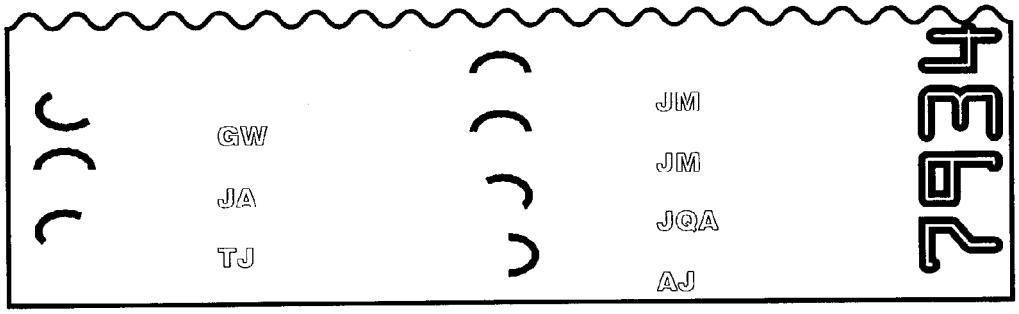
Figure 39D:
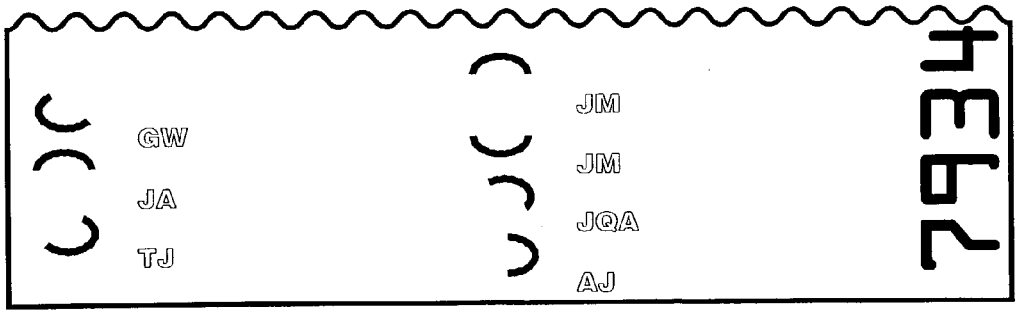
Figure 40A:
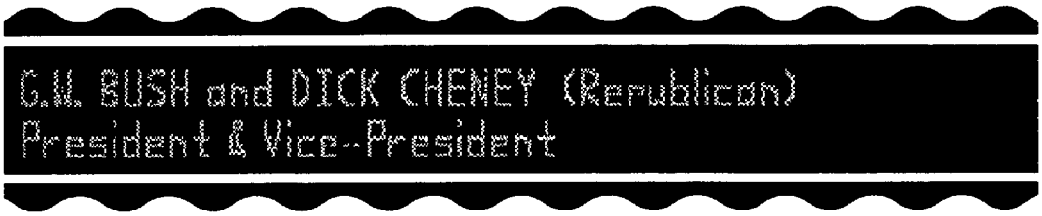
Figure 40B:
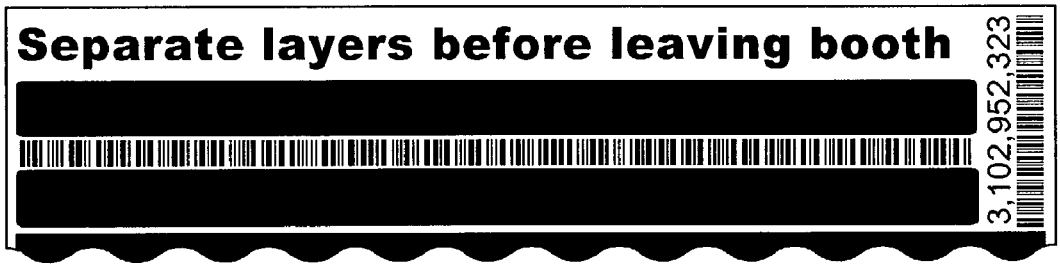
Figure 40C:
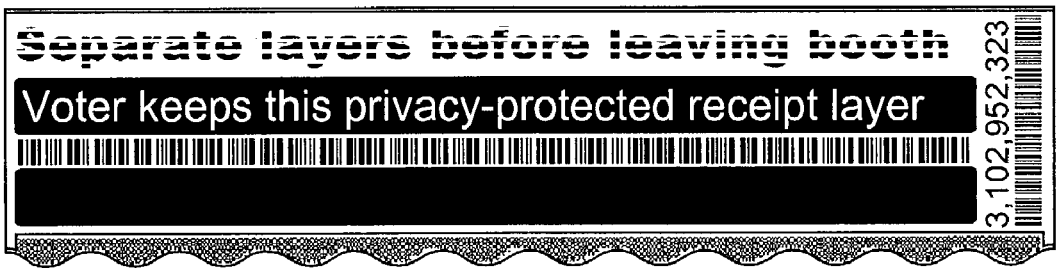
Figure 40D:
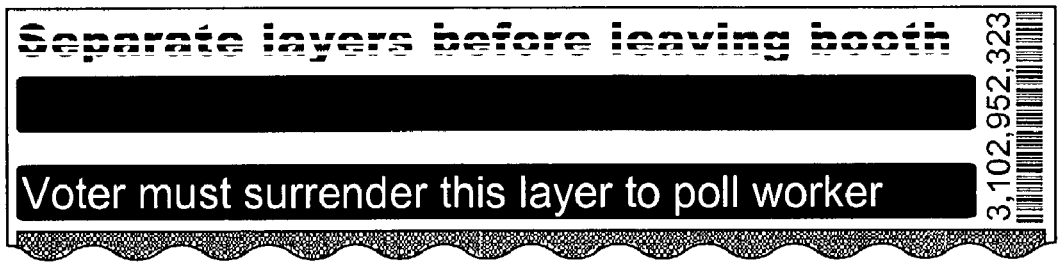

Referring to FIGS. 39*c* and 39*d*, the two laminates are shown separately. The overlapping serial numbers can be seen by the thickened shape, illustrating a single example. The candidate initials are used instead of candidate names as in FIG. 37, again to illustrate another example.

Turning finally now to FIG. 40*a–d*, a plan view and schematic diagram is shown for an exemplary two-layer receipt, in accordance with the teachings of the present invention. In particular, a user experience with a pixel-based receipt is described next as a user experience scenario, for clarity, as will be appreciated.

After making your choices on a touch screen or the like, when using this new approach, a small printer that looks like those at cash registers prints the main part of your receipt. This printout shows your vote and only your vote. The names of those candidates you chose, together with indication of such things as office sought and party affiliation, would be listed as well as your choice on any ballot questions. Included would be any allowed "write-ins" or choices you made, such as with "open primaries" or "instant-runoff voting". There could even be warnings about contests or questions not voted. (As detailed later, there is a security feature, such as an unbroken black background around the text, that voters should also check for at this point.) You are then asked whether or not you agree with the receipt so far; and, if you don't agree you can amend your vote and try again. (Referring to FIG. 40*a*.)

If you do agree with the receipt, you are asked to indicate whether you wish to take the top or the bottom "layer" of the two-layer receipt. Overall security hinges on your freedom to choose, even though it is an arbitrary decision, which layer you want to keep. Once you've chosen, a further inch or so is printed and the then complete form is automatically cut off and presented to you. (referring to FIG. 40*b*.)

As you separate the two layers, you will notice that each layer is mainly a different, unreadable and seemingly random pattern of tiny squares printed on a transparent plastic material—it was the light passing through the combination of still-laminated layers that showed your choices. The special printers used differ from ordinary single-color receipt printers only in that instead of just printing on the top side of the form, they can also simultaneously print separate but aligned graphics on the bottom side of the form.

The last inch printed contains per-layer messages that are clearly readable only when the layer is viewed separately. Whichever layer you had selected as the one you keep, whether top or bottom, would bear a message like "voter keeps this layer" (referring to FIG. 40*c*), while the other layer would state something like "provide this layer to official" (referring to FIG. 40*d*). On the way out, you hand the poll worker the layer marked for them. They make sure they got the right layer and as you watch they insert it into a small transparently-housed paper shredder in which it is destroyed.

Outside the polling place you might find one or more groups, such as the League of Women Voters, prepared to verify the validity of your receipt if you wish. They simply scan it and immediately let you know that it is valid (by subjecting the receipt's printed image and coded data to a consistency check and saving the results for later confirmation online). If they were ever to detect an invalid receipt, incorrect operation of election equipment would be indicated, hopefully before any unwitting recipients of invalid receipts had already left he polling place. You can even, on the official website, look up the page for the range of serial numbers that includes your receipt, and check for yourself that it has been posted correctly.

After the polls close, and all agreed receipts are posted on the website, a series of encrypted process steps used to produce the tally is also posted. Then randomly-selected samples of it are decrypted and posted. The choice of samples is made so that it does not reveal so much information as to compromise privacy. The samples do reveal enough, however, that anyone can run a simple open-source program that checks them against the published process steps to verify that the totally correctly resulted from exactly the votes encoded in the posted receipts.

It is important to ask, as with any security system: What are the properties claimed? How does the mechanism work? and What is the proof that the mechanism really ensures the properties? First all three questions are considered in introductory overview, starting with the first question. Then introductory answers to the second and third questions are combined for each of three aspects: the receipts, the tally process, and the cryptography. Finally the system is detailed more formally and the properties are proved.

All manner of variations, modifications, equivalents, substitutions, simplifications, extensions, and so forth can readily be conceived relative to the present inventions by those of ordinary skill in the art. One example, as will be appreciated, All manner of variations, modifications, extensions, equivalents, substitutions, simplifications, extensions, and so forth can readily be conceived relative to the present inventions by those of ordinary skill in the art. Some examples that may also be mentioned elsewhere include: What values are committed to, when, how, and how they are opened completely or partly to establish relationships are subject to innumerable variations, as is know in the cryptographic art. The two halves committed could be viewed on screen, and only the chosen one printed. The actual vote in clear could be printed on a third portion of the form and retained by the polling place for possible backup, recount and/or counting as part of certification. Instead of printing a digital signature on the form, it could be printed on a sticker that could then be affixed automatically (the serial numbers could be aligned barcodes and there could be secret numbers that also match). A poll-worker could use a barcode scanner to read the code from the ballot part to be kept, and this reader's output used to determine which halves to post and/or which ballots were not split before the voter left. Part of the ballot form may be retained by the precinct and another part shredded, thereby allowing manual checking that all were split and to discovers which ones if any were not split, but without letting poll-workers see the confidential data. The coin-flipping device can be tamper-resistant and be designed to first learn the ballot number (such as by barcode), and only then perform the flip, and after that issue a digitally authenticated message that can be used to determine what half to sign or post. The shared data using can be reduced by using the image under a cryptographic hash function or the like; this is believed to reduce the protection of integrity from the information theoretic potential to the merely computational.

While these descriptions of the present invention have been given as examples, it will be appreciated by those of ordinary skill in the art that various modifications, alternate configurations and equivalents may be employed without departing from the spirit and scope of the present invention.

What is claimed is:

1. A physical form comprising a plurality of separable parts for entry of a plurality of voter options by a voter, said form further comprising:

an indication on at least one part of the plurality of separable parts, said indication comprising a plurality of voter options;

at least a first part and a second part of the plurality of separable parts that are adapted for receiving an encoded indication of a voter choice of at least one voter option of the plurality of voter options, such that said voter choice is recognizable by the voter in a combination comprising at least the first part and the second part, and such that said voter choice is substantially unrecognizable to the public when either the first part or the second part of said plurality of separable parts is excluded from the combination, wherein shared information is encoded on at least a part that is separable from the first part and wherein substantially the same shared information is encoded on at least a part that is separable with the second part, wherein shared information content that is encoded on at least the part that is separable with the first part is recognizable by the voter as substantially the same as shared information content that is encoded on at least the part that is separable with the second part.

2. The form of claim 1, wherein each part of the plurality of separable parts comprises a layer and wherein the voter choice is recognizable by the voter when the plurality of parts are layered.

3. The form of claim 1, wherein the voter choice is recognizable by the voter when the first part and the second part are positioned side by side.

4. The method of claim 1, wherein the encoded indication on the first part includes an encoding of the voter's choice and the encoded indication on the second part includes an encoding of the voter's choice.

5. Apparatus for producing a form comprising a plurality of separable parts, said apparatus comprising:

first coding and indicia producing means for producing on at least two parts of the plurality of separable parts, an encoded portion of a voter choice from a plurality of voter options, such that said voter choice is recognizable by the voter when the at least two parts are examined in combination, and such that said voter choice is substantially unrecognizable to the public when any one part of the at least two parts is examined separately; and a second coding and indicia producing means for encoding shared information on a first part of the plurality of separable parts and for encoding substantially the same shared information on a second part of the plurality of separable parts, wherein the shared information encoded on the first part provides content that is recognizable by the voter as substantially the same as content of the shared information encoded on the second part.

6. The apparatus of claim 5, said apparatus further comprising:

a means for producing said form in a separably attached state so that the form can be separated into parts.

7. The apparatus of claim 5, said apparatus further comprising:

a means for receiving retention indication from a voter, wherein said retention indication comprises an indication that determines at least one part of the at least two parts that is to be retained by the voter.

8. The apparatus of claim 5, wherein at least two of the parts of the plurality of parts each comprise layer information, said apparatus further comprising:

a means for producing an alignment registration between the layer information of at least two layers so that information encoded in the layer information is recognizable by the voter as the voter choice when the at least two layers are aligned in combination according to the alignment registration.

9. The apparatus of claim 5, said apparatus further comprising:

a means for creating a digital signature on at least one part of the plurality of separable parts of said form, wherein the digital signature authenticates at least part of a set of information recognizable to the public on the at least one part.

10. The apparatus of claim 5, wherein the first coding and indicia producing means produces an encoded portion on the first part including an encoding of the voter's choice and the encoded portion on the second part including an encoding of the voter's choice.

* * * * *